US012220049B2

(12) United States Patent
Fischer et al.

(10) Patent No.: US 12,220,049 B2
(45) Date of Patent: Feb. 11, 2025

(54) TOOTHBRUSH

(71) Applicant: TRISA HOLDING AG, Triengen (CH)

(72) Inventors: Herbert Fischer, Reitnau (CH); Thomas Gabriel Stolz, Unterwasser (CH)

(73) Assignee: TRISA HOLDING AG, Triengen (CH)

( * ) Notice: Subject to any disclaimer, the term of this patent is extended or adjusted under 35 U.S.C. 154(b) by 584 days.

(21) Appl. No.: 17/419,112

(22) PCT Filed: Dec. 24, 2019

(86) PCT No.: PCT/EP2019/087017
§ 371 (c)(1),
(2) Date: Jun. 28, 2021

(87) PCT Pub. No.: WO2020/136198
PCT Pub. Date: Jul. 2, 2020

(65) Prior Publication Data

US 2022/0071381 A1 Mar. 10, 2022

(30) Foreign Application Priority Data

Dec. 27, 2018 (WO) ..... PCT/EP2018/097050

(51) Int. Cl.

| | |
|---|---|
| ***A46B 9/04*** | (2006.01) |
| ***A46B 5/00*** | (2006.01) |
| ***A46B 5/02*** | (2006.01) |
| ***A46B 7/00*** | (2006.01) |
| ***A46B 7/04*** | (2006.01) |

(52) U.S. Cl.
CPC ..... *A46B 9/04* (2013.01); *A46B 5/00* (2013.01); *A46B 5/0095* (2013.01); *A46B 5/021* (2013.01); *A46B 7/00* (2013.01); *A46B 7/04* (2013.01); *A46B 7/042* (2013.01); *A46B 7/044* (2013.01); *A46B 2200/1066* (2013.01)

(58) Field of Classification Search
CPC ..... A46B 5/0095; A46B 5/021; A46B 7/04; A46B 7/042; A46B 7/044; A46B 9/04; A46B 2200/1066
See application file for complete search history.

(56) References Cited

U.S. PATENT DOCUMENTS

| | | | | |
|---|---|---|---|---|
| 4,461,053 | A | 7/1984 | Nitzsche et al. | |
| 2003/0074755 | A1* | 4/2003 | Ale | A46B 7/04 15/201 |
| 2009/0049632 | A1* | 2/2009 | Holowecky | A46B 11/0003 15/167.1 |

(Continued)

FOREIGN PATENT DOCUMENTS

| | | | |
|---|---|---|---|
| CN | 1444888 | A | 10/2003 |
| CN | 201048683 | Y | 4/2008 |

(Continued)

OTHER PUBLICATIONS

Feb. 11, 2020 Search Report issued in International Patent Application No. PCT/EP2019/087017.

(Continued)

*Primary Examiner* — Randall E Chin
(74) *Attorney, Agent, or Firm* — Oliff PLC

(57) ABSTRACT

A toothbrush including a main body with a grip part as well as a brush head which forms a bristle field with a plurality of care bristles.

19 Claims, 19 Drawing Sheets

(56) References Cited

U.S. PATENT DOCUMENTS

Figure 1A:
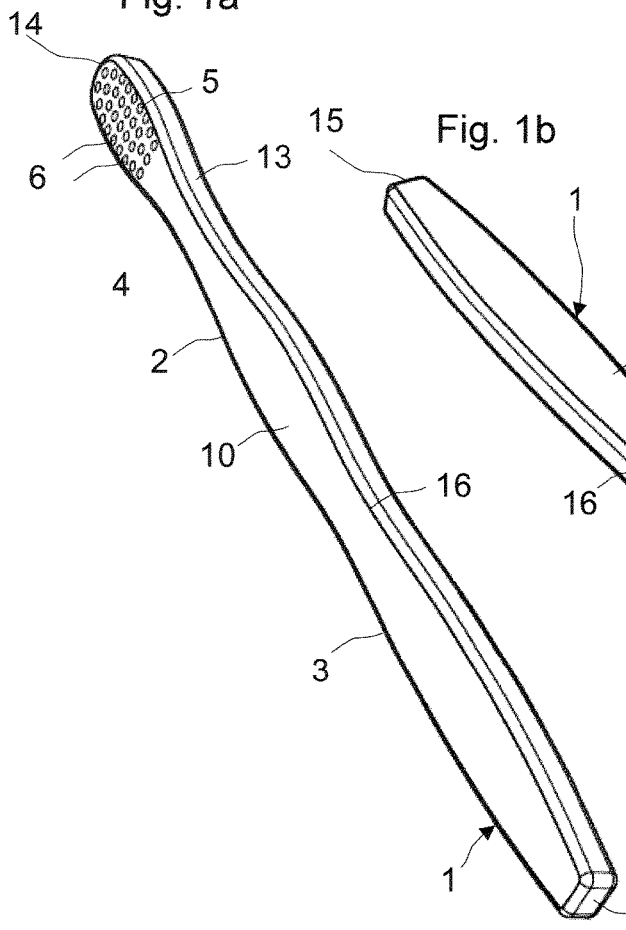

| | | | | |
|---|---|---|---|---|
| 2014/0352093 | A1* | 12/2014 | Bresselschmidt ..... | A46B 9/04 15/167.1 |
| 2017/0164724 | A1* | 6/2017 | Moskovich ..... | A46B 3/005 |
| 2018/0317640 | A1 | 11/2018 | Schar et al. | |

FOREIGN PATENT DOCUMENTS

| | | | | |
|---|---|---|---|---|
| CN | 101716028 | A | | 6/2010 |
| CN | 102441930 | A | | 5/2012 |
| CN | 202367825 | U | | 8/2012 |
| CN | 202388347 | U | | 8/2012 |
| CN | 106213763 | A | * | 12/2016 |
| CN | 106419056 | A | * | 2/2017 |
| DE | 9318453 | U1 | | 3/1994 |
| DE | 200 06 311 | U1 | | 8/2001 |
| DE | 202008007975 | U1 | | 10/2008 |
| KR | 200437728 | Y1 | * | 12/2007 |

OTHER PUBLICATIONS

Feb. 11, 2020 Written Opinion of the International Searching Authority issued in International Patent Application No. PCT/EP2019/087017.

Jun. 21, 2023 Third Party Observation for European Application 19832406.3.

* cited by examiner

Fig. 3i
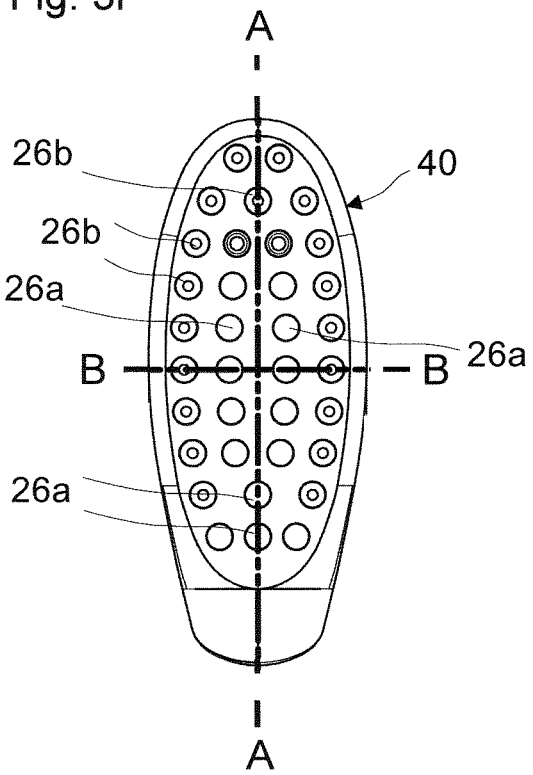
Fig. 3j
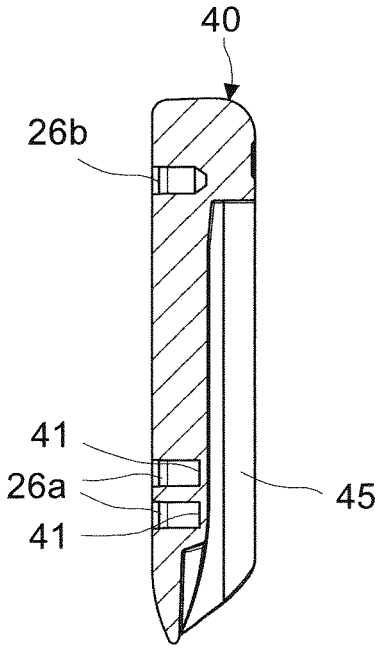
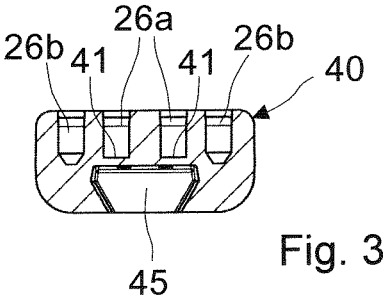
Fig. 3k

Fig. 4c
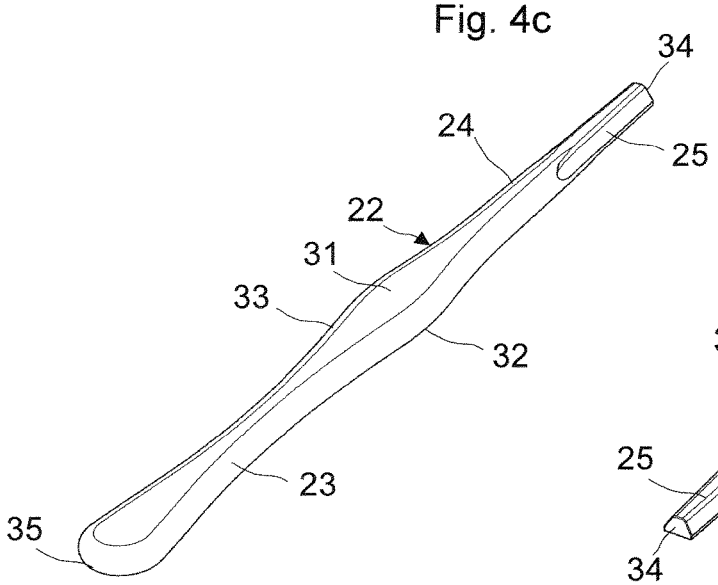
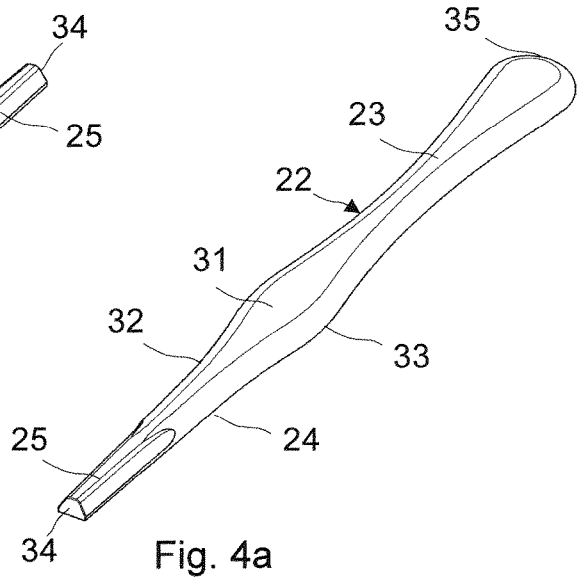
Fig. 4a
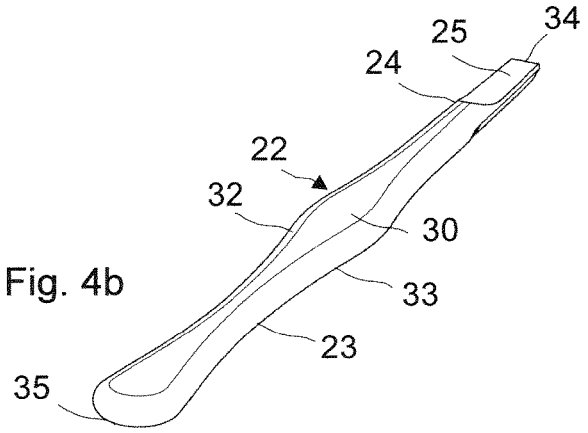
Fig. 4b
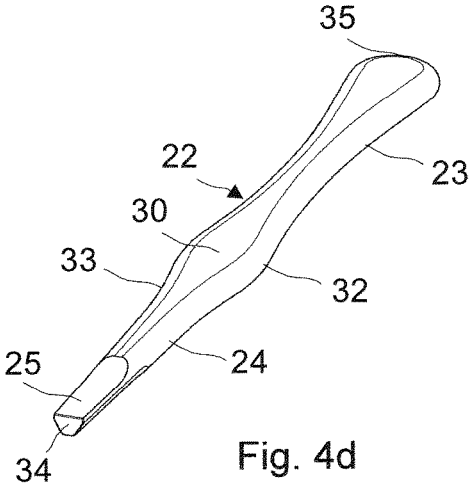
Fig. 4d

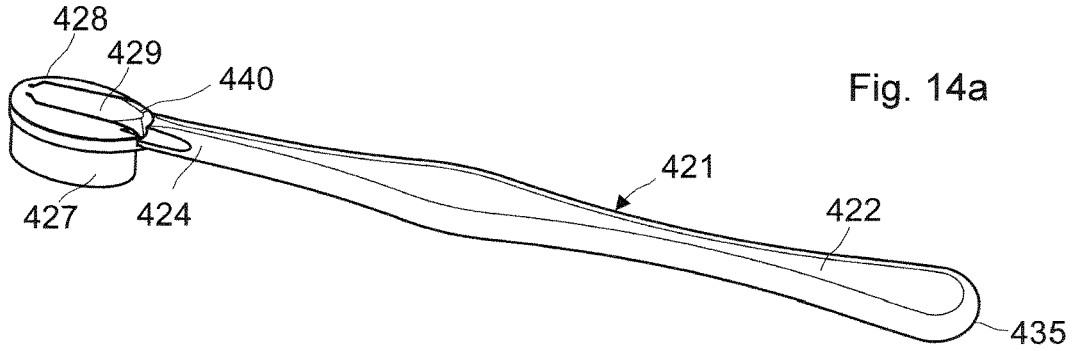
Fig. 14a
Fig. 14b
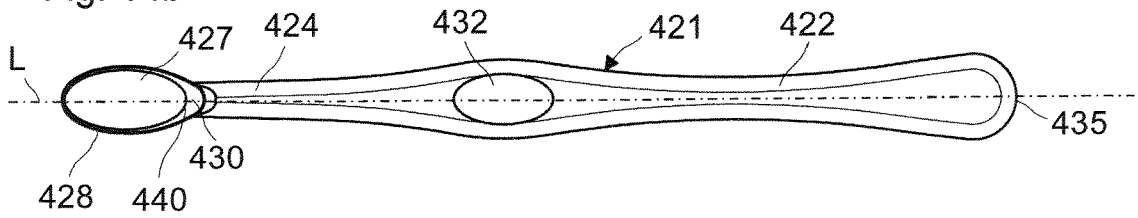
Fig. 14c
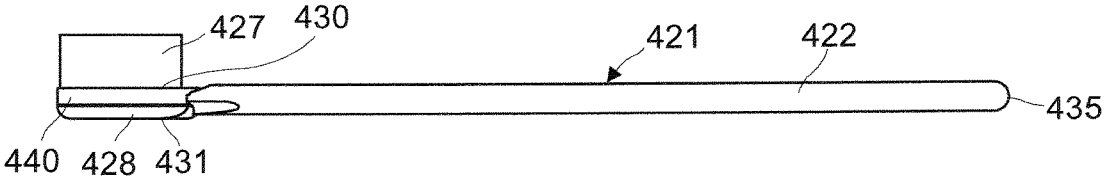
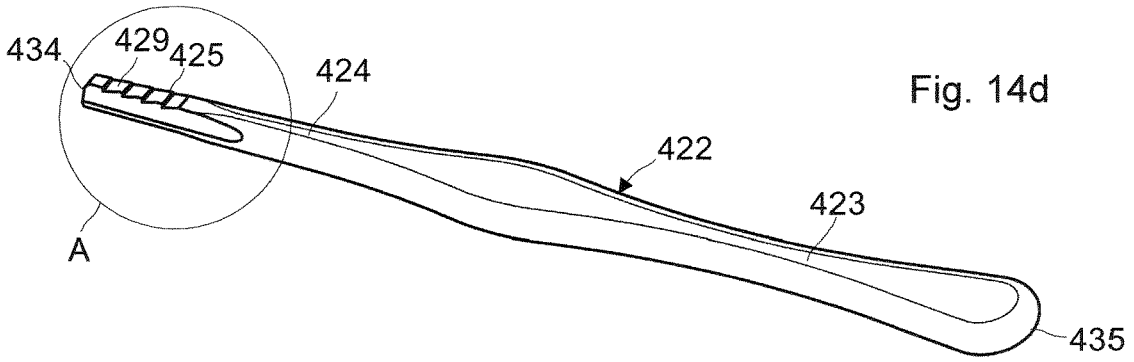
Fig. 14d
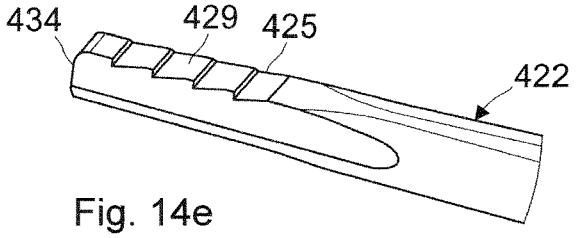
Fig. 14e
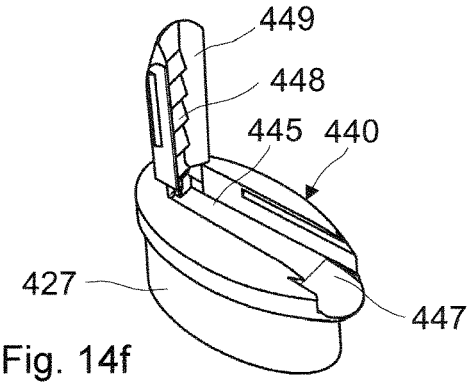
Fig. 14f Fig. 15a
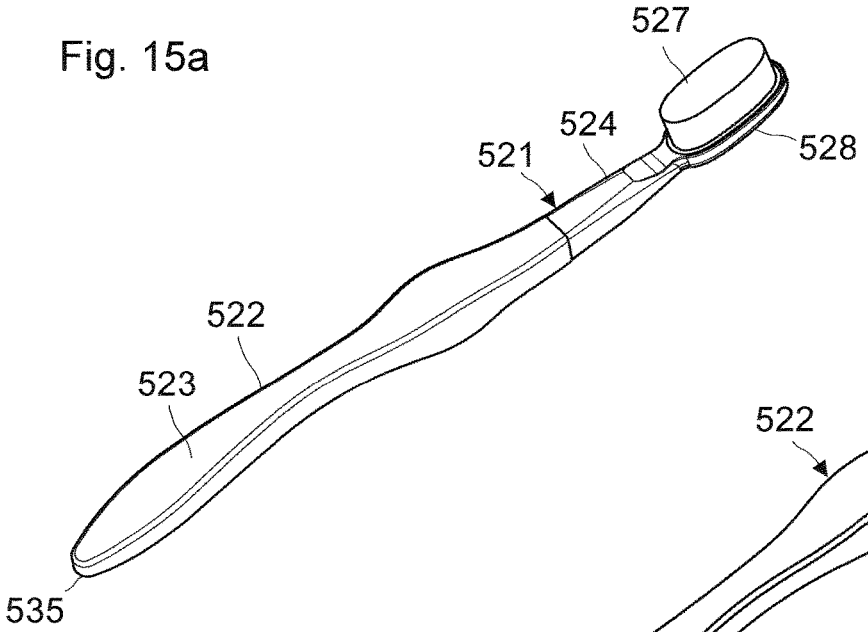
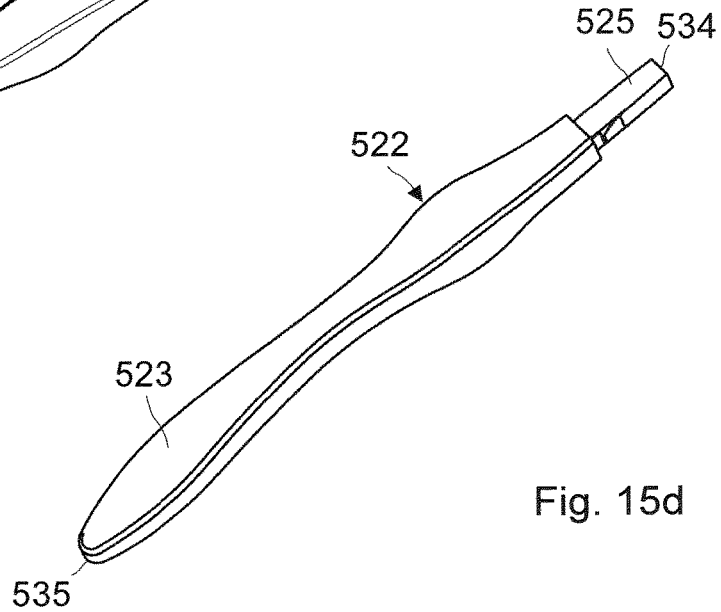
Fig. 15d
Fig. 15b
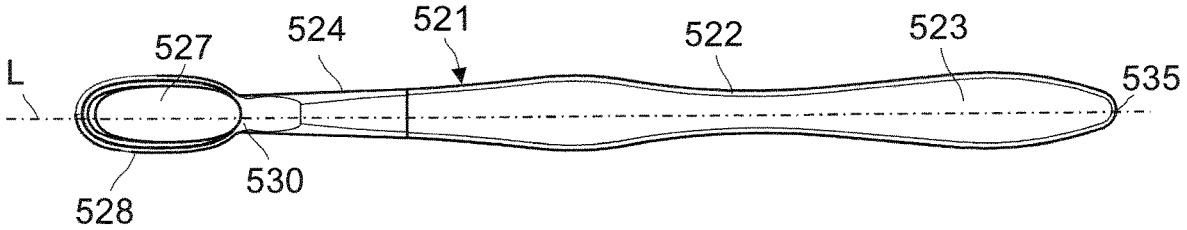
Fig. 15c
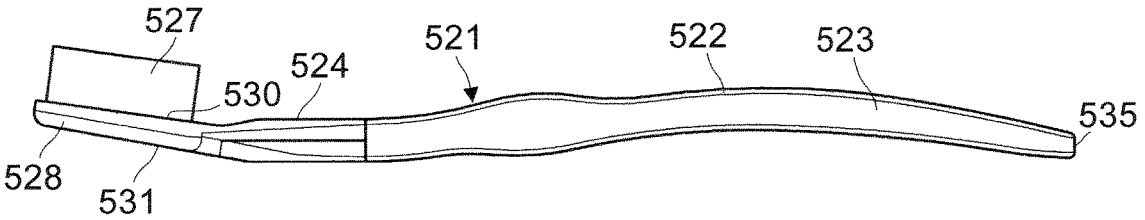

Fig. 16b
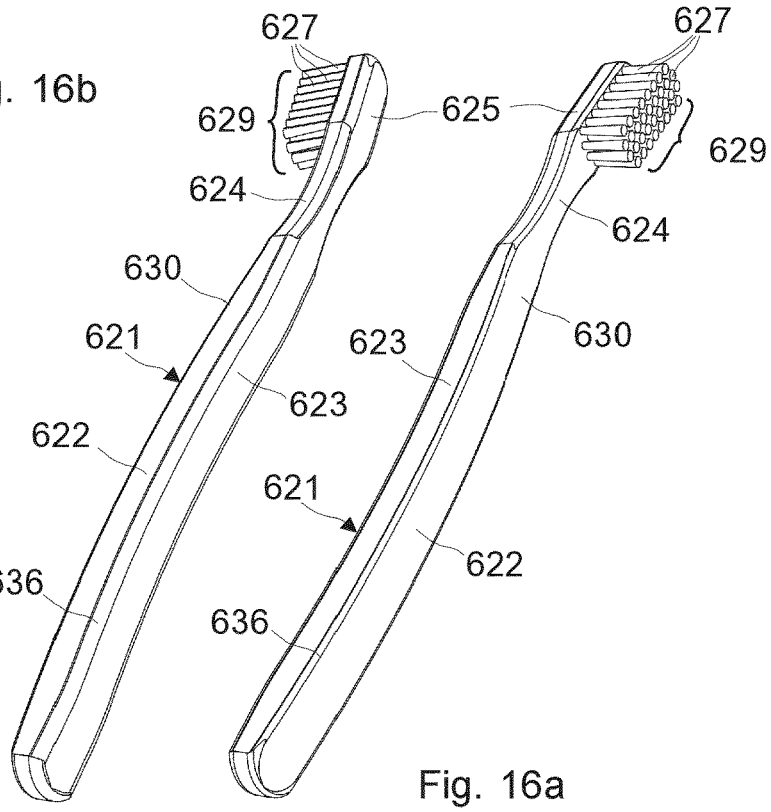
Fig. 16a
Fig. 16d
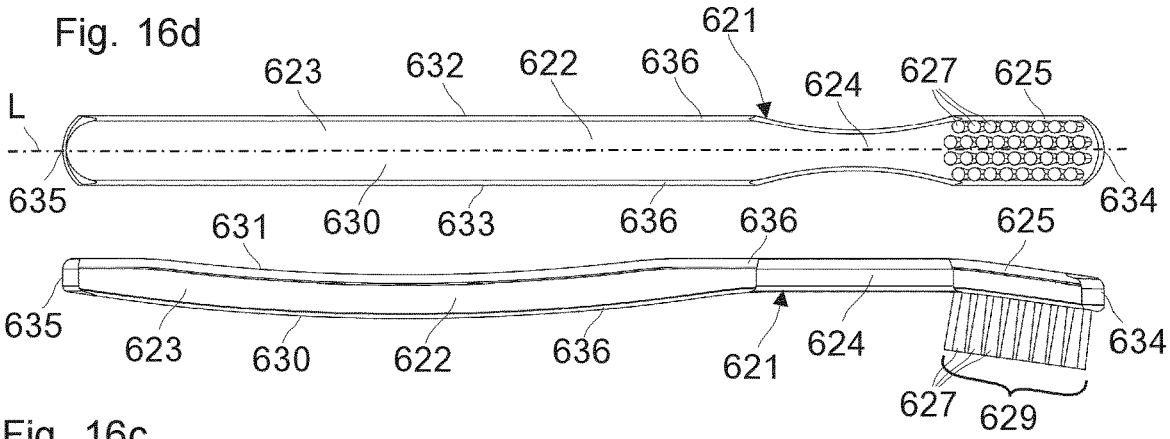
Fig. 16c
Fig. 16e
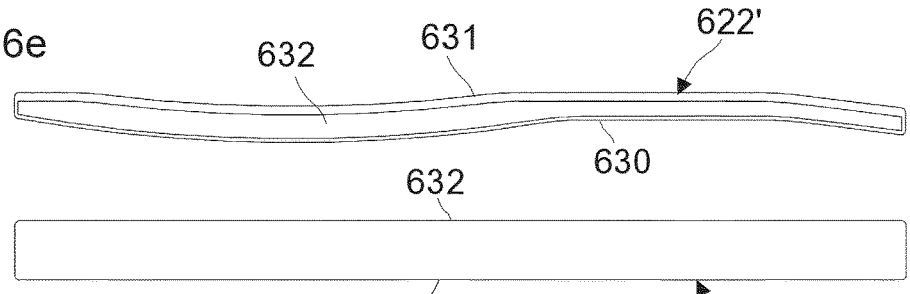
Fig. 16f

TOOTHBRUSH

The invention relates to a toothbrush, comprising a main body with a grip part as well as a brush head which forms a bristle field with a plurality of care bristles or tooth cleaning bristles. The grip part serves for holding the toothbrush with the hand.

The invention further relates to a method for manufacturing the toothbrush as well as to a device for carrying out the method.

It is known to manufacture toothbrushes with a main body by way of an injection moulding method of plastic. Toothbrushes which are manufactured from a plastic which is capable of being injection moulded have the disadvantage that these cannot be biologically broken down or only to a certain extent and are therefore ecologically problematic, which is to say are not ecologically sustainable.

Indeed, approaches by way of which this problem is to be remedied are known from the state of the art. Hence CN-Y-201048683 describes a toothbrush with a grip part of bamboo wood. A toothbrush of solid wood whose surface is treated with a varnish is also described by CN-A-101716028.

Wood as a renewable raw material is a particularly ecological material. For this reason, wood is also particularly well suited for manufacturing a toothbrush with high ecological demands.

Known toothbrushes of wood comprise a head part with a plurality of bristle holes, into which the bristle bundles can be brought by way of a conventional anchor punching method.

Since toothbrushes of ecologically compatible materials such as wood cannot be manufactured by way of injection moulding or only to a limited extent, alternative manufacturing methods must be considered, by way of which methods such toothbrushes can be manufactured as economically as possible, i.e. with as little handwork as possible as well as in high piece numbers.

Common to the manufacturing methods is the fact that the shape of the main body which forms the grip part must be worked at least partly out of a raw body.

The manufacturing method which is specified or described in the course of the description of the invention is discussed by way of example in the context of the material wood. However, in principle it can be used for the most varied of materials which are capable of forming a corresponding raw body. In this context, plastics, in particular moulded plastic, stone, ceramic, glass, mother of pearl, metals, pressed materials such as pressed fibres (e.g. mechanical pulp, cellulose), pressed paper or also materials which are generally based on vegetable fibres such as paper etc. can be used.

The raw body preferably has a similar consistency, hardness and/or machining characteristics as wood.

In order to meet the ecological concept, other substances or materials which are based on organic materials can also be applied analogously to the wood which is predominantly discussed in this document. Other organic materials are for example renewable, pressed materials such as pressed or connected biomass, grass, wood fibres, bamboo, etc.

Structural features of the toothbrush or its main body or method features which are disclosed in the context of the material wood or its machining herewith are also to apply to other possible materials which are mentioned in the course of this description and which originate form a raw body or block which for the manufacture of the base body of the toothbrush is machined at least partly in a material-removing manner.

It is the object of the present invention to suggest a toothbrush as well as a method for manufacturing such a toothbrush, and a device for carrying out the method, said toothbrush being machined at least partly from a raw body. The toothbrush preferably has an improved ecological balance compared to a conventional toothbrush.

Furthermore, the toothbrush should be manufacturable as inexpensively as possible.

Furthermore, the manufacture of the toothbrush should be scalable. This means that the toothbrush should also be economically manufacturable in a large piece numbers.

Furthermore, the toothbrush should have a high cleaning performance and be pleasant in its handling.

This object is achieved by the features of the independent claims. Particular embodiments and further developments of the invention are to be derived from the dependent patent claims, the description as well as the figures.

The main body of the toothbrush in particular comprises a front side and a rear side. The front side corresponds to that side, on which the thumb is placed of cleaning the teeth. The front side further corresponds to that side which faces the bristle field of the toothbrush. The rear side corresponds to that side which is away from the bristle field of the toothbrush. This definition also applies to the brush head body which is mentioned further below as well as to the bristle carrier element.

The front side of the main body is shaped in particular from the upper side of a blank which is yet described further below. The rear side of the main body in particular is shaped from the lower side of the blank.

Furthermore, the main body in particular comprises a longitudinal narrow side which is to the left and right in a plan view upon the front side. The left and right longitudinal narrow sides correspond to the two longitudinally running sides of the main body which laterally delimit the front and rear side of the main body or connect these to one another. The longitudinal narrow sides lie opposite one another.

The longitudinal narrow sides and the front and rear side thus form so-called longitudinal sides which run in the longitudinal direction of the main body.

The main body in particular comprises a grip part for holding the toothbrush with the hand.

The main body can comprise a neck section which connects the grip part to the brush head which is to be formed. The neck section is consequently arranged between the grip part and the brush head which is to say in the transition from the grip part to the brush head.

The neck section in particular is characterised by a smaller cross section than the brush head and possibly also a smaller cross section than the grip part.

The neck section can have a minimal cross-sectional area of 25 $mm^2$-70 $mm^2$, in particular of 35 $mm^2$-50 $mm^2$. Various trials with samples have show that the lower cross sections can lead to breaks in the neck section.

The main body can further form a head part or alternatively a connection section. The connection section can be part of the brush head which is to be formed. The connection section can be part of a neck section which is particular is co-shaped by the brush head body. The connection section lies along the longitudinal axis in particular in front of a possibly present thumb rest considered in the direction of the grip end.

Furthermore, the main body in the grip part in particular comprises a rear face side as well as a front face side which lies opposite the rear face side and which in particular is arranged in a head part or in a connection section.

The main body in particular is a single part. However, it is also conceivable for the main body to be of several parts.

The main body in particular consists of a single material.

The main body in particular consists of a non-plastic material. The main body in particular consists of a material which is not injection-moulded. The main body in particular consist of a material which is worked out of a raw body or comprises such. The main body in particular consists of a material which can be machined in a material-removing manner or comprises such.

In particular, the main body comprises wood or a wood material. The main body in particular consists of wood.

The main body can also consist of several different materials.

Thus the main body can consist of wood and metal. The main body can also consist of wood, metal and plastic.

The main body can also consist of wood and plastic. The main body can also consist of an organic material and metal. The main body can also consist of an organic material, metal and plastic. The main body can also consist of an organic material and plastic.

The main body can comprise different wood types. The main body of wood can in particular consist of different wood types.

The main body can comprise several parts of different wood types. The main body of wood can consist of several parts of different wood types.

The main body can comprise several parts of the same wood. The main body of wood can consist of several parts of the same wood.

The main body can comprise differently treated wood of the same wood type.

The main body of wood can also consist of differently treated wood of the same wood type.

According to a particular modification of the invention, the main body however can also consist of stone, ceramic, glass, mother of pearl, moulded plastic, pressed fibres (e.g. mechanical pulp, cellulose), pressed paper, material based on vegetable fibres such as paper, or metal or combination thereof, or comprise this.

A multi-part main body can consist of a single material or of several different materials. Hence at least a part can be of wood and at least a part of plastic. Hence a rear part of the main body can be of wood and a front part of plastic. The part of wood can be e.g. milled or turned.

It is also possible to form a main body of wood and/or metal and/or plastic, wherein concerning a main body of wood, metal and plastic, the metal part can preferably be positioned between the wood and the plastic.

The metal part can also serve as a thumb rest or be such.

The metal part can also comprise connection means which permit a brush head of plastic to be releasably fixed thereon.

It is also possible for a multi-part main body to consist of different wood types or to comprise these. The wood parts of the main body can be connected to one another e.g. by way of assembly, (ultrasound) friction welding, positive fit and/or bonding.

Combinations of these method cans also be used. Furthermore, different materials in a specific selection can be connected to one another by these methods, for example wood and plastic by way of welding.

The multi-part design of the toothbrush can herein be used for the functional characteristics of the product. For example, a brush head of plastic can be removed or exchanged, whilst the grip of wood or a combination of wood and metal can be used several times.

The main body can be formed of layers of different material, such as wood materials.

Herewith, one can succeed in different product optics arising. Furthermore, the flexibility or the main body can be defined precisely. Layers of different materials which are mentioned above can also be used.

It is generally possible, by way of application of different wood types, to provide an assortment design and for example with different wood types to create different optics and/or to display a different application field (e.g. dark and/or hard wood: whitening toothbrush; light and/or soft wood: sensitive toothbrush). This can also be achieved by a different treatment of the same wood type.

Furthermore, different wood types can be applied for example such that a different wood type or a differently treated wood type which is better suited to the humid conditions in a toothbrush glass is applied at the lower end of the grip part (grip end). The wood type which comes to lie in the toothbrush glass, on account of the special treatment has a greater resistance to water (e.g. water absorption, colour change, bacterial decomposition, formation of algae, etc).

The main body is formed at least partly from a solid body or full body. The main body in particular is a solid body or full body.

The main body can consist of solid wood, stone, ceramic, glass, mother of pearl, moulded plastic, injection moulded plastic, pressed fibres (e.g. mechanical pulp, cellulose), pressed paper, materials based on vegetable fibres such as paper or metal or combinations of the specified materials.

The main body in particular consists of solid wood.

The main body can also be formed as a layered body with several wood layers which are connected, in particular bonded to one another. The wood layers can be of the same wood or of different woods.

Accordingly, the arrangement of the wood layers can be adapted to the characteristics of the wood layers.

The main body as a layered body can consist of several materials which are connected to one another such as solid wood, stone, ceramic, glass, mother of pearl, moulded plastic, injection moulded plastic, pressed fibres (e.g. mechanical pulp, cellulose), pressed paper, materials based on vegetable fibres, such as paper, or metal or combinations of the specified materials.

It is also possible for the layered body to comprise one or more layers of a material, such as plastic, which does not consist of wood.

The layered body can comprise a sandwich construction. The layered body can thus comprise two outer-lying layers of wood and one or more layers which lie therebetween, of plastic, stone, ceramic, glass, mother of pearl, moulded plastic, injection moulded plastic, pressed fibres (e.g. mechanical pulp, cellulose), pressed paper, materials which are based on vegetable fibres, such as paper, or metal or combinations thereof. The construction can also be the other way around.

On using a multi-layered construction, it is possible for certain layers to undergo a pre-treatment/pre-machining.

For example, a wood layer which lies in the main body on the front side can also already be provided with bristle holes or sections of bristle holes. On account of the layer-like design, the bristle holes or their sections in particular are designed in a continuous manner.

The bristle hole base can be formed by a further layer which is not provided with bristle holes. The layer with the bristle hole base—with a view upon the front side—in particular lies below the layer or the layers with the bristle holes or the bristle hole sections.

It is also possible for the bristle holes to each be formed from several bristle hole sections which in particular are arranged in a continuous manner in different, but adjacent layers. The bristle holes in this case are not completely formed until the connection of the layers. For this, on connecting the layers, the bristle hole sections are arranged in register to one another.

Due to the fact that the bristle holes are designed in a continuous manner in the respective layer(s), apart from the known methods such as drilling and milling, further method for shaping the bristle holes can also be used. For example, the bristle holes can be designed by way of laser cutting or water jet cutting on account of this. The bristle holes therefore, apart from a circular shape can also assume further non-circular shapes or other shapes compared to bristle holes manufactured by way of drilling.

Thus bristle holes with essentially angled corners such as triangles, quadrangles, rectangles, trapeziums or other closed contours such as ellipse, sickles or banana shape or general freely shaped surfaces can be formed. The corners of the bristle holes in this case are preferably provided with a radius.

With regard to the outer contour, it is possible to put together already machined layers, so that the arising main body after putting together already has its final shape or at least has its basic shape. The pre-machining in this case, apart from incorporating the bristle holes into the layer(s) also includes the prior shaping of the outer contour on the layers.

It is further possible to put together machined and unmachined layers, so that the machining is still partly necessary.

Furthermore, it is also possible to put together unmachined layers and to only start the machining of the outer contour thereafter. The pre-machining in this case only comprises the bringing of the bristle holes into the layer(s).

The main body can also consist of several wood parts in the longitudinal direction. The wood parts can consist of the same wood type or of different wood types.

The aforementioned characteristics concerning the main body with regard to the construction and material of course also relate to a blank, such as a blank body or block, from which the main body is manufactured.

The term "wood" is not to be understood in the strict botanical sense, but rather from a material-science point of view, according to which in particular also lignified (e.g. wooded) vegetable tissue also represents a wood.

Furthermore, the term "wood" is also to be understood as a technically modified wood or a material which is obtained from wood and is brought into a wood-like form.

As described above, apart from wood, all materials which can be machined starting from a blank and/or materials which can be subjected to material removal are considered, in particular also materials which are based on organic substances.

The main body can consist of a deciduous wood, such as chestnut, oak, beech, lime, pear, apple, walnut, poplar, birch, elm, ash or acacia or comprise this.

The main body can consist of an evergreen wood such as Douglas pine, spruce, larch, Scots pine or pine or comprise this.

The main body can consist of a pre-treated or pre-machined wood such as ebony, thermo-ash or steamed beech or comprise this.

In particular, the main body is of a primary wood. The main body can also be of a recycled wood.

The main body can further consist of bamboo, liquorice or cedar wood or comprise this. Liquorice or cedar wood is characterised by its particular effect or its particular smell and/or taste.

In particular, the applied woods are FSC certified or have other sustainability certificates.

The applied wood in particular is characterised by its high share of closed pores and accordingly by its comparatively low water absorption.

If the applied wood is open-pored, then the surface should be sealed, e.g. by way of wax or varnish. Apart from the comparatively high water absorption, open-pored woods can also have the disadvantage that these lead to an irritation of the mucous membrane of the mouth.

Particularly preferably beech is used. This wood is characterised by a low to non-existent tear formation on machining, in particular on drilling and on punching (bringing the bristles into the pre-prepared bristle holes). Furthermore, the wood has an optimal density and is compact. In particular, the wood has no pronounced annual ring structure, which simplifies the machining. Furthermore, on using beech wood, the limit values for the pull-out forces of the care bristles or bristle bundles can be maintained.

Extensive trials with the most varied of wood types have shown that a pull-out weight of at least 1.6 kg, preferably at least 1.8 kg is achieved with fluted anchor wire and beech wood according to DIN EN ISO 20126. Further wood types such as bamboo do not achieve these values and are there less preferably applied.

The aforementioned characteristics concerning the main body with regard to the material of course also apply to a blank, from which the main body is manufactured.

In particular, the main body is not manufactured in an injection moulding method.

In particular, the main body is at least partly provided or manufactured from a blank.

In particular, the main body is provided or manufactured from a blank.

In particular, the blank is a full body or solid body.

In particular, the blank is of wood as already described above in the context of the main body.

Other materials can be at least partly analogously processed.

For manufacturing the blank, a tree trunk is separated, in particular sawn into raw planks in the longitudinal direction, which is to say parallel to the axis of the trunk or along the annual rings. This is effected e.g. in a saw mill.

The thickness of the raw planks can be 20 mm-90 mm, in particular 35 mm-75 mm.

The raw planks are subsequently dried. This can be effected e.g. by way of storage.

The raw planks can thus be dried in a drying chamber. The drying process here lasts for about four weeks.

The raw planks can also be dried by way of air drying. The raw planks can be stored outdoors and/or in a covered manner. The raw planks can be dried in a manner stacked upon one another. Here, the drying process lasts somewhat longer, specifically about 1 year.

For the further machining of the dried raw planks, these in particular have a wood humidity/wood moisture content $u_{g1}$ of 7% to 10% (equilibrium moisture content). If however the wood is to be reshaped, then a higher moisture content is desirable, as is yet described further below.

In order to achieve the necessary wood humidity values, it is also possible to combine the two drying methods, since in particular lower values can be achieved on drying in the drying chamber. Hence a further drying in the drying chamber can follow the air drying.

In a subsequent processing step, the dried raw planks are each cross cut (longitudinal cross cutting), i.e. separated, transversely to the trunk axis (fibres). The cross cutting in particular is effected by way of sawing.

The length of the cross-cut plank sections in particular corresponds to a multiple of the length of the blanks which are to be manufactured and from which the main body of the toothbrush is to finally be manufactured by way of material-removing machining.

Accordingly, on cross cutting the raw planks, the cross cut cutting length can be calculated in. The cross cut cutting length corresponds to the length of the loss of wood transverse to the sawing cut, this being caused by the sawing. Accordingly, the cross cut cutting length in particular corresponds to the width of the saw blade. This can be 1 mm-10 mm, in particular 2 mm-7 mm.

Accordingly, the length of the plank section results from the sum of x*length of blank+(x−1)*cross cut cutting lengths.

The length of the blank at this method stage in particular corresponds to at least essentially the length of the main body which is to be manufactured and thus of the toothbrush. The length of the blank at this method stage can even correspond to the length of the main body which is to be manufactured or part of the main body if this is of several parts. However, the blank at this method stage can have an overdimension in the longitudinal direction as well as in the transverse direction, said overdimension being removed with the material-removing machining of this blank into the main body.

Accordingly, a plurality of plank sections which each have a multiple of the length of the blank to be manufactured are cross cut from an individual raw plank.

The planks or plank sections do not necessarily need to be raw planks or solid wood planks. It is also conceivable for the planks or plank sections to be semi-finished products of a multi-layer composite which is already mentioned above.

The plank sections are hereinafter divided up in the longitudinal direction, i.e. parallel to the trunk axis (fibres) into so-called scantlings. In particular, the separating is effected by way of sawing. The width of the separated scantling accordingly corresponds to the width of the blanks which are to be manufactured.

On separating the planks sections into scantlings, accordingly the cutting length is also calculated in. As already mentioned, the cutting length corresponds to the length of the loss of wood transverse to the sawing cut which is caused by the sawing. Accordingly, the cutting length in particular corresponds to the width of the saw blade.

Accordingly, the width of the plank section in particular results from the sum of x*width of scantling+(x−1)*cutting length.

The manufacture of the scantlings from the plank section in a step can be effected by way of a multi-blade circular saw. The scantlings which are manufactured therefrom can have a width of 15 mm-30 mm, in particular of 18 mm-26 mm as well as a height of 6 mm-15 mm, in particular of 8 mm-12 mm. This method in particular is applied with smaller piece numbers.

The manufacture of the scantlings from the plank section can also be effected in two steps. In a first step, cuboids are separated from the plank section in the longitudinal direction by way of a multi-blade circular saw. The cuboids can have a width of 50 mm-90 mm, in particular of 65 mm-75 mm, as well as a height of 60 mm-100 mm, in particular of 75 mm-80 mm.

In a second step, scantlings are manufactured from the cuboids by way of a fine blade circular saw. The scantlings can have a thickness or height of 6 mm-15 mm, in particular of 8 mm-12 mm as well as a width of 10 mm-40 mm, in particular of 20 mm-30 mm.

Fine blade circular saws have the advantage that they produce less waste. This method is therefore applied in particular with larger piece numbers.

The scantlings which are manufactured according to the method described above have a cuboid shape.

Instead of scantlings however pre-blanks with other cross sections, such as e.g. round cross sections can be manufactured. The following machining steps can partly be done away with in this case, for example the planing of the surfaces. Furthermore, other methods can be applied for the manufacture of round pre-blanks, so that the round shape is achieved.

Optical or visual quality controls can be carried out between or during the individual working steps, by way of which controls intermediate products of deficient quality, e.g. of poor wood can be sorted away.

After the separating from the plank section, the scantlings can be machined in a material removing manner, in particular planed, along their four longitudinally running sides (along the trunk axis or fibre) to the subsequently specified dimension.

The post-machined scantling in particular has a thickness or height of 4 mm-10 mm, very particularly of 5-10 mm. Furthermore, the scantling in particular has a width of 10 mm-25 mm, very particularly of 15 mm-22 mm.

Furthermore, the scantling has a length which corresponds to a multiple of the length of the blanks to be manufactured, including the cross cut cutting lengths.

In a subsequent step, the scantlings are cross cut or shortened to length to the final length of the blank to be manufactured. The final length can have a tolerance.

The blanks which are cut to length, along their four longitudinally running sides (along the trunk axis or fibres) can be planed to the dimension which is specified above in relation to the scantling, inasmuch as this is not already effected with the scantlings.

The cuboid blank (now the blank to be manufactured) is consequently planed in particular at four sides. The face sides run transversely to the fibres and in particular are not planed.

Basically, the planing as a material-removing machining method is preferred to a sanding, since sanding can leave residues such as mineral substances or adhesive from the sanding means, such as sanding paper, on the wood. Such residues on the one hand contaminate the product which must meet high hygienic demands and on the other hand lead to an increased wear of the tools of machine tools for carrying out subsequent machining steps.

An individual main body of a toothbrush and finally an individual toothbrush can now be manufactured from the individual blank.

It is also possible for the scantlings to be cross cut or shortened to length to the final end length of several blanks (multiple blanks), in particular two blanks (double blanks), plus cross cut cutting length(s).

With multiple blanks therefore several blanks are arranged one after the other in the longitudinal direction. With double blanks two blanks are arranged one after the other in the longitudinal direction.

The length of a double blank can be 200 mm-500 mm, in particular 250 mm-450 mm.

The width of the blank or multiple blank can be 10 mm-30 mm, in particular 17 mm-23 mm. The thickness or height can be 8 mm-20 mm, in particular 10 mm-15 mm.

The separation of the multiple blanks transversely to the longitudinal direction in particular is effected by way of sawing, e.g. by way of a fine blade saw, in particular fine blade circular saw.

The multiple blanks can be cross cut, i.e. separated into individual blanks or main bodies before the subsequently described further machining steps which also include the profiling of the sides (front side, rear side, longitudinal narrow sides, face sides) in a material-removing machining method, or not until subsequent to further machining steps.

In particular, the multiple blanks are separated into individual blanks after the profiling of their four longitudinal sides.

The profiling of multiple blanks has the advantage that less individual parts need to be profiled. Furthermore, larger workpieces which comprise several blanks are easier to handle. Furthermore, longer longitudinal sides can be machined by multiple blanks, and this in turn simplifies the machining process.

The material-removing machining, i.e. profiling, of double blanks can be of a nature such that the main bodies which are worked out of the double blank in a material-removing manner are arranged head end on head end, grip part end on grip part end or head end on grip part end before the cross cutting.

The raw wood, if it is present as a plank or plank section, scantling or multiple blank can be subjected for example to a wood treatment.

The wood treatment can be a pressure impregnation, a thermal treatment or a filling of deepenings with wax or resin. A thermal treatment can reduce the water absorption capability of the wood, which however can lead to a greater brittleness.

Furthermore, the wood treatment can be a mineralisation or comprise such. Salts are herein pressed under pressure into the wood. Herein, different characteristics can be achieved. For example wood having been treated in this manner is more resistant to fungi, less combustible and more resistant to light.

The cuboid plank in particular has an overdimension with respect to the end dimension of the main body, said overdimension being at least partly removed by way of at least one subsequent, material-removing machining step such as planing or milling.

The machining device for manufacturing the main body from a blank in particular comprises a machining tool for carrying out a shaping or material-removing machining step on the blank. As already mentioned above, the blank can also comprise a multiple blank, such as double blank.

For manufacturing the main body from the blank, in particular at least one material-removing machining method is carried out. The device for manufacturing the main body for this in particular comprises a tool for carrying out a material-removing machining step on the blank.

A material-removing machining method is a method which gives the blank a certain geometric shape by way of excess material being separated from the blank in a mechanical manner. Material-removing machining methods include methods such as turning by way of a lathe, drilling by way of a drill tool, milling by way of a milling tool, planing by way of a planing tool, sanding by way of a sanding tool, sawing by way of a sawing tool, filing by way of a filing tool, rasping by way of a rasping tool and shaving by way of a shaving tool or chiselling by way of a chisel tool.

For machining the blank into a main body, in particular material-removing methods such as planing, milling and drilling are applied, wherein several methods can be combined with one another.

Furthermore, a turning is also possible. The bank can therefore be brought into a basic shape or into a rotation body by way of turning, from which body the base body with its longitudinal sides can be manufactured into its final shape by way of one or more further machining methods such as milling or planing.

Alternatively, the turned body can be used in its turned form, without further machining of the outer contours.

Furthermore, other shaping methods by way of material removal, in particular the separating away of material are conceivable. A material removal can thus be effected e.g. by way of laser cutting or water jet cutting. This means that the contour of the main body can be alternatively or additionally also cut.

In particular, profiling means the incorporation of a contour into the blank. The contour in particular is formed by the longitudinal sides of the main body. The contour in particular is characterised by prominences and deepenings on the respective side. In particular, the contour has roundings and curved courses.

Thus a contour can be formed on the front side and the rear side. Furthermore, a contour can also be formed on the longitudinal narrow sides, the front side and the rear side.

If a contour or profiling is formed on the longitudinal narrow sides, the front side and the rear side, then in particular it is the side pair which lie opposite to one another which is firstly machined, i.e. contoured. The other side pair which in particular is offset by a rotation angle of 90° is subsequently machined i.e. contoured. For this, the blank can be rotated about its longitudinal axis by 90° or 180° between the two working steps.

It is also possible for each longitudinal side (left longitudinal narrow side, right longitudinal narrow side, front side, rear side) to be contoured or machined in a separate working step. For this, the blank can be rotated about its longitudinal axis by 90° or by a rotation angle which is a multiple of 90°, between two working steps.

Hence for example the front side and the rear side can be profiled in a first step. The body or blank is subsequently turned around or rotated, wherein the rotation axis in particular corresponds essentially or exactly to the longitudinal axis of the main body. The rotation angle in particular is essentially or exactly 90° or a multiple thereof. The two longitudinal narrow sides can subsequently be machined.

In the case of the respective two-sided machining, the geometric shape of the first profiling is to be selected such that the body can be clamped again after the turning over for the further profiling step, so that this body is firmly fixed for the machining. For example, flat contours or clear indentations or geometry courses can permit the unambiguous and good fixation.

The body which is to be machined is preferably rotated by 90° between the profiling steps. Preferably, the two longitudinal narrow sides are machined in one clamping and the front side and rear side in a further clamping. The precision of the machining steps is ensured by this.

In particular, what is meant by clamping is a temporary, clamping fixation of the body.

The sequence of the machining can be: firstly, the front and rear side in a first clamping, then the longitudinal narrow sides in a second clamping or vice versa.

Furthermore, it is possible for the body to be machined in a further material removing method after the profiling which is described above, in order for example to create a connection section to an attachment part, such as a brush head body. For this, the body can be machined further in a material-removing method, in particular in a milling method, in order for example at one of the main body to mill the connection section and/or other connection structures or a positive fit geometry, in particular a latching geometry, into the body.

The method described above with a four-sided profiling permits the formation of an ergonomic main body.

The longitudinal narrow sides, the front side and the rear side at the same time can each have concave and convex surface elements. Thus in particular main bodies concerning which in particular the pairing of the longitudinal narrow sides or as the case may be also the pairing of the front side and the rear side each form essentially mirror-symmetrical or opposing contour courses can thus be formed. This means contour courses, in which the opposite sides form concave or convex grip zones at the same longitudinal position on the main body. This leads to optically appealing curved zones of the main body (e.g. in the rear part of the main body).

This e.g. leads to thickenings or cambers on the main body (e.g. between the front side and the rear side or between the longitudinal narrow sides in the region of a thumb rest).

Furthermore this leads e.g. to narrowings or neckings on the main body (e.g. between the longitudinal narrow sides in the neck part).

Furthermore, main bodies, concerning which the pairing of the longitudinal narrow sides or in particular the front side and rear side each form essentially parallel or equal running counter courses, can also be formed. This means contour courses, in which the opposite sides each form contact/convex contour courses in pairs at the same longitudinal position on the base body.

The shape of the main body was evolved from the available manufacturing methods and extensive ergonomy trials with various users.

The main body or its grip part accordingly in particular comprises continuous or constant transitions in the contour course. In particular, the transitions consist of roundings or curve courses. The main body or its contour courses, possibly with the exception of a connection edge, in particular comprises no (sharp) edges. In particular, this applies to the grip part. The roundings or curve courses can form convex or concave zones in the main body.

The minimal diameter of the roundings on the longitudinal narrow sides in the cross section perpendicular to the longitudinal axis in particular corresponds to the thickness of the main body between the front and rear side. This diameter in particular is 4 mm to 12 mm, very particularly 5 mm to 8 mm. Larger radii are possible, but then are preferably provided with roundings of the edges at their transition from the front side to the rear side.

The roundings of the longitudinal narrow sides in the direction of the longitudinal axis can have very large diameters. The roundings of the longitudinal narrow sides are shaped by a radius of in particular 5 cm to 50 cm, very particularly of 10 cm to 25 cm. The roundings can be arranged or designed in a concave or convex manner with respect to the longitudinal axis.

The roundings in the front side and the rear side in the direction of the longitudinal axis can comprise very large diameters. The mentioned roundings in the front side and the rear side can be shaped by a radius of in particular 5 cm to 50 cm, very particular preferably of 10 cm to 25 cm. The roundings can be arranged or designed in a concave or convex manner with respect to the longitudinal axis.

In particular, the main body comprises a closed outer contour.

The edges in a cross-sectional view in particular are rounded. The radius of the rounding in particular is between 1 mm to 5 mm, very particularly between 1.5 mm and 2.5 mm.

In regions of the connection section, the roundings and edges can have other dimensions since these are explicitly designed with regard to a function and for example must accomplish a multitude of connection procedures between the main body and the attachment part.

The two longitudinal narrow sides can be rounded in the cross-sectional view. The respective radii are specified above.

The main body in the cross-sectional view perpendicular to the longitudinal axis can have an essentially oval shape.

The mentioned cross section can also have a round, in particular essentially or exactly circular or elliptical shape.

The main body in the cross section perpendicular to the longitudinal axis can essentially also have a diamond shape (rhombus) or a regular or irregular hexagonal shape.

Furthermore, the cross section can generally be designed in an n-gonal, i.e. polygonal manner. The number "n" in particular lies between three and eight.

The cross section can herein be designed such that corners and not surfaces are aligned to the front side, the rear side and to the longitudinal narrow sides.

The cross section can herein be designed such that surfaces are aligned to the front side, rear side and to the longitudinal narrow sides only in certain directions.

The mentioned cross section can have for example a rectangular basic shape. The edges can herein be rounded or chamfered.

The ratio of the height to width in the main body is particular is generally:

at the widest location of the width: 1:2 to 1:4;

at the narrowest location of the width (in the grip part and not in the neck section): 1:2 to 1:4.

The main body can have different cross-sectional geometries along its longitudinal axis. These can merge into one another by way of roundings. The possible cross sections have already been disclosed.

The machined blank or main body in a plan view between the front and the rear face side can have one, two or more than two cross-sectional narrowings. The narrowing in particular corresponds to a waisting.

The main body in a plan view can comprise a narrowing between a thumb rest and a rear face side.

In particular, the narrowing is formed by concave roundings along the two longitudinal narrow sides, said roundings lying opposite one another in a plan view.

The minimal width between the two longitudinal narrow sides in this case in particular is between 6 mm and 10 mm and very particularly between 7.5 mm and 9 mm. The width difference between the widest and the narrowest location is particular is between 4 mm and 10 mm and very particularly between 6 mm and 8 mm.

The main body in a plan view can in particular have a bone shape or the shape of a double bone.

Hence a first narrowing can be arranged between the rear face side and a thumb rest and a second narrowing between the thumb rest and a brush head. In particular, the second narrowing lies in a neck section which is formed in the transition from the grip part into the brush head. More than two narrowings, in particular three, four or five narrowings can also be provided.

The main body in the lateral view can also comprise one, two or more narrowings, as described above.

The narrowings in particular are formed by concave roundings along the front and rear side, said roundings lying opposite one another in a lateral view.

The roundings which are concave in a lateral view can be incorporated on the front side and/or on the rear side of the main body.

The roundings in particular have a radius of 5 cm to 50 cm and very particularly of 10 cm to 25 cm.

The main body in a lateral view can also have a contour which is designed in a manner such that the contour of the front side has no symmetry to the rear side.

According to an embodiment, the longitudinal narrow sides of the main body in a plan view between the rear face side and the brush head of the finished toothbrush can each form an individual, concave arc. The two arcs of the longitudinal narrow sides are directed towards one another and form a narrowing between the rear face side and the brush head in the main body.

The minimal widths in particular are to be derived from the preceding description of the narrowings. Furthermore, the radii of the arcs in particular are to be derived from the preceding description.

Furthermore, according to an embodiment, the longitudinal narrow sides of the main body in a plan view between the rear face side and the thumb grip of the finished toothbrush each form an individual, convex arc, in particular with a radius as specified above. The two arcs of the longitudinal narrow sides are directed away from one another and form a camber.

The formed thickening or camber in particular is shaped by mirror-symmetrically arranged arcs of the longitudinal narrow sides.

The maximal width which is formed by way of this in particular corresponds to the possible width of the main body as is specified further below.

In a further embodiment, the body in a plan view between the thumb rest and the rear face side is triangular and in particular is designed as an isosceles triangle.

A side and in particular the base of the triangle in particular lies at the thumb rest whilst in particular a corner of the triangle is arranged in the rear face side or the rear face side is formed by a corner of the triangle.

The triangular shape can also be designed with rounded, in particular with greatly rounded corners. Furthermore, the sides of the triangle which correspond to the longitudinal narrow sides can be designed in a concave or convex manner.

The height of the isosceles triangle in particular is 8 cm to 14 cm, and very particularly 9 cm to 12 cm. The width or the length of the side of the triangle which is arranged at the thumb rest in particular corresponds to the possible width of the main body as is specified further below.

It is also possible to shape a quasi rectangular body between the rear face side and the thumb rest in the plan view. Herein, the width changes are not effected until in the region of the thumb rest or after the region of the thumb rest in the neck section.

The front side as is yet mentioned further below can be designed in a plane or flat manner. The front side can also have a profiling or a height profile.

The rear side as is yet mentioned further below can be designed in an essentially or completely plane or flat manner. The rear side can however likewise comprise a profiling or a height profile.

According to a further embodiment variant, the front side and rear side of the main body is designed in an essentially or completely plane or flat manner. The front side and rear side in particular correspond to the upper side and the lower side of the blank. A profiling of the front side and rear side in particular does not take place.

Accordingly, according to this embodiment variant in particular the left and the right longitudinal narrow side are profiled by way of material-removing machining.

The left and right longitudinal narrows side of the main body correspond to the two longitudinally running longitudinal narrow sides of the blank which laterally delimit the upper side and the lower side of the blank and which lie opposite one another. The longitudinal narrow sides of the blank in particular correspond to the longitudinal narrow sides of the main body before the material-removing machining.

The longitudinal narrow sides and the upper and lower side of the blank form so-called longitudinal sides which run in the longitudinal direction of the blank. The mentioned sides each comprise a side surface which is delimited by edges.

The longitudinal narrow sides of the blank in particular are machined and profiled by one of the following devices or a combination thereof:

planing device (planing);

fluting device (fluting);

milling device (milling).

In particular, the profiling can include radii and/or chamfer profiles.

For manufacturing the profiling of the longitudinal narrow sides of the blanks, in particular these are fed by way of a loader. The loader comprises a store, e.g. in the embodiment of a magazine, in which the blanks are stored e.g. in a stack-like manner. Furthermore, the loader comprises a singularising device, by way of which individual blanks can be released from the store into a machining zone.

For the material-removing machining of the longitudinal narrow sides, the blanks are clamped between the upper and lower side which form the later front side and rear side of the main body, in particular by way of a clamping device.

The two longitudinal narrow sides can be synchronously machined by way of two machining tools which are led in parallel.

It is also possible for only one longitudinal narrow side to be machined and for the clamped blank to be rotated, e.g. about its longitudinal axis or about an axis transverse to the longitudinal axis, for machining the second longitudinal narrow side.

The machining tool, such as miller or plane, in particular is moved parallel to the longitudinal narrow side.

The profiling of the two longitudinal narrows sides can be identical, i.e. mirror-symmetrical.

The profiling by the machining tool can be effected by way of template. If several different profilings are provided, then these can be effected by several templates. In this case, in particular a separate machining tool is applied per template.

The shape of the profiling in particular corresponds to the shape of the machining tool—for example of the plane.

The profiling by the machining tool can also be effected by way of CNC control. CNC means computerised numerical control, i.e. electronic control of machines. The advantages of a CNC control amongst other things lies in no templates being necessary and therefore a rapid exchange of the model is possible. Furthermore, the working speed such as e.g. the cutting speed can be adapted.

If the profiling is effected by way of a milling tool, then this can be operated at 11'000 revolutions or more, in particular at 16'000 revolutions or more. The higher the rotating speeds, the finer or smoother are the surfaces which are achieved.

The machining speed of the milling tool can be 40 m/s (metres per second) to 100 m/s, in particular 60 m/s to 80 m/s.

The profiling can merely comprise a profiling of one or both side surface of the longitudinal narrows sides without edges. The profiling can also comprise one or both side surfaces of the longitudinal narrow sides as well as one or more edges. The profiling can also comprise only the profiling of one or more edges.

A profiling step of several profiling steps can comprise the machining of an individual or both side surfaces of the longitudinal narrows sides. A profiling step of several profiling steps can comprise the machining of an individual side surface including one or more adjacent edges or both side surfaces of the longitudinal narrow sides including one or more adjacent edges. A profiling step of several profiling steps can also only comprise the profiling of one or more edges.

As already mentioned, instead of individual blanks, it is also possible to machine multiple blanks, in particular double blanks, by way of the machining methods which are described above and which comprise the profiling of the longitudinal sides.

Accordingly, the multiple blanks in particular the double blanks are cross cut subsequent to the profiling of the longitudinal sides, i.e. the individual blanks or main bodies are separated or cut to length, e.g. by way of saws.

The front and/or the rear face side or at least their edges are each likewise profiled, in particular rounded. The machining of the face sides in particular is effected subsequently to the machining or profiling of the longitudinal narrow sides or front and rear side as well as longitudinal narrow sides.

The front face side in particular can also comprise a connection section which can likewise arise by way of profiling. The connection section in particular is likewise machined subsequently to the machining or profiling of the longitudinal narrow sides or generally the longitudinal sides.

Herein, the front and/or rear face side in a plan view can herein have a rounding which corresponds to the width of the main body and can thus merge into the outer shape or the shape of the longitudinal sides in a stepless, continuous or tangential manner.

Furthermore, it is also possible for the front and/or rear face side in a plan view to have a rounding which has a diameter which is larger than the width of the main body. Hereby, a protrusion is formed in the main body. The protrusion in particular is not continuous. The radius of the rounding can herein be between 3 cm and 8 cm.

In particular, the final outer geometry of the main body, in particular of the longitudinal sides (without any possible bristle holes in the main body) arises from the aforementioned material removing machining steps.

According to a further embodiment variant, at least the upper side or the lower side, in particular the upper side as well as the lower side of the blank are profiled. Furthermore, in particular the longitudinal narrow sides of the blank are also profiled. The profiling is effected by way of at least one material-removing machining tool.

Accordingly, the front side or the rear side or the front side as well as the rear side and possibly also the longitudinal narrow sides are profiled in the main body. In particular, the blank is profiled along its four longitudinal sides.

Furthermore, apart from the side surfaces, in particular the edges are also machined or profiled by way of a machining tool. The edges for example can be chamfered or rounded by the machining tool.

According to a particular design, the front side of the grip part is profiled and in a lateral view has a curved contour with alternating thick locations and thin locations. In particular, the front side has a profile course with concave and/or convex zones. In particular, the grip part can have a thick location in the region of the thumb rest in the grip part.

According to a particular design, the rear side of the grip part is profiled and in a lateral view has a curved contour. In particular, the rear side has a profile course with concave and/or convex zones.

According to a particular embodiment design, the front side and the rear side of the grip part is profiled and in a lateral view in particular each have a curved contour, as described above. The grip part in particular can comprise a thickening or a thick location, in the region of a thumb rest in the grip part.

Concave or convex locations or zones on the main body, i.e. in the longitudinal narrow sides as well as the front and rear side, in a lateral view and in a plan view can be arranged essentially in the same section along the longitudinal axis of the main body. The radii of these roundings in particular are from 5 cm to 50 cm and very particularly from 10 cm to 25 cm.

The front side of the neck section as well as the front side of the head part in contrast can be designed in a plane manner. Likewise, the rear side of the grip part as well as of the head part can be designed in a plane manner.

The longitudinal narrow sides can be profiled as already mentioned and e.g. have a curved contour which in a plan views leads to one or more widenings of the grip part and possibly also to one or more waistings in the grip part.

The material-removing machining can be effected by way of a planing device which comprises a planing tool. The planing tool can be a profile plane, such as a waved plane.

The material-removing machining can be effected by way of a milling device which comprises a milling tool.

The device for the material-removing machining in particular is CNC controlled.

The machining by way of a CNC-controlled planing device as a result permits the incorporation of free shapes into the blank. The multi-dimensional design of the main body is restricted in this case.

The additional or exclusive machining by way of a CNC controlled milling device permits the incorporation of multiply arcuate and/or free shape surfaces. Hence in this manner, amongst other things one can also create cambers (rounded surfaces with changing radii not only in the longitudinal direction of the main body).

However, one can envisage free shapes also being incorporated into the blank by way of suitable machining tools and machining methods.

The machining of the longitudinal sides, e.g. by way of planing can be effected in one direction or in both directions.

According to a particular embodiment, a side surface plus an adjacent edge is machined with the machining tool, such as a planing tool.

In particular four tools which machine the blank in a synchronous or temporally staggered manner can be provided for machining the four longitudinal sides plus edges.

For creating the profiling, the blanks in particular are fed by way of a loader. The loader comprises a store, e.g. in the embodiment of a magazine, in which the blanks are stored, e.g. in a stack-like manner. Furthermore, the loader comprises a singularising device by way of which individual blanks can be released from the store into a machining zone.

The blanks can be cut to length or machined in a material-removing manner, e.g. by way of planing, to a tolerance of +/−0.1 mm at their left and right longitudinal narrow side.

For the material-removing machining such as planing, milling or drilling, of the blank, a reference groove (zero-point groove) can be incorporated into the blank. The reference groove can have a height of 1 mm and a depth of 1 mm.

The reference groove is to permit the precise positioning of the blank on displacing the blank between two machining positions. This means that the reference groove serves for precisely aligning the blank in machine tool. In this manner, it is ensured that individual shaping steps, such as profiling steps are matched to one another on the blank in an exact spatial manner.

The reference groove can be incorporated e.g. into one of the face sides, in particular into the front faces side. In particular, the reference groove is always incorporated in a short side, i.e. a face side.

After incorporating the reference groove and before profiling the sides, the blanks can be buffered in a buffer storage.

The buffered blanks are fed in a transport direction parallel to the longitudinal direction out of the buffer store in a singularised manner by way of a singularising device and are fed to the next working station.

The singularised blank is received in particular in a holder for the subsequent machining and is held in this for carrying out further machining steps. In particular, the blank can be clamped in the holder.

In a next machining step, a guide groove can be worked, in particular planed into the blank in a material-removing manner. The guide groove serves for guiding the machining tool.

The guide groove can have a width of 0.5 mm to 1 mm, in particular if 0.7 mm to 0.9 mm. The guide groove can be designed square in cross section. Accordingly, the depth and the width of the guide groove correspond to the aforementioned dimensions.

The longitudinal sides of the blank are profiled in the next machining step, possibly after incorporating a guide groove.

Hence in a first step the first longitudinal narrow side and subsequently the second longitudinal narrow side can be profiled.

In a second step, the upper and lower side of the blank are profiled, e.g. firstly the upper side and subsequently the lower side.

In particular, the profiling is effected by planing by way of a planing tool. The applied planing tools in particular are designed such that they can each machine a side and an edge.

The shape of the planing tool or the planing profile is fashioned in accordance with the shapes which are to be planed. The planing tool can comprise straight (linear) cutters. The planing tool can also comprise arcuate, round, oval or free shape surfaces. Thus for example round cutters are used for round shapes.

In particular, the blank after each machining of a side and possibly an edge is aligned afresh at the reference groove. By way of this, it is ensured that the profiling of the side surfaces and of the edges is effected in a defined position to one another. In this manner, it is ensured that no offset or shift occurs between the individual profilings by way of a displacement of the blank.

If, as described further above, a contour or profile is not only formed in the longitudinal narrow sides but also in the front side and rear side, then the front side and the rear side can also be analogously profiled after the machining of the longitudinal narrow sides.

As already mentioned, this can be accomplished in a clamping. The blank can be rotated by 180° or 90° in order to machine the longitudinal narrow sides or the front side and the rear side. On machining, it is also possible to alternate between a longitudinal narrow side and the front side or rear side and to herein undergo only a 90° rotation.

The guide groove is also removed again, e.g. planed away, with a final material-removing machining step, such as e.g. planing, for the profiling of the side surfaces. Accordingly, the side with the guide groove in particular is the last to be machined.

It is also possible, instead of individual blanks, to machine multiple blanks, in particular double blanks, by way of the machining method which is described above and which comprises the profiling of the side surfaces.

Accordingly, the multiple blanks, in particular double blanks are cross cut, i.e. are separated or cut to length into individual blanks or main bodies, subsequent to the profiling of the side surfaces.

In a subsequent machining step, in particular the face sides of the individual blank are machined in a material-removing manner, i.e. profiled. The face sides or individual face sides can be produced not until cross cutting a multiple blank, as already mentioned above.

The machining or profiling of the face sides in particular is thus effected subsequently to the machining of the longitudinal sides, i.e. of the lower side and upper side of the blank as well as the two longitudinal narrow sides.

The material-removing machining of the face sides in particular is effected by way of milling by a milling tool.

Hence in a first step, a first face side is machined or profiled in a material removing manner. In particular, the first face side can be the front face side which is part of the later brush head.

The machining of the first face side can be effected with two machining tools, such as milling tools which machine the first face side from a left and right side in a material-removing manner.

Subsequent to the material-removing machining, i.e. the profiling of the first face side, the machined face side can be cleaned in a cleaning step and the chips removed. In particular, the cleaning step comprises a brushing-away.

In a following step, the blank is rotated by 180° about a rotation axis transverse to the longitudinal axis. In particular, this is effected together with the holder, in which the blank is held.

The second face side of the blank is subsequently machined or profiled in a material-removing manner.

In particular, the second face side is the rear face side. However, the material-removing machining can also be effected the other way round.

The machining of the second face side can likewise be effected with two machining tools, such as milling tools which machine the second face side in a material-removing manner from the left and the right side.

Subsequently to the material-removing machining, i.e. profiling of the second face side, the machined face side can be cleaned in a cleaning step and the chips removed. The cleaning step in particular comprises a brushing-off.

In particular, the reference groove is removed at the latest with the material-removing machining of the face sides.

The profiling of the blank is now completed and the blank already at least essentially has the outer geometry of the main body.

The profiling of the face sides, in particular of the front face side can be a rounding. The rounding in particular connects the two longitudinal narrow sides to one another.

This means that a contour which tangentially continues the outer contour of the longitudinal narrow sides is created and thus a rounding is created.

The maximal diameter of the rounding in particular corresponds to the maximal width of the main body or in this case in particular to the width of the head part.

Different roundings with different radii can also be put together, in particular tangentially, these finally connecting the two longitudinal narrow sides.

The rounded contour of the front and/or rear face side in particular can merge into the contour of the longitudinal narrow sides in particular in a flowing, i.e. continuous manner without edges. The round face side contour in particular merges tangentially into the outer contour of the longitudinal narrow sides.

The profiling of the face sides, in particular of the front face side can be a rounding. The rounding in particular connects the front side and the rear side to one another.

This means that a contour which tangentially continues the outer contour from the front side to the rear side is created and thus a rounding.

The maximal diameter of the rounding in particular corresponds to the maximal height of the main body or in this case in particular to the height between the front side and the rear side.

Different roundings with different radii can also be put together, in particular tangentially, these finally connecting the front side and the rear side.

The rounded contour of the front and/or rear face side in particular can merge into the contour of the front side and rear side in a flowing manner, i.e. continuously. The round face side contour in particular merges tangentially into the outer contour of the front side and the rear side.

The roundings of the face sides in particular are superimposed such that the face side is rounded in all directions. Herein, an essentially hemispherical or semi-ellipsoidal end arises.

The machined or profiled blank in particular is removed from the holder.

The profiled blank can be transferred to a belt conveyor after the completion of the profiling.

A quality control (e.g. by way of optical sensors) in which blanks which are not true to dimension are sorted out can be provided before the machining of the blanks. This means that blanks which e.g. do not have the necessary edge lengths are ejected out. In particular, the quality control is necessary in the case of externally produced blanks.

One can envisage the aforementioned profiling of the longitudinal narrow sides being effected in several stages or steps, in particular in two stages or steps.

Hence in a first step, one can incorporate an intermediate profiling, in particular coarse profiling. A further profiling, in particular fine profiling which is superimposed on the intermediate profiling is incorporated in a second step. The main body is now present in its final profiling.

A profiling in several stages or steps can be provided in particular with the edge machining. This e.g. is the case if the edges between the longitudinal narrow sides and the front or rear side are to be differently chamfered or rounded in the longitudinal direction, which is to say are to be differently profiled or structured.

Several, in particular two machining tools, such as milling tools can be applied for the multi-stage profiling, wherein a specific contour or profiling can be incorporated into the blank each with one machining tool.

According to a further development, the blank or the main body can be reshaped by way of a reshaping method. The reshaping can comprise a bending or pressing.

On reshaping, the pressure and/or the temperature and/or the humidity can be adapted to the reshaping process. Herewith, the speed of the reshaping can be increased and the tendency of the blanks to break be reduced.

Hence the reshaping can be effected e.g. in a processing chamber. E.g. the temperature and/or the humidity and/or the pressure can be set in the processing chamber. This can be effected e.g. via a control device. The processing chamber can be designed as a pressure chamber and/or steam chamber accordingly.

A reshaping process can possibly be combined with a coating or treatment process. Hence for example the blank or the main body can be reshaped in the course of a pressure impregnation, which means in particular together with or directly subsequent to a pressure impregnation. As already mentioned, a temporarily higher humidity content due to the pressure impregnation has an advantageous effect on the reshaping.

In particular, the reshaping can comprise a bending in a plane parallel to the care bristles. The reshaping in particular can be a bending away from the front side and/or the rear side of the main body. The bending in particular comprises the incorporation of one or more bending radii.

In particular, the mentioned bending radii correspond to the previously mentioned bending radii of the roundings on the front side and rear side of the main body.

Thus for example a curvature or a bending can be incorporated in the neck section. The curvature or bending is designed such that the brush head is inclined to the front thus in the direction of the front side with respect to the grip part.

The blank can also be reshaped, in particular bent also in the region of the thumb rest or in the rear end region of the grip part.

In particular, the reshaping can include one or more sections of the main body, such as the brush head, the neck section, the grip part or parts thereof.

The reshaping in particular can be combined with a profiling of the main body by way of a material-removing machining method. The reshaping can take place before the profiling. The reshaping can take place after the profiling.

The reshaping method can thus be carried out on the main body. The reshaping method however can also already be carried out on the blank. The reshaping method can also be carried out on a multiple blank. The reshaping method can also be carried out on a scantling. The reshaping method can also be carried out on the plank or plank sections.

Hence a plank or plank section or a plate can be reshaped, wherein the scantlings or blanks are not cut out of the plank or the plank section or out of the plate until after the reshaping.

A main body can be reshaped in one or in several dimensions by way of the reshaping. In particular, a three-dimensionally shaped main body can be created by way of the reshaping.

For the sake of simplicity, the term "wood body" is used hereinafter in the context of the reshaping method. It is to be understood that the term "wood body" applies to all mentioned blank materials or blank material combinations.

For reshaping, the wood body which is to be reshaped in particular is clamped into a holder such as mould which brings the wood body into the final shape or replicates the end shape of the wood body to be reshaped.

The wood body is reshaped into the final shape during the reshaping process, in particular in a step-wise manner.

The wood body to be reshaped in particular is clamped for at least several minutes and very particularly more than 20 minutes.

The clamped wood body in particular is under pressure in a pressure chamber during the mentioned time or reshaping. The pressure is greater than the atmospheric ambient pressure.

The clamped wood body in particular is reshaped in the holder amid the action of heat.

The clamped wood body can also be reshaped under steam in a steam room, e.g. at a steam temperature of greater than 930 (degrees Celsius), in particular 100° C. The reshaping under steam can be effected without pressure or under pressure in a pressure chamber.

The aforementioned method steps ensure the shape retention after the reshaping.

After the reshaping, the wood body can be held in the final shape by tension belts e.g. during a cooling phase. In this manner, the return back into the initial shape is prevented.

If the wood bodies to be reshaped by way of a bending method, then in particular this consists of a well bendable wood. Not all wood types can be bent equally well. Exotic woods such as softwood are more difficult to bend.

Wood types with a high tanning agent content, such as oak or walnut further have the tendency to discolour at the bending locations on reshaping.

Wood bodies of glued wood layers, in particular of glued layered wood are particularly suitable for reshaping.

If the wood body is reshaped by way of bending methods, then this in particular is merely dried to a wood humidity/wood moisture content $u_{g1}$ of 20% to 30%. This means that the wood body to be reshaped in particular has a wood humidity/wood moisture content $u_{g1}$ of 20% to 30%.

If the wood body has a lower moisture content of e.g. 10%, then this can no longer be reshaped in accordance with wishes. The same applies to wood bodies, whose moisture content is lifted from below 20% again to 20% to 30% by way of moistening, steaming, watering etc. for the purpose of reshaping. For this reason, the wood body which is to be reshaped should never have a humidity content of below 20% to 30% before the reshaping.

If a reshaping method which bends or presses the wood body into shape by way of a tool is applied, then this can be effected in different manners. On the one hand the body can be clamped or become clamped in a suitable tool or between two tool halves, wherein the body accordingly deforms between the tool halves.

Furthermore, it is also possible to act with only one tool half and to reshape the body only on one machining side, e.g. by way of pressing, wherein the further sides of the body are reshaped in one or more further steps.

The tools which are used in the bending method/reshaping method can be cold or warm. Cold tools are not temperature regulated, they are at temperature which corresponds to room temperature. Warm tools are temperature regulated and are brought to a temperature of e.g. more than 80° preferably more than 100° and mostly preferred of more than 120°. Herein, the temperature is matched to the applied wood of the wood body, so that no burning on the wood surface or damage in the wood body itself can happen.

The application of warm tools can of course be combined with the treatment options in the bending method which are specified further, for example with the application of steam.

The main body can comprise one or more holes such as blind holes or continuous holes. In particular, the holes are arranged on the front side and/or rear side of the main body. If the holes are through-holes, then these in particular lead from the front side to the rear side. The hole or holes can be incorporated into the main body e.g. by way of drilling, cutting, milling or stamping. In particular, the holes can be formed separately from the bristle holes.

A through-hole can thus be provided in the grip-part-side end section of the main body. The through-hole leads in particular from the front side onto the rear side. The through-hole can also lead from the left longitudinal narrow side to the right longitudinal narrow side. The through-hole serves e.g. for suspending the toothbrush, in particular upside down. By way of this, the water can drip away, by which means the toothbrush dries quicker after dental care.

One or more holes can also be provided in the thumb rest. The holes can be through-openings. The holes can be blind holes or deepenings. A combination of through-holes and blind holes or deepenings is also possible.

The hole or holes serve e.g. for improving the ergonomy or haptics. The holes can also favour the flowing-away of water and by way of this accelerate the drying of the wood after use. The holes can also serve as an assembly aid for further material components.

In particular, the holes have a diameter which is dependent on the function. In particular, the diameter is 2 mm to 12 mm.

The holes can be round, such a circularly round. Apart from circularly round holes, holes or recesses of a different shape can be provided. The recesses can be e.g. essentially elliptical, triangular, trapezoidal, quadrangular, rectangular, square, diamond-shaped, dragon shaped. Polygonal recesses preferably form radii in their corners.

The holes can be milled or drilled. In particular, the non-circularly-round holes or recesses are milled. Any corner radii of the recesses in particular are the same or larger than the radius of the miller. These radii in particular are between 1 mm and 8 mm, very particularly between 2 mm and 5 mm.

Furthermore, one or more holes or recesses which serve for the weakening of the main body for the purpose of forming a predetermined breaking location can be provided in the main body. The hole or holes can be arranged e.g. in the neck section, in particular between the grip part and the neck section or brush head and neck section.

The predetermined break location can serve for example for separating the brush head with the brush head body of plastic or the brush head with plastic bristles from the remaining main body of wood. The material separation simplifies the recycling or disposal of the individual recyclable materials.

Furthermore, holes or recesses, in particular through-holes can be provided in the main body also as a fashion element.

The holes can be round holes. The hole can also be elongate holes, in particular longitudinal holes. A combination of holes with a different hole cross section is also possible.

The main body can comprise a (longitudinal) slot in the rear face side. The slot can be part of a stand function and e.g. permit the toothbrush to be stuck onto the edge of a toothbrush glass or onto a corresponding holder. In particular, the slot can be incorporated by way of milling or stamping into the main body.

The main body can comprise a cross slot on its rear face side. The cross slot can be part of a stand function and e.g. permit the toothbrush to be stuck onto a corresponding holder. In particular, the cross slot is incorporated into the main body by way of milling.

The holder which is e.g. a stand accordingly comprises a cross-like counterpart, or attachment part, such as an attachment nub. The holder can be sold together with the toothbrush in the same package.

The slot or cross slot in particular together with the holder can also serve for the separation of the brush head from the grip part for recycling purposes or for disposal.

One can envisage the blanks being brought into a raw shape, in particular profiled, by way of a material-removing method which is described above.

Subsequently, the machined blanks in the raw shape can yet be machined (processed) further in an individual manner. The post-machining can comprise a filing, by way of a file, such as nail file. The post-machining can be a varnishing by way of varnish, such as nail varnish. The post-machining can be an inscribing by way of a pen such as a felt pen.

One can envisage the post-machining being effected by the customer or user himself. This means that the customer or user can himself personalise his toothbrush. The mentioned tools for personalising can be sold together with the toothbrush, e.g. in the same package. The personalisation however can also be envisaged such that the machining tools are already present in the average household.

According to a further development, the blank after completion of the profiling, i.e. the main body is subjected to a surface treatment.

The surface treatment can be over the complete surface. The surface treatment can be over part of the surface, and be effected e.g. only in those zones, where an effect which is achieved by the surface treatment is necessary or desirable.

It is possible for different surface zones to be subjected to different surface treatments.

It is also possible for the surface or surface zones of the main body to be subjected to several of the subsequently mentioned surface treatments.

Thus the grip part, the head part or the connection section or a tongue cleaner which is possibly arranged on the main body can undergo a different surface treatment.

The surface treatment in particular comprises the treatment of the surface with a treatment agent. The treatment agent can be a liquid or a gas or be flowable.

The surface treatment can serve for refining the wood. The surface treatment in particular serves for protecting the wood from outer influences, such as humidity or for refining the wood.

The surface treatment can hence prevent or restrict the water absorption of the wood material, e.g. by way of sealing/impregnating the surface.

The surface treatment can also serve for decoration purposes.

The surface treatment can also combine different purposes such as a decoration purpose and a reduced water absorption.

The surface treatment can be a varnishing at the grip end for the protection from water absorption.

The surface treatment can further also serve for an improved oral hygiene.

The surface treatment can have an anti-bacterial or anti-microbial effect before or during the use of the toothbrush. The treatment agent consequently in particular has an anti-bacterial or anti-microbial effect.

The surface treatment can also serve for a taste modification of the toothbrush.

The surface treatment can also serve for a modification of the smell of the toothbrush.

The surface treatment can also be designed such that the surface which is treated with the treatment agent leaches an active ingredient, in particular during the dental care.

The leached active ingredient can assist e.g. the oral hygiene. The active ingredient can have different effects. The following materials can be applied alone or in combination with one another:

(a) toothpaste-like effect: sorbitol, aromas, hydrated silica, sodium lauryl sulphate, sodium, monofluorophosphate, creatine, zinc sulphate, triclosan, glycerine, sodium saccharine, propylene glycol, disodium phosphate, alumina, trisodium phosphate, sodium fluoride, betaine, titanium dioxide, cellulose gum, tetra sodium pyrophosphate, amine fluoride, etc.;

(b) anti-bacterial effect: sodium bicarbonate, citric acid, phosphoric acid, sodium carbonate, potassium carbonate, sodium perborate, sodium hexametaphosphate, sodium benzoate, sodium stearate etc.;

(c) ingredients for dental bleaching, e.g. with hydrogen-peroxide-containing ingredients.

According to this surface treatment, in particular it is only those surface zones of the main body which on dental care are brought into the oral cavity which are treated with one or more active ingredients. In particular, the rear side of the toothbrush head is treated with one or more activate ingredients.

The associated surface treatment method can be an immersion or bathing in treatment agent, which is followed by a subsequent blowing-away of the excess treatment agent.

The surface treatment method can also be a drum treatment (drumming), concerning which the main body is treated with the treatment agent in a rotating drum.

The drum treatment can also be used for deburring/chip removal. Hence the last remains of waste from the material-removing machining can be removed from the main body by way of the drum treatment.

The surface treatment method can also be a spraying or spray coating, concerning which the main bodies is sprayed or spray coated with a treatment agent.

The surface treatment method can also be a vapour deposition concerning, which the main body is subjected to vapour deposition with a treatment agent.

The surface treatment method can also be an impregnating, concerning which the main body is impregnated with a treatment means. The impregnating method in particular can be a pressure impregnation.

The surface treatment method can also be a painting, concerning which a treatment agent such as paint is deposited onto the main body, e.g. by way of brushing.

The surface treatment method can also be a varnishing, by way of which a varnish, such as protective varnish is deposited onto the main body.

The surface treatment method can also be a staining, by way of which a mordant is deposited onto the main body.

The treatment agent can also be deposited onto the main body by way of an application tool which creates contact, such as a brush or roller.

The treatment agent can also be deposited onto the main body by way of a printing method (e.g. tampon printing, screen printing, inkjet printing, laser printing).

The medium which is deposited onto the main body can be water-soluble. The medium which is deposited onto the main body can be non-water-soluble.

The deposited medium can be designed such that this releases from the main body during the duration of use, in particular in a continuous manner. The deposited medium can also be designed such that this stays on the main body during the duration of use, thus does not release from the main body.

The main body can be coated and/or impregnated with the treatment agent.

The surface treatment method can be an oiling, concerning which the main body is oiled with oil. Oil from renewable or sustainable raw materials is preferably used.

The surface treatment method can also be a perfuming, concerning which the main body is perfumed with a perfume.

As already mentioned, the surface treatment can be effected over the complete surface or pointwise or over part of the surface, e.g. according to treatment zones.

If the main body comprises bristle holes, then the surface treatment in particular can take place before incorporating the bristle holes. By way of this, one prevents the bristle holes from becoming blocked by way of flowing-in treatment agent.

The treatment agent can be a wax, such as e.g. soya wax or bees wax. A wax from renewable or sustainable raw materials is preferably used. In particular, the wax can be vegan.

A surface treatment by way of wax leads to a high softness of the surface. After the waxing, the main body feels less rough than an untreated main body. The formation of sprouts on roundings and edges is reduced.

The surface treatment with wax can serve for the protection from water absorption and for example be only partially deposited at the rear end of the grip part.

The respective treatment agent can be dyed, so that dyeing is also entailed by the coating.

The treatment agent can be provided with additives such as for example dye, taste or an oral hygiene additive such as e.g. fluoride.

It is also possible for the surface of the main body to be mechanically treated or machined at least partly in another manner, e.g. by way of sand blasting, sanding, roughening. The main body can also be brushed (e.g. with a coarse brush), so that an optical effect arises.

The surface treatment can be a thermal treatment such as burning-in or flaming.

The surface treatment can be effected by way of a coating method, concerning which the main body is to be coated is put into a drum. The drum rotates in the application and the main body or main bodies which are brought in move in this. In particular, the treatment agent is introduced by way of nozzles whilst the drum rotates.

The sequence of such a drum treatment in particular is designed as follows:

1) The treatment agent is filled into a container on the device.
2) The drum is filled with main bodies.
   The main bodies are filled into the drum as a bulk material. The filling is selected such that the main bodies can move during the rotation of the drum. The movement of the main bodies in the drum is important so that these undergo the surface treatment in different positions.
3) The main bodies are heated in the rotating drum.
   The surfaces of the main body are heated in particular by way of infrared radiation, so that the treatment means is fixed to the main body in an improved manner.
4) The main bodies are coated in the rotating drum.
   Whilst the drum rotates, the treatment agent is sprayed out of a container onto the main bodies in the drum by way of nozzles.
5) The main bodies are dried in the rotating drum.
   The main bodies are dried in the drum in particular by way of air/hot air, infrared and/or UV irradiators, so that the coating is touch dry.

In particular, the treatment drum is arranged such that the rotating axis is arranged at an angle with respect to a horizontal, said angle being different to 0° and 90°. On account of the angled arrangement of the rotation axis, the main bodies are through-mixed or rotated and moved by way of gravitational force on rotating the drum.

The drum can comprise a lateral surface which is not smooth or is not plane on the inner side. The lateral surface can be provided with round, wave-shaped patterns. The main bodies are moved to an improved extent by way of this.

The quantity of treatment agent which is deposited per main body in particular is between 0.001 g (gram) and 1 g per main body, very particular between 0.01 and 0.5 g. The details relate to the completed or dry main bodies.

Intensive trials with users have shown that too low quantities or too high quantities of treatment agent are perceived negatively by the user on use. For example, the taste of a treatment agent can be too intensive or the intrinsic taste of the wood can be perceived as to strong. The wood can also be perceived as being too rough if too low quantities of treatment agent are deposited.

Possible treatment agents are for example vegetable waxes such as sunflower wax, rapeseed wax or also carnauba wax. As the case may be, a vegan final product can be formed by way of the vegetable base of the waxes.

It is possible for a mixture such as for example an emulsion to be formed, in order to permit a spraying processing, for the application of a treatment agent by other means.

In particular, the pores of the wood are at least partly closed or sealed from water at the grip-part-side end section of the main body.

For this purpose, the grip-part-side end section of the main body can be coated with a water-impermeable varnish, oil, wax or a plastic coating, e.g. of an elastomer, such as rubber. The coating protects the grip-part-sided section of the main body from water. This e.g. is of significance if the toothbrush is placed with the grip-part-side end section of the main body into the toothbrush glass which often contains standing water in small quantities.

The plastic coating can be permanently or non-permanently, i.e. removably attached to the main body. The plastic coating can be injected on the main body in an injection moulding method.

For preventing or reducing the water absorption, or for the at least partial closure of the pores of the grip-part-side end section of the main body, in an analogous manner to that which has already been suggested with regard to the connection section, this can also be compressed, i.e. compacted by way of a pressing procedure e.g. in the course of a reshaping, as described further above. On account of this, the wood can absorb less humidity.

The mentioned pressing procedure can also serve for the shaping and hence in particular correspond to the previously described reshaping and have the mentioned characteristics.

Basically, the complete main body or parts thereof can be compressed, i.e. compacted by way of a pressing procedure or a reshaping, for the purpose of a reduction of the water absorption capacity and/or the shaping. For this, the main body or parts thereof are inserted into a tool mould which sets the final shape, and pressed.

The pressing to a certain extent moreover permits the incorporation of shape into the main body, said shape being set by the mould tool. This can be a free-shape surface.

Thus for example the edge geometry can be changed by a pressing procedure. In particular an edge shape which is different in the longitudinal direction can also be incorporated into the main body by way of a pressing procedure.

The main body or the related parts can be treated or provided with a treatment agent for the pressing procedure. In particular, the main body or the related parts can be humidified for the pressing procedure. In particular, the main body or the related parts can be heated for the pressing procedure.

Furthermore, steps can be shaped out in the main body by way of a local pressing. The steps in the main body can imitate a bending of the main body.

The pressing can be designed as a pure pressing with pressure, but it is also possible to combine the pressing with heat and humidity, as mentioned above, in order to achieve the desired results.

Furthermore, ultrasound can also be applied in the pressing tool.

Furthermore, the grip-part-side end section of the main body can also be thermally treated, e.g. by hot embossing or laser treatment, for the purpose of reducing the water absorption capability.

Moreover, the grip-part-side end section of the main body can also be pressure-impregnated for the purpose of reducing the water absorption capability.

The surface of the main body can be subjected to a structuring over the complete surface or part of the surface. In particular, a structuring is to be understood as the incorporation of a roughness pattern on the surface of the main body.

In particular, the structuring is effected after the profiling of the blank or the main body.

The structuring can be the characterisation of the toothbrush, for reproducing information or for decoration purposes.

The structuring can also serve for improving the grip or the haptics of the toothbrush.

Thus for example a structuring can be incorporated on a thumb rest.

Furthermore, a structuring, such as for example a roughness pattern can be incorporated on the grip part.

If further function elements, such as e.g. a tongue cleaner are provided on the main body, then these elements can have a corresponding structuring. The structuring can be regular or irregular. For this, prominences or deepenings can be formed e.g. from the initial surface.

The structuring can be deposited e.g. onto the surface of the main body. Such a material deposition can be effected e.g. by way of 3D printing, screen printing or inkjet. The height of the deposited elements in particular is between 0.01 mm to 0.8 mm and very particularly between 0.1 mm to 0.6 mm.

If the material deposition is of plastic, then it is also possible to bond an element which comprises the structuring onto the main body. It is also possible to bond an element with a structuring and which is not of plastic, onto the surface of the main body.

Thus for example a thumb rest or a tongue cleaner can be bonded onto the main body, e.g. in the form of a label. This for example can be a haptic plastic label or a granular, sandpaper-like label. The label can be bonded on and/or positively and/or non-positively anchored.

Furthermore, it is also possible to inject an element or several elements which form the structuring, onto the main body. This e.g. can be effected by way of an injection moulding method.

Thus a thumb grip with a thumb rest can be injected onto the main body. A tongue cleaner can thus be injected onto the main body.

Furthermore, it is moreover also possible for the brush head body to be injected onto the main body. In this case, the brush head body and the main body no longer need to be connected to one another in an additional working step.

The brush head body together with the cleaning elements or care bristles can be injected onto the main body. This means that the cleaning elements or the care bristles are injected in the same working procedure.

The brush head body can also be injected onto the main body without cleaning elements or care bristles. The cleaning elements or care bristles are thus attached, e.g. injected onto the brush head body in a separate working procedure.

For this, according to a particular embodiment the main body is inserted into a moulding tool and is peripherally injected with one or more plastic components.

The aforementioned structuring can also be worked into the surface of the main body, e.g. by way of material removal and/or material displacement and/or material burning.

Hence the structuring can be milled into the surface by way of a milling tool.

Hence the structuring can be cut into the surface by way of a knife.

The structuring can also be burnt into the surface. For example, a heated structuring tool, such as a piece of metal can be used for this. The temperatures which are herein applied vary in particular in a range between 250° C. (degrees Celsius) and 500° C. Herein, the machining time/treatment time is between 0.2 s (seconds) and 2 s. It is dependent on the temperature and also on the pattern depth which is burnt in.

The structuring can also be incorporated into the surface by way of a laser treatment.

Furthermore, the structuring can be incorporated into the main body by way of a local compressing or compacting of the wood material. This is effected e.g. by way of pressing.

The mentioned methods can be applied individually or in a combined manner.

A structuring which is brought into the surface can be e.g. a corrugation or a fluting.

Flutes can be incorporated in the longitudinal direction and/or transverse direction and/or at an angle, in particular 15°-75° to the longitudinal direction of the main body.

Furthermore, a structuring can be incorporated into the main body by way of a multitude of small deepenings (deepenings less than 1 mm). The deepenings can have a circular, elliptical, triangular, rectangular, square or polygonal shape.

In particular, the structuring has a multitude of equal structure elements. A zone which is provided with a structuring in particular comprises 10-200 surface structure elements.

In particular, the structuring is formed symmetrically to the longitudinal middle axis of the main body.

A pattern for reproducing information can be deposited onto the surface of the main body. The pattern can be a visualisation of an outline, a characterisation or an inscription. The characterisation can be e.g. a logo, such as trademark logo or a picture. The inscription can e.g. be a lettering.

The pattern can be e.g. a Lot code, an EAN code, a QR code or a bar code. In particular, the code is machine-readable.

The pattern can be deposited onto the surface by way of a method for structuring which is described above. The pattern can therefore also fulfil the tasks of the structuring, i.e. the pattern for reproducing information can simultaneously be a tongue cleaner, thumb rest, decoration, etc.

The pattern can be visually and/or haptically perceivable.

The pattern can be fashioned as a positive or as a negative. If the pattern is created for example by way of embossing, then the actual pattern e.g. the lettering can be embossed (positive) or the outline can be embossed (negative).

The depositing of a pattern can be effected by way of hot-embossing, with or without foil.

The depositing of a pattern can be effected by way of a punch.

The depositing of the pattern can be effected by way of an inkjet printing method.

The depositing of a pattern can be effected by way of tampon printing.

The depositing of a pattern can be effected by way of screen printing.

The depositing of a pattern can be effected by way of digital printing.

The depositing of a patter can be effected by way of laser. Thus the laser can burn or engrave the pattern into the main body.

The depositing of a pattern can be effected by way of burning in. Different graduations in the burning-in procedure can create pictured representations.

The depositing of a pattern can be effected by way of embossing a picture foil.

The depositing of a pattern can be effected by way of engraving.

The depositing of a pattern can be effected by way of inscription by way of a pen, such as a felt pen.

The depositing of a pattern cane effected by way of inlays in the wood. With regard to this technology which is also denoted as intarsia, different woods are applied into and onto one another such that the desired pattern arises. Instead of different woods, one can also insert different materials, such as plastic or metal, which have the same effect.

The pattern can be arranged on the grip part of the main body.

The pattern can be arranged on the neck section of the main body.

The pattern can be arranged on the front side of the main body.

The pattern can be arranged on the rear side of the main body.

The pattern can be arranged on a longitudinal narrow side of the main body.

The pattern can be arranged on a thumb rest of the main body.

The pattern can be arranged on the end of the main body which is away from the brush head.

The pattern can be arranged on the rear side of the brush head.

The main body can comprise one or more patterns.

Basically, a pattern can be arranged at all locations of the main body.

The main body can comprise hand grip zones. The main body in particular comprises a hand grip zone in the form of a thumb rest, as already mentioned further above. The thumb rest can be e.g. part of an injection moulded thumb grip.

The thumb rest in particular is arranged in a section of the grip part of the main body, said section being at the front towards the brush head.

In particular, the thumb rest is arranged in front of the brush head and in particular in front of a neck section considered in the direction of the brush head.

In particular, the thumb rest is arranged on the front side of the main body.

In particular, the thumb rest is arranged on at least one, in particular both longitudinal narrow sides of the main body.

In particular, the thumb rest is also arranged on the rear side of the main body.

Several thumb rests can be provided on the main body at different locations

The thumb rest, in particular comprises a closed outer contour, in particular if this is arranged on the front side of the main body.

The outer contour of the thumb rest can be essentially elliptical, round, triangular, rectangular or polygonal. The outer contour can also be adapted to the thumb shape.

As already described further above, the thumb rest can comprise a structuring. The structuring can comprise a plurality of deepenings.

As already described above, the thumb rest can comprise a pattern.

The thumb rest can comprise a combination of a pattern and structuring.

The pattern or structuring can be effected by way of embossing, such as hot-embossing, burning-in or pressing in.

One can envisage the structuring extending to onto the edge of the thumb rest.

One can envisage the thumb rest being framed by a peripheral edge and the structuring being arranged within the edge.

The thumb rest can be designed in the form of a trough.

The edge itself can likewise be structured. The peripheral edge can thus be designed as deepening.

The thumb rest can have a width of 5 mm-18 mm, in particular 7 mm-12 mm.

The thumb rest can have a length of 12 mm-30 mm, in particular of 17 mm-25 mm

The thumb rest can have a depth or deepenings of 0.2 mm-2 mm, in particular of 0.5 mm-1 mm.

The deepenings of the thumb rest which are formed by the structuring in particular are less pronounced towards the edge of the thumb rest than in the centre.

The deepenings can be delimited by perpendicular or inclined side walls.

The structuring with deepenings can extend over the complete surface of the thumb rest. The thumb rest can also form islands without a structuring. The structuring can also be islands within the thumb rest.

In particular, the structuring of the thumb rest is designed symmetrically to the middle longitudinal axis of the main body. The structuring of the thumb rest can additionally have a symmetry transverse to the middle longitudinal axis.

The care bristles or tooth cleaning bristles in particular are manufactured of filaments or cut to length from filaments. With the anchor punching method, one or more filaments which are cut to length are bent in a U-shaped manner. In this manner, the filaments each form two care bristles which are connected to one another, each with a used end.

The used end corresponds to that end of the care bristle, by way of which the care function is carried out. Accordingly, the used end in the finished toothbrush represents a free bristle end.

Several care bristles in particular form bristle bundles in the brush head.

The care bristles or the bristle bundles in particular form a bristle field in the brush head.

Apart from the care bristles, the bristle field can also comprise cleaning and massage elements, e.g. of a soft component. The cleaning and massage elements can be of an elastomer or of a rubber-elastic material. The cleaning and massage elements can be injected or injected onto the main body by way of an injection moulding method.

In particular, the care bristles are of plastic. The care bristles can be of a hard component. The care bristles can be of a soft component. The care bristles can be of a combination of hard component and soft component.

The care bristles can be conventionally manufactured i.e. extruded. Extruded care bristles can be of polyamide (PA) or polyester (PBT). Hence the care bristles can be manufactured of polyamide PA 6.10 or PA 10.10.

Te care bristles can also be manufactured of sustainable materials. In particular, the care bristles can be manufactured of renewable raw materials. Hence the care bristles can be manufactured of cellulose or on the basis of cellulose. The care bristles can further be manufactured on the basis of lactic acid (PLA). In particular, the care bristles can also be manufactured of a biologically degradable plastic.

Furthermore, the care bristles can be manufactured of recycled plastic, for example from a recycled polyester (PET).

The care bristles can be cylindrical or pointed. The care bristles can be pointed in a chemical method, if particular of these consist of polyester (PBT).

The care bristles can have a cylindrical, wavy, rotated or spiral-shaped longitudinal shape.

The cross-sectional shape of the care bristles can be (circularly) round, elliptical, oval, polygonal, such as triangular, rectangular, square, trapezoidal, parallelogram-shaped or rhombus-shaped.

The care bristles which are used in oral hygiene can have a diameter of 0.075 mm-0.25 mm. The care bristles can have an area of 0.002 $mm^2$-0.2 $mm^2$.

The care bristles which are used in the cosmetic field can have a diameter of 0.025 mm-0.2 mm. The care bristles can have an area of 0.001 $mm^2$-0.15 $mm^2$.

The surface of the care bristles can be smooth or textured.

The care bristles in particular are grouped together into bristle bundles. If the care bristles are fastened in bristle holes as bristle bundles, then each bristle hole receives a bristle bundle with the conventional anchor punching.

A bristle bundle can comprise care bristles of the same type or of different types of care bristles and thus form a mixed bristle bundle. Different types of care bristles can relate to different geometries and/or different materials. For example, cylindrical and pointed filaments can be mixed and these different care bristles be provided in a bristle bundle:

According to an embodiment variant, the care bristles can also be injected in an injection moulding method:

Thus the care bristles can be injected directly onto the main body, in particular onto a head part of the main body, e.g. of wood, by way of injection moulding methods.

Herein, in particular it is not only the care bristles which are injected, but the interface to the main body also formed with the same material and on the same piece in the same working operation.

If the injected care bristles are injected directly onto the main body, then this can be pre-treated so that the main body is not compromised by the heat effect of the injection moulding method.

Since the main body as a rule does not assume a material connection with the injected plastic material, structuring elements, in particular deepenings or recesses such as undercuts, blind holes and/or through-holes can be shaped on the main body, and these permit a positive holding of the injected-on elements such as care bristles.

In particular, a saw-tooth shaped geometry on the main body is suitable for the main body and the injected-on element to be well connected or held on one other.

The respective disclosure concerning the manufacturing of recesses or holes further above in the description is referred to with regard to the manufacture of these structuring elements.

It is further conceivable, given a suitable design of the wood body and of the injection moulding part and suitable measures on manufacturing, for the injecting of the plastic material onto the main body of wood to be possible without aids or without special geometry elements on the main body. This is due to the fact that an adequate adhesion is achieved due to the interaction of e.g. design, wood type, plastic component, pressure and heat.

In particular, the wood is compressed by the injection pressure on injection moulding.

With the injection moulding, plastic material can at least partly penetrate into the outer layer of the wood. The adhesion of the plastic to the wood is increased by way of this.

During the injection moulding, the residual humidity is gassed out of the wood and forms small air inclusions or voids in the plastic body. This has the effect of a propellant and thus plastic can be saved.

If the main body, e.g. for injecting on the brush head body, is inserted into the injection moulding tool, then this main body can be clamped on a clamping section.

In particular, the main body is pressed or compacted on the clamping section. This leads to a calibration of the cross section of the main body on the clamping section, which in turn ensures the sealedness of the peripheral injecting procedure or leads to a sealing of the tool cavity. In particular, the clamping section therefore lies on the edge of the tool cavity.

These effects are valid for all the methods which are presented in this document and concerning which wood is peripherally injected with plastic in a direct manner (for this, see the statements with regard to the IMT method for anchoring bristles, injecting on care bristles, injecting on haptic elements etc.).

If an element which e.g. comprises care bristles is injected onto the main body of wood in the injection moulding method, then a pull-off force for separating the wood and plastic body must be at least 4 kg, preferably at least 5 kg. A trouble-free application of the finished product is possible herewith.

If the injected care bristles are injected on the main body in a direct manner, then a particularly thin brush head can be fashioned.

However, the care bristles can also be injected onto a bristle carrier element. In particular, the bristle carrier element is connected to the brush head body which is yet described hereinafter.

It is also possible for the care bristles to be injected onto the brush head carrier.

In particular, the injected care bristles are of a thermoplastic elastomer and very particularly of a thermoplastic polyurethane elastomer (TPE-U). This component is characterised by good flow characteristics as well as a rapid solidification, i.e. crystallisation. The molecule channels in particular connect at already (still) high temperatures.

The injected care bristles can also be of polyethylene (PE), e.g. in the forms low density polyethylene (LDPE) or linear low density polyethylene (LLDPE).

The injected care bristles can further also be of a thermoplastic polyester elastomer (TPE-E) or a thermoplastic polyamide elastomer (TPE-A).

Special types of soft components are used for injected care bristles, and these as a rule have a higher Shore hardness than soft components, from which soft-elastic cleaning and massage elements or handgrip zones such as thumb rests or tongue cleaners are manufactured.

The component for injected care bristles in particular of thermoplastic elastomer, in particular has a Shore hardness of 0 to 100, very particularly of 30 to 80.

The injected care bristles can be combined with further cleaning and massage elements.

During the injection moulding (two-component or multi-component injection moulding) the components for injected care bristles as a rule do not assume a material fit with the main body and the possibly other applied soft and/or hard components. As a result, a positive fit (undercuts and/or openings and/or partial or complete peripheral injections) are provided for any connections to other hard or soft components. The care bristles which are injected as the second injected component shrink onto the first injected hard or soft component on cooling and then form a shrink connection.

Injected care bristles can be manufactured from sustainable materials. In particular, these can be manufactured from renewable raw materials. Injected care bristles in particular can be manufactured of a biologically degradable plastic. This permits the main body including the injected care bristles to be disposed of in a biologically degradable manner. The separation of the injected care bristles from the main body would no longer necessary.

Injected care bristles can also be manufactured of recycled plastics.

As is yet described in more detail hereinafter, the main body or a brush head body or a bristle carrier element which is assembled on this can comprise bristle holes.

One, more or all bristle holes can be formed at least partly in a cylinder-shaped manner. In particular, this relates to those bristle holes, via which a brush head body is to be press-fit stemmed to a connection section.

The bristle holes can have a diameter of 1.3 mm-2.1 mm, in particular of 1.5 mm-1.9 mm. The bristle holes very particularly have a diameter of 1.6 mm.

The bristle holes can have a depth of 1.5 mm-5 mm, in particular of 2 mm-4 mm. The bristle holes very particularly have a depth of 3.5 mm.

Bristle holes can be incorporated in the region of the brush head at an angle to the front side, i.e. to the bristle hole surface. The angle can be 0° to 45° (angle degrees), in particular 5° to 25°.

Bristle holes which are incorporated at an angle can be oriented in the direction of the longitudinal axis, wherein the bristle holes can herein be inclined in the direction of the front or rear face side of the toothbrush.

Furthermore, bristle holes which are incorporated at an angle can also be orientated at an angle to the longitudinal axis, i.e. transverse to the longitudinal axis. This angle can be 0° to 90°, in particular 0° or 90°. Herein 0° corresponds to an orientation in the direction of the longitudinal axis.

On account of the angled arrangement of bristle bundles, these can also project laterally beyond the brush body in the direction of the longitudinal axis or at an angle to this, i.e. transverse to the longitudinal axis. By way of this, the bristle field is wider or longer than the main body.

Bristle holes with different diameters can be provided in a bristle field. Herein, different bristling or bundles with bristles of a different type can be realised for the different diameters. Thus larger bristle bundles with pointed care bristles and smaller bristle bundles with cylindrical care bristles can be realised.

The bristle bundle sizes can be arranged in different patterns. By way of example, some possibilities are listed hereinafter:

- alternating sizes in longitudinal or transverse rows;
- row of bristle bundles at the outside on the bristle field with a different size compared to the bristle bundles in the inside;
- bristle field of one bristle bundle size with individual islands of bristle bundles of one or more other sizes;
- having a size course: larger bristle bundles at the front in the bristle field towards smaller bristle bundles at the rear in the bristle field.

Bristle holes which stand very close to one another and in this manner fashion a larger bristle bundle can also be formed.

Thus, the wall thickness between the bristle holes can be reduced compared to conventional bristle fields. For this, the anchor elements can be incorporated into the bristle holes at angles. This means that adjacent anchor elements are not parallel, so that these do not mutually disturb one another and hence an optimal anchoring of the care bristles is ensured.

The arrangement can be selected such that the anchor elements do not anchor into the walls between the closely located bristle holes, but into walls of the bristle hole, to which walls no closely located bristle holes are adjacent.

The anchor elements can basically be incorporated by way of a punching machine with a rotatable anchor, so that the anchor elements can be set at different angles with respect to the longitudinal middle axis of the main body depending on the configuration of the bristle holes.

Specifically, the angle can also be adapted depending on the grain of the wood, and hence the anchor elements in particular are incorporated transversely to the grain of the wood. If the grain of the wood lies in the longitudinal direction, then in particular the anchor elements are incorporated at an angle of 15°-75°, very particularly of 25°-65° to the longitudinal middle axis of the main body.

The filaments can be brought into the bristle holes by way of a punching method and be fastened in these and thus form care bristles and bristle bundles.

The filaments can be anchored into the bristle holes in particular by way of anchor elements and thus form care bristles and bristle bundles.

Thus, the filaments can be anchored into the bristle holes by way of an anchor punching method and thus form care bristles and bristle bundles.

With the anchor punching method, the filaments together with the anchor elements are brought into the bristle holes by way of a punching tool which comprises a punching stamp, are folded around the anchor element and fixed, i.e. anchored in the bristle holes by way of the anchor elements. The care bristles form a bristle bundle herewith.

On account of the folding by way of the anchor element, the bristle bundle comprises two halves which each comprise one of the ends of the folded care bristles.

As already mentioned above, the anchor element can be positioned in the bristle hole at an angle of 0° to 90° relative to the longitudinal axis of the main body. The angle can be variable over the bristle holes. In particular, adjacent bristle holes cannot enclose the same angle, i.e. are not aligned parallel to one another.

In particular, anchor element is an anchor platelet.

The anchor element can be of metal. The anchor element can be of plastic. The anchor element can be of a sustainable plastic, in particular of a renewable plastic, recycled plastic or biologically degradable plastic. Furthermore, the anchor element can also be of a wood or a wood material or of a material which is obtained from wood.

The anchor element can have a smooth surface. The anchor element can have a structured surface, e.g. with a fluting or corrugation. The anchor element can have the structured surface on one longitudinal side or on both longitudinal sides.

In particular, the anchor element is longer than the diameter of the bristle hole, so that the anchor element which is inserted into the bristle hole with its longitudinal edge in front can be anchored in the bristle hole.

The anchor element can have a length which is at least 0.2 mm, in particular at least 0.3 mm longer than the diameter of the bristle hole.

The anchor element can have a length of 1.2 mm-3 mm, in particular of 1.8 mm-2.5 mm.

The anchor element can have a width of 0.15 mm to 0.4 mm, in particular of 0.2 mm-0.35 mm.

The anchor element can have a height of 0.8 mm-2 mm, in particular of 1 mm to 1.6 mm.

The anchor elements in the bristle head amongst one another in particular have a distance of at least 0.25 mm, in particular at least 0.4 mm.

The pull-out force of the bristle bundles which are brought into the bristle holes on the main body by way of the anchor punching method in particular is at least 1.5 kg, i.e. 15 Newton.

The pull-out force of the bristle bundles which are brought into the bristle holes in a brush head body by way of anchor punching methods in particular is even at least 4 kg, very particularly 5 kg.

The pull-out force in particular depends on the nature of the wood or on the wood type. For example, the pull-out force of bristle bundles which are anchored in beech wood is greater than the pull-out force of bristle bundles which are anchored in bamboo, given an identical bristle hole design.

The pull-out force on using beech wood in particular is greater than 2.5 kg thus 25 Newton, preferably in the region of 3 kg which is 30 Newton.

If the bristle bundles are incorporated into bristle holes on the main body, or in the head part of the main body, then—with the anchor punching method as well as with an anchor-free method which is yet described further below—after incorporating the bristle bundle—the wood material in the brush head can be brought to swell at least in the region of the bristle hole or of the bristle holes.

Alternatively, this region can also be compressed. Herein, one can apply the same mechanisms as with the reshaping and pressing.

The swelling or compressing in particular is effected in a suitable device/a suitable tool. The swelling or compressing tool can be an integrated constituent of the stuffing tool, such as stamp, which brings the bristle bundles into the holes. The swelling or compressing process can be assisted or amplified with the feed of heat and/or humidity and/or other means/agents.

On account of the swelling and compressing of the wood, the diameter of the bristle hole or holes reduces, which ensures a retention or additional retention of the care bristles or of the bristle bundles in the bristle holes.

The care bristles or bristle bundles can also be fastened or fixed in bristle holes by way of an anchor-free bristling method. Anchor-free bristling methods in contrast to the anchor punching methods in particular are characterised by the fact that the care bristles are not folded, i.e. no U-shape is formed.

A particular embodiment of an anchor-free bristling method in particular wherein the care bristles are fastened on a bristle carrier element such as a bristle carrier platelet and the bristle carrier element is attached to a head part of the main body or to a brush head body.

In particular, the care bristles are fastened on or to the bristle carrier element by way of a (plastic) welding or melt connection.

The rear-side bristle ends which in particular are melted on form an at least continuous melt carpet.

For this, the bristle carrier element can comprise bristle holes or bristle recesses for receiving the care bristles or no bristle holes, according to the particularity of the anchor-free bristling method.

The bristle holes or bristle recesses can be designed as blind holes or through-holes in the bristle carrier element.

The toothbrush or the brush head, as yet described further below, can comprise a brush head body which is connected to the main body via a connection section on the main body. The bristle carrier element with the care bristles is arranged on the brush head body or is fastened to this. For this, the brush head body in particular forms a receiver which receives the bristle carrier element.

The bristle carrier element with the care bristles can also be arranged directly on a head part of the main body, or be fastened to this. For this, the head part can form a receiver for receiving the bristle carrier element.

The receiver can comprise undercuts which can be e.g. by material-removal, pressed, milled or in the case of a brush head body even injection moulded.

The bristle carrier element in particular is of plastic, in particular of a sustainable plastic as described further above. The bristle carrier element however can also be of wood.

The fastening of the bristle carrier element, e.g. in the receiver of the head part or of the brush head body can be effected by way of plastic welding (on being received in the brush head body), in particular ultrasound welding or friction welding. The bristle carrier element can also be glued into the receiver. The bristle carrier element can be mechanically anchored and thus fastened in the receiver e.g. also by way of a snap connection, pressing in by compressing and/or pressing and reshaping wood. A combination of the methods is possible.

For connecting the bristle carrier element to the head part or to the brush head body, projecting or protruding geometries can be pressed.

The attachment of the care bristles onto a bristle carrier element which in turn is attached onto a head part or a brush head body, as a variant can lie in an anchor-free bristling method which is described hereinafter.

In particular, the care bristles or bristle bundles are fastened in bristle holes in the so-called PTt-method without the help of an anchor element.

The care bristles are provided in a bundled manner. The care bristles are melted with one another in a bundled manner at their bristle ends which lie opposite the used end.

For this, the care bristles in bundles with their bristled ends which lie opposite the free used end are led in particular through openings of a holding/pressing device.

A bristle carrier element or a bristle carrier body of plastic which forms bristle holes, in particular blind holes is provided and in particular is heated at least partly to the glass transition temperature.

The melted bristle bundles are brought into the bristle holes e.g. by way of the holding/pressing device.

The bristle bundles which are introduced into the bristle holes are fixed or anchored in the bristle holes amid the application of pressure upon the bristle carrier element or the bristle head carrier, e.g. by way of the holding/pressing device. In particular, the fixation is effected by way of deformation or compressing the bristle holes. Hereby, the cross section of the bristle holes is deformed and in particular reduced in size, at least in sections.

According to a particular modification of the PTt method, the bristle holes each comprise an in particular annular projection or edge, with respect to a bristle hole surface. The bristle hole surface corresponds to that surface, into which the bristle holes are recessed.

For the fixation of the care bristles which are brought into the bristle holes, the body (such as bristle carrier element or brush head body) which forms the bristle holes, or the mentioned projection is deformed in the region of the bristle holes, e.g. by way of pressing, in a manner such that the care bristles which are inserted into the bristle holes are fixedly clamped by way of the deformed projection or the edge.

On account of the pressure upon the bristle carrier element, e.g. during the PTt method, the bristle carrier element can be anchored on the receiver of the head part or of the brush head body. I.e. in other words, the anchoring of the care bristles in the bristle carrier element and the assembly or the anchoring of the bristle carrier element on the receiver of the head part or of the brush head body can be made in one working operation during the PTt process.

The bristle bundles can be melted with one another before the insertion into the bristle bundles according to the PTt method described above.

According to a particular design, the bristle holes are formed in the head part of wood. For carrying out the aforementioned PTt method, the head part is compressed or compacted by way of pressing and thus the bristle holes are deformed. In contrast to a heated plastic body, the deformation does not take place by material flow but by way of compressing or compacting or squeezing.

The bristle holes can be deformed during this procedure. I.e. circularly round holes can be deformed into elliptical bristle holes during this procedure.

The pressing can take place under the action of heat. The pressing can take place under the action of humidity, such as e.g. steam.

The pressing or the deformation can be effected in different directions. On the one hand the direction of the applied pressure can be effected parallel to the bristle longitudinal axis. This means that for example projecting elements are pressed around the bristle holes, such as for example projecting edges. On the other hand, a pressing or a deformation of the head part can be effected perpendicularly to the bristle longitudinal axis. Hereby, for example the head part can be laterally pressed together, so that a sufficiently large holding force for the bristle bundles can be achieved.

By way of the pressing or the deformation perpendicular to the bristle longitudinal axis, the head part is narrowed in the transverse direction, which means that the head part has a smaller width. The deformation entails a reduction of the width of the head part of 5% to 20%, preferably of 7% to 12%. The reduction of the width also effects a reduction of the diameter of the bristle holes which for its part lies in a similar range as the reduction of the width of the head part, specifically at 5% to 20%, preferably 7% to 12%.

By way of the application of the pressing or the deformation, other bristle bundle shapes can also be realised. For example, bristle holes with an elongate extension, thus in an elongate recess which is orientated in the longitudinal direction of the main body. Bristles can be fixed in these recesses in an anchor-free manner by way of lateral pressing or deforming.

A similar effect can also be achieved by way of the swelling of the wood. The compressing or compacting and swelling can be combined with one another.

The design with the head part of wood, which is described above, can be combined with the modification of the PTt method which is described above and in which the fixation of the bristle bundles is effected by way of deformation of a projection or edge. In this case, the projection or edge in particular consists of wood.

According to the embodiment, concerning which the edge of the bristle hole is deformed, the main body is manufactured in particular before the anchoring of the bristle bundles, as is manufactured e.g. for conventional punching. The bristle holes in particular are drilled. The bristle bundles which in particular are melted at their end are brought into the bristle hole and the edge is deformed around the bristle hole.

For this, the edge of the bristle hole is pressed with a tool, in particular such that this lies more deeply than before after the pressing. Herein, a type of ramp from the edge to the surface of the brush head is shaped. Herein, the ramp has an angle of 30° to 60° to the remaining surface of the head part.

The bristle carrier element can e.g. be a bristle carrier platelet.

The anchor-free bristling can also be effected by way of a so-called AFT or AMR method. These are characterised by continuous bristle holes in a body (e.g. head part, bristle carrier element or brush head body). According to this method, the care bristles or bristle bundles are led through the bristle holes and are melted together with their end sections or bristle ends which exit at the other side.

The rear-side end sections or bristle ends which are melted to one another can be shaped into an anchor element or melt carpet on melting. The anchor element is characterised in particular by a larger cross section than the bristle hole, by which means this develops an anchoring effect against a pulling-out from the bristle hole in the direction of the used end of the care bristles.

The end sections or bristle ends at the rear side can also be melted to the body which forms the bristle holes.

It is also possible, prior to this, to melt the bristle bundles to one another with their end sections or bristle ends which lie opposite the used ends, analogously to the PTt method. The bristle bundles are subsequently led with their melted end sections or bristle ends through the bristle holes. The melted end sections or bristle ends which exit at the other end are melted once again and in particular are reshaped into an anchor element.

The melted end sections or bristle ends can be melted to the body which forms the bristle holes, by way of re-melting.

Alternatively or additionally, the exiting end sections or bristle ends can also be peripherally injected or moulded with an (additional) plastic material in the AMR method. This can be effected e.g. by way of an injection moulding method. The injection moulded plastic material, as is yet explained further below, can form a function element. The plastic material can be a hard or a soft component. For this, the body which comprises the bristle holes is inserted together with the introduced care bristles or bristle bundles into an injection moulding tool.

The bristle holes can run out into a trough at the rear side, said trough receiving the exiting end sections or bristle ends.

According to the AMR method, e.g. the head part of the main body which in particular is of wood can comprise continuous bristle holes.

It is also possible for a bristle carrier element, in particular a bristle carrier platelet to comprise continuous bristle holes, as is the case with the AFT method for example.

The bristle carrier element can be of plastic. The bristle carrier element can be injection moulded.

The bristle carrier element can for example be connected to a brush head body.

The bristle carrier element can also be connected to a head part of the main body, e.g. by way of bonding, welding, mechanical connecting or snapping or pressing and compressing the head part. Combinations of the mentioned methods can also be applied.

For this, the bristle carrier element in particular is inserted into a receiver on the brush head body or head part.

The bristle ends or end sections which exit at the rear side of the bristle holes and are connected to one another or the material which is deposited on the rear side by way of injection moulding, apart from their anchoring function can yet have a further function. Thus the mentioned end sections or bristle ends or the injected-on material can serve as shock absorbers or as a tongue cleaner or form such an element and be shaped out accordingly.

The bristle carrier element can e.g. be a bristle carrier platelet.

A method for fastening a bristle carrier element which has been equipped with care bristles with an anchor-free method, to a head part, is disclosed for example in the document DE 200 06 311 U1.

According to a particular method, the care bristles are deposited onto the head part, a brush head body or a bristle carrier element by way of IMT (in mould tufting). In contrast to other anchor-free methods, concerning which the conventional care bristles are fastened by way of melting in bristle holes, here for anchoring the conventional care bristles are peripherally injected by way of plastic (in mould tufting IMT) in an injection moulding machine.

Herein, the care bristles in particular in a manner grouped together in bristle bundles as well as the receiver of the head part or of the brush head carrier are inserted into an injection moulding tool and are subsequently peripherally injected with a hard and/or soft component. The bristle carrier element which arises by way of the peripheral injecting is anchored on the receiver of the head part or of the brush head carrier in the same working operation and the care bristles are fixed in the bristle carrier element.

According to the Aero (integrated anchorless production), the care bristles are likewise peripherally injected, wherein the bristle carrier element, in particular the bristle carrier platelet is formed by the peripheral injecting.

The bristle carrier element which is furnished with care bristles is then attached to the head part or to the brush head body as in the methods which are described further above.

As already mentioned further above, according to an embodiment variant the care bristles are received into the main body in a direct manner.

For this, the main body apart from a grip part comprises a head part. Bristle holes are incorporated into the head part. In particular, the bristle holes are blind holes with a bristle hole base.

The creation of the bristle holes is effected e.g. by way of drilling or in particular by way of milling. Accordingly, a drilling tool or in particular a milling tool is applied.

In particular, a plurality of bristle holes which form a so-called bristle hole field is brought into the head part. In particular, the bristle holes serve for receiving bristle bundles.

The bristle holes amongst one another can have a minimal distance from hole edge to hole edge of 0.5 mm to 2.5 mm, in particular of 0.8 mm to 1.5 mm.

The outermost bristle holes can have a minimal distance to the edge of the brush head (hole edge to side edge of the brush head) of 1.5 mm to 3 m, in particular of 1.8 mm to 2.2 mm. Herein, the bristle holes in particular should not lie in a possible rounding of the edge of the brush head, or intersect this.

The frontmost bristle holes can have a minimal distance to the front edge of the brush head (hole edge to face edge of the brush head) of 2.5 mm to 5 mm, in particular of 3.5 mm to 4.2 mm.

The difference between drilling and milling bristle holes amongst other things lies in the fact that the drill hole base comprise a cone shape or chamfer in the case of drilled bristle holes. The bristle hole base consequently does not form a right angle to the side wall.

In the case of milled bristle holes, the bristle hole base comprises two waves. These waves form on account of the geometry of the miller. The cutting edge of the miller is shaped accordingly.

Bristle holes are not only to be understood as circular holes, but also non-circular recesses. The recesses can also assume and essentially elliptical, triangular, quadrangular, polygonal, banana-shaped, circle segment-shaped basic shape.

For incorporating the bristle holes into the main body, this body in particular is held by a holder. The main body is inserted into the holder prior to this. In particular, the main body is clamped in the holder.

In particular, the manufacture of the bristle holes is effected after the profiling and in particular also after carrying out a surface treatment.

After creating, i.e. milling and/or drilling and/or stamping out and/or lasering the bristle holes, the bristle hole field is cleaned and the chips and dirt are removed. This is effected e.g. by way of brushing-away. The brushes can be e.g. soft elastic brushes. In particular, the cleaning can be effected by way of rotating brushes. The cleaning can also be effected by way of a rotating buffing wheel.

After creating the bristle holes, the filaments are inserted into these and are fastened in the bristle holes (as described above), in particular by way of anchor elements.

In particular, the filaments are fastened in the bristle holes by way of an anchor punching method which is described further above.

Concerning an anchor punching method, up to 1000 bristle holes per minute are punched which is to say are occupied with filaments. As a rule, the individual bristle holes are bristled in a temporally successive manner in a repetitive process by way of a punching tool. However, several bristle holes can also be bristled simultaneously.

For bristling the bristle holes, in particular by way of the anchor punching method, the main body is brought into, in particular clamped into a holder, and is held by this—inasmuch as this is not already the case due to the preceding working step.

Thus for bringing and fastening the filaments into the bristle holes, the main body can be held in the same holder as on incorporating the bristle hole. This means that the main body in particular remains in the holder between the incorporation of the bristle holes and the bringing and fastening of the filaments into the bristle holes.

An exact positioning between the bristle holes and the fastening tool, such as punching tool for bringing in and fastening the filaments is achieved by way of holding the main body in the same holder for incorporating the bristle holes as well as for bringing in and fastening the filaments in the bristle holes.

The incorporating of the bristle holes into the main body and the bringing-in and fastening of the filaments in the bristle holes can be combined in a common device or in separate, i.e. two different devices which are spatially separated.

Hence with the anchor punching method, the filaments are brought into the bristle holes in a punching machine. The punching machine can either be designed as a separate processing machine or be combined with a device for incorporating the bristle holes, such as a milling or drilling machine.

The incorporation of the bristle holes into the main body and the bringing-in and fastening of the filaments in the bristle holes can be effected in a temporally consecutive manner or at a temporal interval. The time duration between the incorporation of the bristle holes into the main body and the bringing-in and fastening of the care bristles in the bristle holes in particular is effected in a temporal interval of less than 4 weeks, in particular less than 3 weeks. By way of this, it is ensured that the main body does not change its dimensions too greatly on account of environmental influences.

Furthermore, one attempts to carry out the incorporation of the bristle holes and the fastening of the filaments which in relation to this is staggered with regard to time, at essentially equal climatic conditions (same temperature and air humidity). For this, the main body before the machining can be stored for a certain time under the respective conditions, so that the machining steps are effected under equal conditions The longer the main body is stored between the two aforementioned machining steps, the earlier are the measures for monitoring the storage, such as the control of the temperature and air humidity necessary. Otherwise, the dimensional accuracy of the main body is not ensured, which given the subsequent introduction and fastening of the filaments can lead to an inaccurate positioning between bristle holes and the fastening tool.

If the main body is machined in the same holder, then one can forgo a monitoring even with a longer storage.

It can occur that the exact positioning between the holder and bristle hole cannot be ensured and a bristle hole offset occurs. A bristle hole offset can occur for example as a result of shrinkage or swelling of the wood.

For detecting the hole offset, bristle hole positions can be acquired by a camera or be measured out on the punching machine with the drilled or milled main body in the holder.

Accordingly, evaluation software for evaluating camera pictures is applied. The effective bristle hole positions can be compared to reference bristle hole desired positions and deviations recorded by way of the evaluation software.

The measuring and evaluation can encompass all or a selection of bristle holes. According to a particular embodiment, at least two reference bristle holes, in particular exactly two reference bristle holes are measured out or evaluated.

If not all, but only a selection of reference bristle holes are measured out or evaluated, then any occurring positional correction of the other bristle holes are derived from the results concerning the reference bristle holes, e.g. by way of an extrapolation or interpolation method.

The positional correction is notified to the bristling machine, such as punching machine. The bristling machine corrects the position of the bristle hole which deviates from the desired position, according to the measured or computed and fed-in positional correction.

The correction can be effected by way of a displacement of the holder together with the held main body. The correction can also be effected by way of a displacement of the bristling tool, such as punching tool or punching stamp.

A determined offset between an effective bristle hole position and desired bristle hole position in particular can be individually corrected way of a CNC control.

The main body is led by the holder during the aforementioned procedures.

After the positional correction has been effected, the bristling of the bristle hole, e.g. by way of a punching step is effected.

The punching tool, in particular the punching stamp which is applied in the anchor punching method can come to abut on the main body on punching, i.e. on attaching the bristling. The abutting of the punching tool on the main body represents an end position of the punching tool. Only way of the abutting, it is to be ensured that the anchor element is brought sufficiently far into the bristle hole.

Furthermore, the main body can further be additionally compacted in the region of the bristle hole as described above, by way of the abutting.

The dimension from the bristle surface to the end position of the punching tool is e.g. 0.01 mm to 0.3 mm, in particular 0.03 mm to 0.1 mm. This means that the punching tool penetrates into the main body by this amount, which can lead to a certain deformation of the main body in the region around the bristle hole.

After fastening the filaments in the bristle holes, a post-machining of the care bristles, in particular of the bristle ends, such as profiling and cutting follows, depending on the bristle type. Herein, it is also possible to print the care bristles (horizontally as well as vertically).

With regard to the anchor-free methods which are described above, the bristle ends of the care bristles are machined (cut and/or rounded) in particular before the fastening. The printing of the bristles is preferably made after the fastening.

According to a further embodiment variant of the invention, the bristle holes or the care bristles are not brought into the main body in a direct manner.

The main body according to this embodiment variant forms a connection section. The connection section in particular is a brush-head-side end section of the main body. The connection section in particular comprises a free end. The connection section in particular is designed in a rod-like manner.

In particular, the connection section serves for creating a connection with a brush head body. The connection section or at least a part thereof in particular is a part of a brush head of the toothbrush to be manufactured.

The length of the connection section in particular is 15 mm to 30 mm, very particularly 15 mm to 25 mm.

The diameter of the connection section in particular is 5 mm to 15 mm, very particularly 5 mm to 12 mm.

In particular, the connection section is shaped out by way of a material-removing machining, such as planing, milling, turning or drilling and/or shape-pressing. The shaping of the connection section can be effected together with the profiling of the longitudinal sides of the main body which is described further above. The shaping of the connection section can also be effected before or after the profiling of the longitudinal sides of the main body which is described further above.

The connection section can comprise at least one, in particular several deepenings.

The connection section can alternatively or additionally comprise at least one, in particular several prominences.

The at least one deepening or prominence in particular is arranged laterally.

The at least one deepening or prominence in particular represents a positive-fit geometry, such as latching geometry. Positive-fit geometries secure the brush head body in particular from a withdrawal of the brush head body from the main body.

The at least one deepening in particular corresponds to an engagement deepening. The at least one prominence in particular corresponds to an engagement element.

The at least one deepening or prominence in particular serves for creating a positive-fit connection with the brush head body, in particular a latching connection. The positive fit connection in particular is characterised by the hooking of at least one prominence or an engagement element with at least one deepening or engagement deepening.

The positive-fit geometry is possibly designed such that a withdrawal of the brush head body is only possible from a defined minimum pull-out force.

The procedure "withdrawing" in particular means a relative movement between the brush head body and the connection section parallel or essentially parallel to the longitudinal axis of the connection section or possibly the toothbrush.

The at least one deepening can be a notch. In particular, this is characterised by a shape which is triangular in cross section. The at least one deepening can be an indentation.

The at least one prominence can be a bulge, a projection or a jag.

Hence for example several deepenings can be shaped out on the connection section. These can be arranged next to one another or behind one another in the longitudinal direction of the main body. In the latter case, a saw-tooth shape with several deepenings which are arranged after one another can be formed. In particular, the saw-tooth arrangement runs parallel to the longitudinal direction.

Basically, it is also possible for the connection section to comprise the complementary positive-fit geometry to the aforedescribed saw-tooth shape of deepenings, specifically a saw tooth shape of projecting jags.

The deepenings in particular have a depth of 0.5 mm to 2 mm, very particularly of 0.8 mm to 1.5 mm with respect to the main surface.

A deepening in the connection section in particular forms a positive-fit pairing, such as latching pairing with a projecting element or a prominence in the receiver on the brush head body.

A prominence in the connection section forms a positive fit pairing such as latching pairing in particular with a deepening in the receiver on the brush head body.

A projecting element or prominence in the receiver can be a bulge, a projection or a jag.

A deepening in the receiver can be a notch. In particular, this is characterised by a shape which is triangular in cross section. The at least one deepening can be an indentation.

In particular, deepenings or prominences in the receiver are arranged laterally.

Deepenings in the connection section in particular are formed inverted to the aforementioned elements or prominences in the receiver of the brush head body.

As already mentioned, the brush head body can be injected onto the main body, by which means opposite geometries such as mutually complementary deepenings and projecting elements or projections form between the brush head body and the connection section.

The care bristles then, as described, in particular can be simultaneously anchored during the attachment or injection moulding of the brush head body (e.g. by way of IMT methods) or be anchored in or on this subsequently (e.g. by way of AFT methods, PTt methods or anchor punching).

Deepenings can be brought into the connection section in a material-removing manner such as milling, planing or drilling. Furthermore, the deepenings, as mentioned further below, can also be brought into the connection section by way of a pressing procedure.

According to a particular further development, the connection section is shaped out into a rough geometry by way of the aforementioned material-removing machining. The connection section is pressed into its final geometry in a subsequent machining step, such as shape pressing, by way of a pressing tool such as a forming press.

Concerning this procedure, the wood of the connection section is compressed or compacted, which leads to a reduction of the shape cross section. By way of the pressing procedure, the definitive geometry of the shape cross section is brought into the connection section.

In particular, for this, the connection section is inserted into a tool mould which represents the final shape of the cross sectional geometry of the connection section. The mould can be for example of two parts. The tool mould can consist of metal.

One can envisage the tool mould being cooled. One can envisage the tool mould being heated or warmed.

The two-stage shaping process for the connection section has the following advantages:

In the connection section, the wood is compacted at least partly or in sections, by which means this can absorb less humidity and therefore swells to a lesser extent on use.

Moreover, the pressing procedure serves for the calibration of the connection section. In particular, this is of significance if the main body is manufactured externally and the connection section is not present in the demanded shape accuracy. In this context, the connection section in particular is manufactured with a slight overdimension, so that in series all connection sections can be calibrated to dimension independently of the environmental influences.

The pressing procedure can also serve, as mentioned above, for shaping a positive-fit geometry with at least one deepening or prominence into the connection section.

The final (base) shape cross section of the connection section in particular is trapezoidal. The trapezium shape in particular is a quadrangle with two base sides of a different length which lie parallel to one another. The limbs which connect the base sides to one another in particular run towards one another to the shorter base side and in particular run apart to the longer base side.

In particular, the shorter base side is directed to the rear side of the toothbrush and the longer base side in particular is directed to the front side of the tooth brush.

The final (base) shape cross section of the connection section in particular is swallowtail-shaped.

Such a shape cross section for example prevents the brush head body from being pushed onto the connection section with an incorrect alignment, specifically rotated by 180°.

According to a further embodiment variant, the final (base) shape cross section of the connection section is round, in particular circularly round. A connection section a with round, in particular circularly round (base) shape cross section in particular can be turned.

However, elliptical, triangular, rectangular, polygonal shape cross sections are also conceivable.

The connection section can be designed in a conically tapering manner towards its free end.

In the assembled state, the connection section in particular forms a part of the brush head.

In the assembled state, the connection section in particular forms part of the neck section.

The brush head body serves for receiving the care bristles and consequently for forming a bristle field.

According to an already mentioned embodiment variant, the brush head of the toothbrush comprises a brush head body for directly receiving the care bristles or for receiving a bristle carrier element with care bristles which are anchored thereto.

The brush head body in particular is connected to the main body via the connection section.

According to a particular embodiment, the brush head body is manufactured as a separate component and in a subsequent working step is connected to the main body or to its connection section.

The brush head body however, e.g. analogously to the injected bristles can also be connected directly to the main body or be injected onto this in the injection moulding method (as already described further above).

Thus, in particular a connection section on the main body is peripherally injected in a cross-sectional view.

If the brush head body is injected on the main body in an injection moulding method, then for this purpose the main body is inserted into the injection moulding tool (see also description further above).

In order to avoid over-injections of the plastic component, the main in particular is sealed in the injection moulding mould. For this, the main body can be pressed into the injection moulding mould at least in sections. By way of this, a good scaling is to be achieved at the edge of the injection moulding cavity (see also description further above).

The main body can already be pressed in the region of the sealing in a previously executed step, so that it obtains a matching contour for the sealing and is shaped in a sufficiently accurate manner.

Furthermore, the main body at least in the sealing region or sealing section can be pressed into shape also by way of the insertion and closure of the injection moulding tool. For this, the main body comprises an overdimension, in particular before the insertion. Herewith, elastic biasing which serves for sealing the injection moulding cavity is realised.

In order to anchor the injected-on brush head body to the main body, positive fit geometries such as recesses or deepenings, undercuts, openings, neckings, prominences or projections, widenings which are peripherally injected or through-injected and thus anchor the plastic body can be created on the connection section of the main body.

This is necessary since wood and plastic do not assume a material fit, so that a connection can only be effected via a positive fit.

Thus, for example a lateral necking or widening which is peripherally injected with plastic can be created in the connection section of the main body. By way of this, the plastic body can no longer be removed, i.e. pulled off.

The design of the recesses or deepenings, undercuts, neckings, prominences, projections, widenings or openings in the connection section can be effected directly in the material-removing method on shaping the longitudinal narrow sides or with the subsequent milling, drilling, punching or pressing.

In particular, the injection moulding is effected in a pressure range of 300 bar to 2200 bar.

Herein, the injection moulding of injected bristles is effected in particular with a pressure between 1200 bar and 2000 bar. The pressure on injection moulding a brush head body of a soft or hard component in particular is between 500 bar and 1500 bar.

The temperature of the melted soft or hard component in particular lies between 100° C. and 350° C. Hence, these components encounter the main body at very high temperatures.

The bristle head body can form bristle holes, into which the care bristles are brought and fastened by way of an already described bristling method, such as anchor punching or the PTt-method.

Cleaning and massage elements and/or injected bristles can also be moulded on the brush head body in the injection moulding method. These for example can be injected onto the brush head body. These for example can be injected together with the brush head body.

According to an alternative embodiment, the cleaning and massage elements and/or injected bristles can be injected directly on the main body, in particular on its head part.

Furthermore, the mentioned thumb grip and/or the other haptic elements or the mentioned element on the grip end for the protection from water absorption can be injected in the injection moulding method.

The possible usable hard and/or soft components for the injection moulding method are specified at another location.

The brush head body in particular is an injection moulded part.

The brush head body in particular consists of a different material than the main body.

The aforementioned injected-on parts or elements, such as the tongue cleaner, thumb grip or the element at the grip end for the protection from water absorption in particular consist of a different material than the main body. Subsequent embodiments concerning the material of the brush head body also apply to the mentioned injected-on parts and elements.

In particular, the brush head body consist of a plastic, very particularly of a sustainable plastic. Hence the brush head body can consist of a plastic of renewable raw material, of a biologically degradable plastic, of a recycling plastic or however also of a conventional plastic or comprise these.

In particular, the brush head body consists of a hard component or comprises this.

The brush head body can consist of a single plastic material. The brush head body can also be a multi-component element of several plastic materials. Thus, the brush head bodies can consist of a hard component and/or soft component and/or material for injected bristles.

The brush head body can comprise one or more scaling lips which seal the assembled brush head body with respect to the main body or to the connection section. The sealing lip can be of a hard or soft component.

The brush head body can comprise a base element of a soft component, such as thermoplastic elastomer (TPE). The brush head body in particular is connected to the connection section via the base element, e.g. is pushed or stuck onto this connection section. This means that the base element forms the connection interface of the brush head body.

The brush head body can have the following (maximal) outer dimensions:

Length: 20 mm-45 mm, in particular 25 mm-37 mm;

Width: 8 mm-20 mm, in particular 10 mm-15 mm;

Height: 4 mm-12 mm, in particular 5 mm-8 mm.

The brush head body can also assume larger longitudinal dimensions due to regulatory demands or safety demands. In particular, due to the larger longitudinal dimensions it is to be ensured that the brush head body cannot be swallowed in the case of a breakage or separation. In this case, the length can be 45 mm-80 mm, in particular 50 mm-75 mm.

The brush head body can be designed such that this together with the main body, apart from the brush head also completely forms at least a part of the neck section or the neck section of the toothbrush.

The brush head body can thus be designed such that this or at least a part of this is arranged at an angle to the main body or to its grip part. An angle relative to the grip part can thus be incorporated for example in the neck section or at the transition from the neck section to the brush head.

The brush head body can thus form a head part which is part of the brush head of the toothbrush to be manufactured, as well as a neck part which is part of the neck section of the toothbrush to be manufactured. By way of this, a larger length dimension is achieved.

The interface, i.e. the connection between the main body and the brush head body is accordingly formed at least partly in the neck section. The interface however can extend to into the brush head. It is also possible for the interface to be formed completely in the neck section.

The height of the brush head body can reduce in the direction of the front face side of the toothbrush.

The outer contour of the brush head body in particular corresponds to the outer contour of a common brush head of a toothbrush. The outer contour of the brush head body is consequently in particular rounded or very preferably oval. This however in particular only relates to that part of the brush head body which forms the later brush head and not to a neck section which can possibly be part of the brush head body.

The brush head body in particular comprises a front side for the direct or indirect receiving of the care bristles.

In particular, the brush head body in particular comprises a connection interface for connection to a connection section of the main body. The connection interface in particular is arranged on the rear side.

The connection interface in particular is aligned in the longitudinal direction of the main body. The connection interface in particular is a receiver for receiving the connection section of the main body.

According to an embodiment variant, the receiver can be slot-shaped or groove-shaped. The receiver in particular comprises a longitudinal opening such as slot opening. The longitudinal opening in the assembled state of the brush head body in particular runs in the longitudinal direction of the main body or the toothbrush. In particular, the longitudinal opening faces the rear side of the toothbrush.

The width of the longitudinal opening in particular is smaller than the width of the receiver, so that considered in cross section an undercut is formed.

According to another embodiment variant, the receiver is closed over the whole periphery.

In particular, the receiver comprises an insert opening for inserting and pushing the connection section into the receiver. In the assembled state of the brush head body, the insert opening is directed towards the grip part of the main body. The bringing-together of the brush head body and the connection section in particular is effected in a direction parallel to the longitudinal axis of the connection section or possibly of the toothbrush.

The procedure "inserting" or "pushing in" in particular means an in particular linear relative movement between the brush head body and the connection section parallel or essentially parallel to the longitudinal axis of the toothbrush.

The receiver can have the following (maximal) dimensions:

Length: 12 mm-28 mm, in particular 16 mm-24 mm;

Width: 6 mm-10 mm, in particular 5 mm-8 mm (transverse to the longitudinal direction);

Height: 3 mm-10 mm, in particular 5 mm-8 mm (up to the open end of the receiver).

The cross-sectional geometry of the receiver in particular is inverted to the cross-sectional geometry of the connection section of the main body. In this manner, the connection section forms a positive fit with the receiver on joining together.

As already mentioned, the receiver can comprise at least one, in particular several prominences, such as e.g. projections.

Alternatively or additionally, as already mentioned, the receiver can comprise at least one, in particular several deepenings.

The at least one prominence or deepening in particular represents a positive-fit geometry such as latching geometry. The at least one prominence or deepening in particular serves for the creation of a positive fit connection with the connection section of the main body, in particular a latching connection. The at least one deepening in particular corresponds to an engagement deepening. The at least one prominence in particular corresponds to an engagement element.

The at least one prominence or deepening can be a jag or a notch and e.g. have a triangular shape.

A positive-fit connection or latching connection which is realised by way of bringing together the brush head body and the connection section is e.g. not releasable, in particular not releasable without destruction.

Depending on the desired functionality with regard to the exchangeability of the brush head body, one can envisage the connection section as well as the brush head body or their positive fit geometries being damage or destroyed or only the brush head body or its positive fit geometry being damage or destroyed or neither the connection section nor the brush head body or their positive fit geometries being damage or destroyed, on separating the brush head body from the main body or from the connection section.

The positive-fit connection or the latching connection can thus also be designed in a releasable manner. Hence this can be released (in a destruction-free manner) by way of applying a minimal pull-out force as already mentioned. Furthermore, the exchangeability of the brush head body can also be effected by way of separating aids, in particular in the form of detachment elements which permit the withdrawal of the brush head body from the connection section. The brush head body in this case can be exchanged by the user.

If the exchangeability serves the exchange of a spent brush head body by a new one, then the spent brush head body or parts thereof can indeed become damaged or destroyed with the separation procedure, so that this can no longer be used.

If the exchangeability serves for the repeated exchange of different brush head bodies, then the brush head bodies should not be damaged or destroyed with the separating procedure.

In contrast to the press-fit stemming which is yet described hereinafter, with regard to a latching connection the connection structures (prominences, deepenings) are already formed before creating the connection. This means that they are not created not until manufacture of the connection as with press-fit stemming. In particular, a latching connection has the characteristic that the connection structures elastically deform on creating the connection. Herein, the brush head body in particular deforms to a greater extent than the connection section. Necessary hollow structures are therefore preferably formed on the brush head body.

Thus, several prominences, such as jags can be shaped out in the receiver. These can be arranged next to one another or one after the other in the longitudinal direction of the brush head body. In the latter case, a saw-tooth shape with several prominences which are arranged one after the other can be formed. The saw-tooth arrangement in particular runs parallel to the longitudinal direction.

Basically, it is also possible for the receiver to comprise the complementary positive-fit geometry to the saw-tooth shape of prominences which is described above, specifically a saw-tooth shape of deepenings, such as notches.

If the receiver as well as the connection section has a saw-tooth-shaped positive fit geometry or latching geometry, then the geometries in particular mesh into one another in the assembly position.

In particular, the prominences have a height of 0.5 mm to 2 mm, very particularly 0.8 mm to 1.5 mm with respect to the base surface.

The receiver of the connection interface can thus comprise at least one, in particular several deepenings, such as e.g. recesses. The at least one deepening in particular represents a positive-fit geometry, such as e.g. latching geometry. The at least one deepening in particular serves for creating a positive fit connection with the connection section of the main body, in particular a latching connection. The at least one deepening can have a triangular shape.

Thus, for example several deepenings can be shaped out in the receiver. These can be arranged next to one another or one after the other in the longitudinal direction of the brush head body. In the latter case, a saw-tooth shape with several deepenings which are arranged one after the other can be formed. The saw tooth arrangement in particular runs parallel to the longitudinal direction. The deepenings can be incorporated on the front side and/or the one or other or both longitudinal sides and/or on the rear side.

Furthermore, the prominence or deepening in the connection section or in the receiver can have a semicircular bead. The prominence or recess can be designed in a round manner around the longitudinal axis of the receiver or of the connection section.

The cross-sectional geometry of the receiver in particular is trapezoidal. The trapezium shape in particular is a quadrangle with two base sides of a different length which lie parallel to one another. The limbs which connect the base sides to one another in particular run towards one another to the shorter base side and in particular run apart to the longer base side. The longer base side in particular is directed to the front side. The shorter base side in particular is directed to the rear side. The shorter base side in particular is arranged in the longitudinal opening.

In particular, the shape cross section of the receiver is swallowtail-shaped.

According to a further embodiment variant, the final (base) shape cross section of the receiver is round, in particularly circularly round, i.e. cylinder-shaped.

According to a further embodiment variant, the final (base) shape cross section of the receiver is rectangular.

According to an embodiment variant, the receiver can be an open, such as semi-open in particular cylinder-shaped recess. The longitudinal opening is formed by the cross-sectionally open, such as semi-open recess.

The open, such as semi-open, in particular cylinder-shaped receiver in particular is open at the rear side. The open part of the brush head body as a result is arranged on the rear side of the toothbrush in the assembled state.

The base shape cross section of the receiver or of the connection section in particular can have a similarity with the cross section of the main body or of the grip part. This means that round cross sections of the main body or of the grip part coincide with round cross sections of the receiver or of the connection section, or that rectangular cross sections of the main body or of the grip part coincide with rectangular cross sections of the receiver or of the connection section and thus form a flat body geometry.

The longitudinal opening of the receiver on the rear side in particular is designed in a manner such that it forms a circle sector of 60° to 150°, in particular 750 and 120° with respect to the cylinder-shaped recess.

The receiver at its open end, in particular face end which in the assembled state faces the main body, in particular comprises a ring. In particular, the ring is part of the brush head body.

The ring forms an insert opening which in particular is closed over the whole periphery, for the connection section. The insert opening therefore serves for insertion into the receiver and, as yet explained further below, for the latching of the connection section in the receiver.

The ring effects a stabilisation and fixation of the connection section in the receiver.

The ring can comprise means for the separation of the brush head body and the connection section after their assembly.

In particular, prominences or projections with respect to the rear side opening are arranged in the lateral surface of the receiver, for creating a latching connection with the connection section.

According to a particular embodiment, the prominences or projections are present in the form of a saw tooth-shaped latching geometry. The geometry which is counter to the saw-tooth-shaped latching geometry is arranged on the connection section of the main body.

The connection section with this embodiment variant in particular is designed in a conically tapering manner towards its free end.

Furthermore, elliptical, triangular, quadrangular, polygonal (base) cross sections of the receiver are also conceivable.

The receiver can be designed in a conically widening manner towards the grip part of the main body.

The receiver and the connection section in particular are designed such that these form a positive fit on joining together.

The brush head body is attached to the connection section of the main body for creating the connection between the main body and the brush head body.

The brush head body in particular is stuck or pushed onto the connection section of the main body for creating the connection with the connection section. The stick-on or push-on movement in particular runs from the front face side in the longitudinal direction of the main body in the direction of the grip part. The thus created stick-on connection can be releasable or non-releasable.

If the brush head body forms a ring with an insert opening as described above, then the connection section is stuck or pushed with the front face side in front through the face-side insert opening on the brush head body into the open receiver of the brush head body.

"Releasable" in particular means that the two joining parts can be separated again without a destruction or damage to the joining parts and any present connection structure.

"Non-releasable" in particular means that the two joining parts can only be separated from one another again by way of destruction or damage of at least one of the joining parts or of any present connection structure.

The stick-on connection can also be characterised by a slight friction fit between the brush head body and the connection section. In particular, this permits a withdrawal of the brush head body from the main body again. According to this embodiment variant, in particular no latching connection is present.

The stick-on connection in particular is only a provisory fastening. In particular, the connection is releasable again by way of pulling off the brush head body.

The stick-on connection, as mentioned, can be combined with a latching or snap connection. Concerning a latching connection or snap connection, latching elements on a joining part releasably or non-releasably latch into deepenings on the other joining part.

The brush head body can also be connected to the main body or to the connection section by way of a screw connection. The two joining parts comprise a corresponding outer and inner thread.

The brush head body can also be fastened by way of fastening pins which e.g. are driven into the connection section.

The brush head body can also be connected to the main body or to the connection section by way of a bonding connection. The bonding connection can be combined with one of the aforementioned connection types.

One can envisage care bristles which are inserted into continuous bristle holes in the brush head body being bonded in the anchoring region between the main body or the connection section and the brush head body on connecting the brush head body to the connection section.

A permanent, i.e. non-releasable connection between the brush head body and the main body or connection section amongst other things is achieved in particular by a press-fit stemming of the brush head body to the connection section, such a press-fit stemming yet being described hereinafter. In particular, the press-fit stemming can be combined with one of the aforementioned connection types.

According to an alternative embodiment, the brush head body is formed directly on the main body or on the connection section.

The contents described above concerning the main body and the connection section and concerning the brush head body, such as the design, materials and geometries also apply to this aforementioned alternative embodiment with the exception of the disclosure concerning the connection of the two joining parts.

In particular, the brush head body is injected onto the main body or onto the connection section by way of an injection moulding method. This is effected e.g. by way of an insert moulding method or other methods which are described further above, according to which the main body or its connection section represents the insert.

For this, deepenings, e.g. in the form of through-holes and/or undercuts, via which the brush head body is (positively) held on the main body or connection section can be incorporated in the main body or the connection section.

The brush head body according to this embodiment can form bristle holes, into which the care bristles are introduced and fastened subsequently to the creation of the brush head body by way of an already described bristling method, such as e.g. anchor punching or PTt methods.

Basically, it is also possible to inject the care bristles together with the brush head body onto the main body or connection section in an injection moulding method (e.g. IMT method).

The bristling however in particular takes place after the creation of a non-releasable connection between the main body or the connection section and the brush head body.

The injecting of parts of the product directly onto the main body in a direct manner which is mentioned in the context of the brush head body, apart from the brush head body can also be used for other parts. The respective embodiments accordingly also apply to these parts. For example, the thumb grip or the thumb rest, the tongue cleaner, the projection from water absorption at the stem end can be injected on.

In particular, the brush head body is connected to the connection section in a non-releasable manner via one of the subsequent connection types or a combination of these:

non-positive (frictional) connection positive connection.

According to a particular embodiment for forming a non-releasable connection between the main body or the connection section and the brush head body, at least one engagement element of the brush head body engages into at least one engagement deepening on the connection section.

At least one engagement element on the brush head body is inserted into at least one engagement deepening on the connection section, for connecting the brush head body to the connection section.

Preferably, several engagement elements on the brush head body are inserted into an engagement deepening on the connection section, for connecting the brush head body to the connection section.

The at least one engagement element is or has been pressed into or pushed into in particular the engagement deepening.

The engagement deepening in particular can be created by way of the pressing-in. This means that the engagement deepening is formed on pressing the engagement element into the connection section.

The at least one engagement element in particular is formed from a surface section of the brush head body. The engagement element in particular is designed in a lobe-like manner.

The at least one engagement element which in particular is designed as a surface section projects into the engagement deepening for example at angle of more than 0° (angle degrees) and less than 90°, in particular from 45° to 75° and very particularly from 55° to 65° relative to a surface normal to the surface of the connection section, into which surface the engagement deepening is recessed. The angle can thus be e.g. 60°.

The at least one engagement element in particular projects into the engagement deepening at an angle of more than 10° and very particularly of more than 20° relative to the surface of the connection section, into which surface the engagement deepening is recessed.

The at least one engagement element in particular projects into the engagement deepening at an angle of less than 80°, and very particularly of less than 70° relative to the surface of the connection section, into which surface the engagement deepening is recessed.

The at least one engagement element which projects into the at least one engagement deepening in the connection section is directed with its free end in particular towards the brush head end or has at least one direction component which is directed towards the brush head end.

According to a particular connection between the brush head body and the connection section, the brush head body in particular is press-fit stemmed to the connection section.

In particular, the press-fit stemming is effected subsequently to the attachment, in particular sticking on or integral formation of the brush head body on or onto the connection section of the main body.

A press-fit stemming is to be understood as the creation of a non-positive and positive-fit connection between the brush head body and the connection section by way of an irreversible deformation of at least the connection section. The deformation which is achieved with the press-fit stemming is herein effected in a manner such that the brush head body and the connection section unreleasably connect to one another. The brush head body and the connection section in particular are wedged or meshed into one another The press-fit stemming in particular is effected by way of a press-fit stemming tool. In particular, this comprises a reshaping stamp. The press-fit stemming tool in particular is part of a press-fit stemming device.

At least one reshaping stamp is pressed or pushed into the brush head body for press-fit stemming the brush head body and the connection section. The reshaping stamp acts upon the at least one engagement element on the brush head body, by which means this is pressed or pushed into the at least one engagement deepening in the connection section, wherein the reshaping stamp in particular simultaneously shapes the engagement recess.

The at least one engagement element which in particular is designed as a surface section in particular is partially released out of the brush head body by way of the reshaping punch.

The engagement element which is partially released out of the brush head body in particular is pivoted into the engagement deepening by way of the reshaping stamp.

"Partially released out" means that the engagement element, e.g. a surface section is not completely separated from the brush head body, but remains connected to this, e.g. via a connection zone.

Releasing out means that the engagement element is partially separated from or out of the engagement element. This can be along a weakening zone or weakening line. In this case, the engagement element is pressed out of the brush head body in particular in a partial manner by way of the reshaping stamp.

Releasing out can also mean that the engagement element is already partially separated from the brush head body, e.g. along a partition line, and on releasing out of the brush head body is bent out or pivoted out. Accordingly, the reshaping stamp does not partially separate the engagement element out of the brush head body but merely bends or pivots this out of the brush head body.

The engagement deepening in the connection section in particular is produced, in particular pressed in, by the reshaping stamp. The engagement deepening in particular is simultaneously produced with the pressing of the engagement element into the engagement deepening.

In particular, the main body is compacted in the region of the engagement deepening which is pressed into a wood material by the reshaping stamp. The pressing-in of the engagement deepening by the reshaping stamp in particular entails a structural breakage in the region of the engagement deepening.

The reshaping stamp on press-fit stemming can act upon the engagement element e.g. with a weight of 600 kg.

Basically, the reshaping stamp on press-fit stemming is pressed until a movement into the connection section is no longer effected. This means that the limitation is not effected by a defined press-fit stemming path, but by the press-fit stemming weight or pressing pressure.

On press-fit stemming, the reshaping stamp moves into the brush head body or into the connection section in particular in a straight line. In particular, a sliding or rolling past the surface does not take place.

In particular, the engagement recess is a notch. In particular a notch is a pointedly tapering or wedge-like incision or engagement deepening.

In particular, the notch is formed by the reshaping stamp. The mentioned procedure is denoted as notching.

The reshaping stamp in particular is designed as a notching stamp. For this, the reshaping stamp in particular has a wedge-like active section. The wedge-like active section, in particular in an indirect manner via the brush head body, is pressed into the surface of the connection section, so that a notch arises in the connection section.

The notch comprises a first notch surface which in particular runs parallel to a surface normal to the surface of the connection section, into which surface the engagement deepening is recessed.

The notch further comprises a second notch surface which is inclined relative to the mentioned surface normals. In particular, the inclination corresponds to the inclination which is mentioned further above and with which the engagement element projects into the engagement deepening. The engagement element in particular bears or lies on the second inclined engagement surface.

The at least one engagement element which engages into the at least one engagement deepening of the connection section counteracts a pull-out force which acts upon the brush head body in the direction of the brush head end.

The engagement element which is released out of the brush head body, as mentioned can be designed as a surface section or in a lobe-like manner and comprise a free end section with a front end-face as well as a connection zone which is arranged lying opposite the free end section. Furthermore, the surface section or the lobe-like engagement section can comprise lateral end-faces.

According to an embodiment, with regard to the orientation of the press-fit stemming, the connection zone of the engagement element in a plan view of the toothbrush can be arranged in front of the free end section of the engagement element considered in the direction of the brush head end. On applying a pull-out force upon the brush head body, a pressure acts upon the front end-face of the free end section of the press-fit stemmed engagement element. This is the preferably applied orientation of the press-fit stemming.

According to further embodiment, with regard to the orientation of the press-fit stemming, the connection zone of the engagement element in a plan view of the toothbrush can be arranged after the free end section of the engagement element considered in the direction of the brush head end. On applying a pull-out force upon the brush head body, a pressure acts upon the inclined surface of the press-fit stemmed engagement element, with which surface this element lies on the inclined notch surface.

According to a further embodiment, with regard to the orientation of the press-fit stemming, the connection zone in a plan view of the toothbrush can be arranged next to free end section considered in the direction of the brush head end. On applying a pull-out force upon the brush head body, a pressure acts upon the lateral end-face of the press-fit stemmed engagement element.

The press-fit stemming device can comprise individual or several reshaping stamps.

Thus, several press-fit stemmings can be simultaneously carried out by several reshaping stamps. It is also possible to carry out one or more press-fit stemmings in a temporally consecutive manner, e.g. by an individual or several reshaping stamps.

The brush head body can be press-fit stemmed to the main body or to the connection section via a single press-fit stemming by way of a single engagement element. It is also possible for the brush head body to be press-fit stemmed to the main body or the connections section via several press-fit stemmings by way of several engagement elements. This improves the retention of the brush head body on the main body or connection section.

A press-fit stemming in only those surface sections of the brush head body, in which this lies above the connection section of the main body is basically possible.

The press-fit stemming is thus effected in particular in a middle region of the brush head body. In particular, no press-fit stemming occurs along the peripheral edge sections.

E.g. 5 to 25, in particular 10 to 20 press-fit stemmings are envisaged on the brush head body.

The orientation of the press-fit stemming, as is explained above by way of the three embodiments, can be the same for all press-fit stemmings or can be different.

The above embodiments with regard to the brush head body and its connection or press-fit stemming to the connection section of the main body also apply to the subsequently described embodiment variants.

With regard to the formation of the (provisory) connection between the brush head body and the connection section, the above statements likewise apply to the subsequently described embodiment variants.

Preferably, the changes which are created by the press-fit stemming on the brush head body are hidden from the user i.e. cannot be externally seen or felt.

The care bristles can be attached onto the brush head body in different manners.

According to a particular embodiment, the brush head body forms at least one bristle hole which receives at least one care bristle or a bristle bundle.

The at least one bristle hole in particular is designed as a blind hole and comprises a bristle hole base.

The at least one engagement element is then formed by at least one surface section of the bristle hole base or by the bristle holes bases.

According to the present embodiment variant, the at least one reshaping stamp is inserted or driven into the at least one bristle hole.

The reshaping stamp in particular has a smaller diameter than the bristle hole. Thus, the play between the reshaping stamp and the bristle hole can be 0.05 mm-0.5 mm and in particular 0.08 mm-0.2 mm. Very particularly the play is 0.1 mm.

At least one surface section of the bristles hole base or of the bristle holes bases, said section forming the engagement element, is pressed or pushed into the engagement deepening in the connection section by way of the reshaping punch.

Hereby, the bristle hole base or a part-surface of this in particular is broken out of the bristle holes by way of the reshaping stamp.

According to a present embodiment variant, the engagement deepening in particular simultaneously with the releasing of the surface section out of the brush head body is formed by the reshaping punch. For this, the reshaping punch which is driven into the bristle hole is pressed together with the released-out surface section into the connection section.

As mentioned, the surface section corresponds to the bristle hole base or a part-surface of this.

In particular, the surface section is designed in a lobe-like manner.

The surface section or the bristle hole base in particular is partially released or pressed out of the bristle hole body by way of the reshaping stamp and in particular remains connected to the brush head body via a connection zone.

After the press-fit stemming, the reshaping punch is retracted again out of the bristle hole.

One can envisage a separating slot being provided, via which the surface section can be released out of the brush head body and be pressed into the engagement deepening.

In particular, the separating slot surrounds the surface section which is to be released out. The separating slot can be designed e.g. in a C-shaped manner. In particular, the connection zone is formed between the two slot ends, via which connection zone the surface section which is released out of the brush head body remains connected to the brush head body.

In particular, the separating slot is arranged in the bristle hole base. In this embodiment, the surface section which is to be released out corresponds to the bristle hole base or a part-surface of this.

In particular, the separating slot can run along the transition between the bristle hole base and the bristle hole wall.

In particular, the separating slot is partly circumferential. Thus, the separating slot can extend over a peripheral angle of 75° (angle degrees) to 240°, in particular from 90° to 180°.

The slot width in particular is as minimal as possible, since the separating slot merely serves for separating the surface section or the bristle hole base from the brush head body.

The separating slot can be designed in a continuous manner, i.e. lead completely through the surface section or the bristle hole base. The surface section or the bristle hole base can be partially released out of the brush head body via the separating slot and pressed into the engagement deepening.

The separating slot can also be designed in a non-continuous manner, i.e. not lead completely through the surface section of the bristle hole base. In this case, the separating slot forms a weakening zone (desired breaking location), via which the surface section or the bristle hole base can be partially released out of the brush head body and pressed into the engagement deepening. The separating slot can be designed e.g. a slot groove.

The above disclosure in the context of the separating slot also relates to embodiments according to which the engagement section is not formed by the bristle hole base or a part-surface thereof.

A press-fit stemming in particular takes place merely via such bristle holes, whose bristle hole base is adjacent or which to say abuts a connection section or bears on this.

The brush head body can also comprise bristle holes, whose bristle hole base is not adjacent to the connection section and which are accordingly not suitable for a press-fit stemming.

The bristle hole base of the bristle holes, via which the brush head body is press-fit stemmed to the connection section, is likewise designed in a plane manner. The mentioned bristle hole base before the press-fit stemming in particular forms a right angle with the bristle hole wall which connects onto this.

Subsequently to the connecting, in particular to the press-fit stemming of the brush head body to the connection section, the care bristles or the bristle bundles are inserted into the bristle holes and are fastened, in particular anchored in these.

For this, in particular the anchor punching method which is already described above is applied.

The two method steps of press-fit stemming and bristling in particular can be coordinated with one another via a control device. This means that the press-fit stemming tool and the bristling tool are in particular coordinated with one another with regard to control technology.

According to a further development, the press-fit stemming device and the bristling device with the associated tools are part of a common device or machine. This means that the bristling and the press-fit stemming take place in a common device. The press-fit stemming and the bristling in particular take place at a constant, i.e. unchanged position of the brush head body. For this, the brush head body and/or the main body in particular are clamped in a holder.

By way of bringing the care bristles or the bristle bundles into the bristle holes and fastening these in the bristle holes, in particular by way of anchor punching the care bristles, i.e. by way of bringing the anchor element and the care bristles into the bristle hole, the engagement element is secured against moving back out of the engagement deepening.

Depending on the bristle type, the post-machining of the care bristles, such as profiling (cutting) and rounding is subsequent to the fastening of the bristles.

According to this embodiment, the brush head of the toothbrush is formed in particular by the brush head body, the care bristles which are arranged on this as well as the connection section of the main body or a part thereof.

According to a further embodiment variant, the care bristles are not directly brought into existing bristle holes on the head part of the main body or on a brush head body e.g. by way of an anchor punching method.

In contrast, the care bristles are attached onto a bristle carrier element which is connected to a brush head body.

The brush head body with regard to the design of the connection interface can correspond to the brush head body which is described further above.

According to this embodiment variant, for fastening the care bristles, in particular an anchor-free method which is already described above, such as AFT (anchor free tufting), PTt, AMR or IMPT is applied for fastening the care bristles. For this, the individual care bristles or the individual bristle bundles are attached to the bristle carrier element in an anchor-free manner.

The care bristles or the bristle bundles in particular with their bristle ends or end sections which lies opposite the free used ends are fastened to the bristle carrier element via a material connection, in particular by way of plastic welding or melting of the bristle ends or the end sections, or in an injection moulding method by way of peripherally injecting the bristle ends.

Regarding further details of the anchor-free bristling method, the respective disclosure concerning the anchor-free bristling methods further above is referred to.

Concerning an anchor-free method, no anchor elements which as a rule are of metal are applied. The anchor-free method consequently permits the manufacture of a metal-free toothbrush. If the brush head body and the bristles furthermore consist of a sustainable plastic, preferably of a biologically degradable plastic (see also the statements concerning the bio-plastic) then one obtains a completely biologically degradable toothbrush.

Furthermore, a completely biologically degradable toothbrush can also be achieved by way of anchor elements of a degradable plastic also being used, apart from biologically degradable bristles, in toothbrushes which are bristled by way of the anchor punching method.

According to this further embodiment variant, the brush head body forms a receiver for a bristle carrier element, on which the care bristles are arranged.

The bristle carrier element which comprises the care bristles is connected to the brush head body. For this, the bristle carrier element in particular is inserted into the receiver on the brush head body.

In particular, the bristle carrier element is a bristle carrier platelet.

In particular, the bristle carrier element is likewise of plastic. The bristle carrier element can be of the same plastic as the brush head body. The bristle carrier element however can also consist of a different plastic than the brush head body.

The bristle carrier element has a front side which in the assembled state is directed to the front side of the toothbrush, and from which the care bristles project. The bristle carrier element further comprises a rear side which in the assembled state is directed to the rear side of the toothbrush, and via which the bristle carrier element is connected to the toothbrush.

The bristle carrier element on assembly on the brush head body in particular is already equipped with care bristles.

The brush head of the toothbrush in particular is formed by the brush head body and the bristle carrier element which is arranged on this and which comprises the care bristles, as well as by the connection section of the main body or a part thereof.

The brush head body in particular comprises no bristle holes. Instead of a bristle hole field, the brush head body at this location or on its front side in particular comprises the receiver for the bristle carrier element.

The receiver can comprise a receiver deepening on the front side of the brush head body, said receiver deepening being surrounded by a peripheral edge.

The receiver in particular forms a receiver base. This can be plane. The engagement elements which are described above are now released out of the receiver base and pressed into the engagement deepening in the connection section by way of the stamp.

The procedure of press-fit stemming has already been extensively described above. Respective statements also apply to the present embodiment variant.

After connecting or press-fit stemming the brush head body to the connection section, the bristle carrier element is introduced into the receiver and is connected to the brush head body. The bristle carrier element herein covers the receiver base with engagement elements which are released out. The bristle carer element herein in particular lies on the receiver base.

According to a further development, the bristle carrier element comprises securing members which in particular project from the bristle carrier element and in the assembled state are directed to the receiver base. The securing members in particular form a geometry counter to the indentations in the receiver base which have arisen due to the press-fit stemming. In the assembled state of the bristle carrier element, the securing members engage into the mentioned indentations and secure the press-fit stemming from a moving-back of the engagement element out of the engagement deepening.

The bristle carrier element, as already mentioned, is connected to the brush head body by way of a material connection, in particular by way of welding, such as ultrasound welding.

According to a modification of the aforementioned embodiment variant, the securing members are part of a separate securing element, such as securing platelet. The above disclosure concerning the securing members otherwise also applies to the present modification.

For manufacturing the brush head, after the press-fit stemming of the brush head body, firstly the securing element is inserted into the receiver and is connected to the brush head body or is only introduced into this. The securing members of the securing element, as already described in detail further above, engage into the indentations on the receiver base and secure the engagement elements from moving back out of the engagement deepenings.

In a subsequent step, the bristle carrier element is positioned or applied onto or over the securing element and is connected to the unit consisting of the brush head body and securing element. The bristle carrier element herein secures the securing element so that this retains its position and is positioned in a positionally accurate manner.

In particular, the securing element is of plastic. The securing element can be manufactured from the same plastic as the brush head body. The securing element however can also be of a different plastic than that of the brush head body.

The securing element can be of the same plastic as the bristle carrier element. The securing element however can also be of a different plastic than that of the bristle carrier element. The securing element can also be of wood.

The bristle carrier element in particular is connected to the brush head body and/or to the securing element by way of a material-fit connection, such as plastic welding or melt-connecting or bonding.

Basically, other holding or insert geometries can also be provided for bristling the brush head carrier, and these for example permit the use of AFT method or PTt method for bristling.

Subsequently to the creation of the brush head, the toothbrushes can fundamentally yet also be subjected to further post-machining steps.

At least one post-machining step or all post-machining steps can be effected for example in the punching device given an anchor punching method.

The post-machining steps can be:

depositing a characterisation or inscription as already described further above;

depositing a surface structure or structuring as already described further above.

Specific examples for the aforementioned post-machining steps are e.g.:

depositing a marking, such as LOT code (production code for tracing);

depositing a code, for example a QR code, which is linked e.g. to a home page, on which product specifications can be retrieved or on which for example details concerning the disassembly, disposal and/or recycling process are explained;

depositing a decoration such as trademark logo;

depositing structures in hand grip zone, such as a thumb rest.

The aforementioned post-machining steps can be effected e.g. by way of lasers, burning in, milling, laser machining, embossing or printing.

A further post-machining step can comprise the removal of dirt, such as dust, after the creation of the brush head or after the bristling, e.g. in the anchor punching method. The post-machining step can be a blowing-away of sucking-away.

The toothbrush in particular is packaged subsequently to its completion in manufacture. For ecological reasons, one desires to do without the packaging of the toothbrushes according to the invention in blister packages of plastic which is common today.

For ecological reasons, for example a cardboard packaging is used. The cardboard can be provided with a barrier layer which for the protection of the main body of wood in particular prevents the passage of moisture.

The toothbrush can also be packaged in a tube or tubelet, e.g. of wood, such as bamboo.

Furthermore, the brush head can also be packaged in wax. The grip part of the main body can e.g. remain unpackaged. The wax can be removed, e.g. washed out before use of the toothbrush.

The toothbrush can be provided with further elements such as toothpastes or head casing on packaging.

The head casings can be shaped from wood.

The toothbrush according to the invention can have a length of 100 mm-240 mm, in particular of 140 mm-200 mm.

The toothbrush according to the invention can have a width of 10 mm-20 mm, in particular of 12 mm-18 mm. The width can vary over the longitudinal extension.

The toothbrush according to the invention can have a thickness or height of 4 mm-15 mm, in particular of 5 mm-10 mm. The thickness or height can be constant or vary over the longitudinal or transverse extension.

The toothbrush according to the invention, in particular its main body is designed such that these fulfil the usual tests for suitability as a toothbrush. Thus the toothbrush according to the invention is accordingly chemically resistant with regard the influence of toothpaste and water.

The neck region fulfils the pendulum impact test and accordingly has a sufficient stability.

The toothbrush according to the invention furthermore fulfils the alternating bending test.

According to a particular embodiment variant, the toothbrush comprises an exchangeable head. The exchangeable head which e.g. forms the brush head can be connected to the main body via releasable connection. The main body for this can form a connection section which is arranged on the brush head side.

Preferably, the connection section which is arranged on the brush head side is manufactured by way of the already described material-removing methods. The positive-fit geometries which are provided on the connection section, such as latching geometries, can be incorporated in a separate working step. This is preferably effected before the assembly of the exchangeable head. This has the advantage that the positive-fit geometry or latching geometry can be calibrated independently of the storage conditions of the main body. The positive-fit geometry such as latching geometry can be incorporated on the connection section by way of the already described methods e.g. by way of milling, drilling, pressing, deformation.

Furthermore, other materials e.g. plastic, metal, ceramic etc. which as positive-fit geometry or latching geometry interact with the exchangeable head can be used on the connection section. The positive-fit geometry, such as latching geometry which is incorporated on the exchangeable head is preferably formed by way of injection moulding. A mechanical machining in particular is not envisaged.

The brush head body with regard to the bristling in particular is formed according to one of the bristling methods which are described above.

The exchangeable head system permits e.g. the application of a high-quality reusable grip part. Accordingly, the grip part can also be designed in a high-quality and more permanent manner.

The main body according to this embodiment variant can be e.g. of wood, metal, stone, ceramic, glass, mother of pearl, or also plastic or of combinations of these materials.

The exchangeable head can be e.g. of plastic. The exchangeable head in particular can be manufactured of a plastic from renewable raw materials. The exchangeable head can be manufactured of several plastics and/or plastics from renewable raw materials.

As explained in detail above, the brush head body in particular consists of a plastic wood and the main body in particular of wood. The connection between the main body and the exchangeable head is therefore in particular wood onto plastic.

One can also envisage the brush head body consisting of wood and the main body likewise consisting of wood. The connection between the main body and the brush head body is therefore wood to wood. The brush head body however can also be of a different wood than the main body. The brush head body in this case preferably consists of a harder wood than the main body.

The exchangeable head in particular can be designed such that the main body is provided with an element of plastic which is unreleasably anchored or press-fit stemmed onto the main body and comprises the exchange mechanism or forms an interface of the exchange mechanism. Herewith, the exchangeable head of plastic can be stuck onto the exchangeable mechanism of plastic.

The exchangeable head in particular can be composed of several parts. The different parts can consist of different materials and be fashioned in different colours. One part can comprise the outer geometry, whilst the other part comprises the connection section.

It is also conceivable for an interdental brush analogously to the toothbrush to be designed as an exchangeable head system, with a main body which forms a grip part, and with a brush head which is exchangeable.

The toothbrush can comprise means which permit the toothbrush to be divided up or separated into the individual material constituents such as wood, plastic and metal on reaching its expiry duration, for recycling purposes, so that the individual materials of the toothbrush can be separately disposed of.

In particular, the aim is to divide up the toothbrush into individual parts, of which in particular at least one part consists of a single material.

Thus, one can envisage only individual parts consisting of a single material, e.g. of wood, and other parts being mixed parts of several materials, such as wood, plastic, ceramic, glass or metal.

Thus, in particular one can envisage the creation of pure wood parts, e.g. the grip part, whilst other parts, e.g. brush head are mixed parts of e.g. wood, plastic, metal ceramic, glass or plastic and metal.

Concerning a toothbrush with a head part of wood, concerning which the care bristles are punched in bristle holes in the head part, for example the brush head with the care bristles which are e.g. of plastic can be separated from the grip part. This can be effected of example via a separation location in the neck section.

Concerning a toothbrush with a brush head body of plastic, one can envisage the brush head body being released from the connection section of wood. This can be effected e.g. in a destruction-free manner or by way of destroying at least one of the connection partners.

One can also envisage the brush head body together with the connection section or a part thereof being separated from the grip part. For this, a separating location can be provided in the connection section or in the neck section of the main body.

The brush head body can comprise a separating aid, such as a detachment element or deepening, which simplifies or permits the separation of the brush head body from the main body by hand or by way of a simply available tool.

The separating aid can be designed to permit or simplify the separation or withdrawal of the brush head body from the connection section. The separating aid can also be designed to permit or simplify the separation of the brush head body together with the connection section or a part thereof from the main body.

The separating aid, such as a detachment element can permit or simplify e.g. the withdrawal of the brush head body from the main body or from the connection section by hand.

Detachment elements wherein these can be detached or released from the (remaining) brush head body. This can be effected e.g. by way of pulling or tearing away.

Detachment elements can be e.g. tabs or withdrawal tabs or strips. In particular, tabs wherein these are orientated parallel to the longitudinal axis of the toothbrush.

The detachment element in particular forms a wall section of the receiver.

The detachment elements in particular wherein these at least partly expose the receiver in the brush head body on detachment and thus permit a withdrawal of the brush head body from the connection section. The detachment or withdrawal of the detachment elements can be effected manually, i.e. by hand or with the assistance of a tool.

The detachment elements can be designed such that these (for the purpose of separating the brush head body from the connection section) can be completely detached i.e. separated from the (remaining) brush head body.

One can also envisage the detachment elements being pivotable relative to the remaining brush head body between an assembly position and a separating position via a hinge, such as a film hinge.

In particular, the detachment elements are releasable out of the brush head body (no complete separation) or can be separated from this (complete separation), along linear weakening zones, such as thin locations, perforations or notches. The weakening zone in particular is designed as a predetermined breaking location.

The detachment elements can be connected to the (remaining) main body by way of a positive connection, a frictional connection or a combination thereof. The positive connection in particular can be a snap-connection. With regard to the snap connection, at least one of the joining parts elastically deforms and subsequently hooks with the other joining part in a releasable manner.

A positive connection, friction connection or combination thereof are particularly applied if the brush head body is to be re-usable, i.e. is to be able to be connected to the main body again. For this reason it is advantageous if the detachment element can be brought into an initial assembly position on the brush head body.

The detachment elements can comprise a positive-fit geometry, such as latching geometry on their side which faces the connection section. This has already been described further above. On detaching the separating aid, the positive fit between the detachment element and the positive-fit geometry of the connection section is lifted.

By way of this, the positive fit between the brush head body and the connection section is at least partly lifted, which permits the separation or withdrawal of the brush head body from the connection section.

A tab which is described above can be detached for example along the longitudinal axis of the toothbrush, wherein the latching geometry is also torn.

In particular, the separating aids can be injected together with the brush head body onto the main body.

The separating aid can consist at least partly of a different material than the brush head body. The separating aid and the brush head body can be injected on the main body in a multi-component injection moulding method.

The aforementioned separating location, e.g. in the neck section of the main body can be characterised by a weakening zone or predetermined breaking location. The weakening zone or the predetermined breakage location can comprise e.g. one or more notches.

The separating location can comprise a characterisation which displays the separating location to the user.

The toothbrush can comprise a characterisation which displays the location at which the separating tool is to be applied.

The separation of the toothbrush into different parts, as already mentioned above, can be effected with the help of a separating tool. Such a separating tool can be e.g. a household tool, such as a bottle opener, a side cutter, a pruning scissors, a garden scissors, a saw or an axe.

The brush head can thus be moved into a bow opening of a bottle opener. The brush head can be separated from the grip part by way of a tilt movement which is carried out by the bottle opener. The brush head body can comprise structures or separating aids, such as deepenings, for applying a bottle opener on the brush head body.

A pipe or tubelet, into which the brush head is inserted and by way of which the brush head is separated from the grip part by way of leverage can also serve as a separating tool.

The separation can also be effected by way of a premanufactured separating function. For example a weakening zone such as perforation can be incorporated on the brush head body and this in the assembled state holds together the brush head body. If the brush head body is separated along the weakening zone, then the brush head body can be detached from the main body. The plastic parts preferably remain on one piece also after the separation.

The weakening zone can be designed in a linear manner. Thus e.g. a separating strip which comprises two weakening zones can be formed. Thus, the separating strip in particular can comprise two weakening zones, in particular linear weakening zones, which in particular run next to one another, in particular parallel next to one another and distanced to one another. The separating strip can thus be pulled off or detached along the weakening zones. The separating strips herein correspond to a detachment element which is discussed further above.

After the single use of the separating function, the brush head body in particular can no longer be fixed to the main body. I.e. positive connection elements between the main body and the brush head body no longer fulfil their purpose or only to a very restricted extent due to the use of the separating function. By way of this, a continued use of a separated-away brush head body can be prevented.

A further possibility for creating separating possibility lies in creating a separable seal which after separating open permits the separation of wood and plastic. The separable seal can also be designed in the manner of the detachment element which has been described above.

With regard to the embodiment which is described further above, comprising a brush head body with a ring in the end region of the receiver, said ring forming an insert opening, the ring can comprise a weakening zone or separating location, such a slot, for the purpose of separating the brush head body from the connection section.

The weakening zone or separating location permits the opening of the ring. In particular this is effected by way of a ring section at the weakening zone or separating location being gripped and as a tab being pulled away from the weakening zone or separating location. The ring is therefore opened by way of pulling away the ring section.

According to a further development of this embodiment, a strip-like part of the brush head body which is directed to the front side and which comprise the latching geometry, in particular a saw-tooth-shaped latching geometry is also torn away together with the pulled-away ring section. After tearing away the ring section with the strip-like part which in particular form a single tear-off part, the brush head body can be separated from the connection section and thus from the main body.

For this, the strip-like part is delineated from the remaining brush head body by way of at least one linear weakening zone such as perforations. Thus, the strip-like part can thus be delimited with regard to the remaining brush head body by way of two linear weakening zones which run next to one another and between which the latching geometry is arranged. The weakening zone on assembly also permits a certain resilience of the spring geometry, which simplifies the manufacture of the latching connection.

The separating possible of the brush head body and the main body which has been explained above can of course also be realised if the bush head body is injected onto the main body. Herein, the elements for separation, such as e.g. weakening zones or separating locations must be shaped out on injection moulding.

The weakening zone or the separating location can consist at least partly of a material which is different to the brush head body. The separating aid and the brush head body can be injected on the main body in a multi-component injection moulding method.

Analogously to the brush head body, the aforementioned separating possibility can also be realised for the thumb grip or the thumb rest and the further mentioned injected-on elements.

If the toothbrush comprises a thumb grip or a thumb rest, then in particular the thumb grip or the thumb rest which e.g. consist of plastic can also be separated from the grip part.

The separating procedure can also be effected in a multi-stage manner, wherein a tool, such as bottle opener can also be used in one of the separating stages.

The design variants which are disclosed in this description are exemplary. Within the scope of the invention, the individual manifestations and elements of the disclosed design variants can be combined with other design variants without departing from the scope of the disclosure of the present invention.

In particular, the toothbrush is a hand toothbrush. In particular the toothbrush is not electrically operated. The toothbrush can be designed as a disposable toothbrush. The toothbrush can be designed as a reusable toothbrush. As mentioned, the toothbrush also be designed as an exchangeable head toothbrush. Furthermore, it can be designed as a single-tuft brush.

The toothbrush can be combined with further function elements such as toothpicks tongue cleaners, interdental cleaners, etc. For example, a toothpick can be realised at the rear face side.

The concept according to the invention, being a main body of wood with connection sections as well as function body with a function element, in particular brush head body which is fastened to a connection section of the main body or stuck onto this and is press-fit stemmed with this, can also be used with the following products:

Oral hygiene:
- tongue cleaner
- interdental brush
- flosser
- interdental cleaner/toothpick Cosmetics:
- facial brush
- applicators
- massage device Household:
- dishes brush
- broom
- floor wiper General Body Care:
- hair brush
- wet shaving The function head body, e.g. of a tongue cleaner, in particular is manufactured in an injection moulding method.

Concerning a wet shaver, the function body is a blade head. The wet shaver in particular is an exchangeable head system, according to which the blade head can be releasably fastened to the main body which comprises the grip part and accordingly be exchanged.

The concept according to the invention can also be used with certain models of electrically operated toothbrushes. This concept can preferably be used with attachment brushes for sonic toothbrushes or vibration toothbrushes.

The attachment brush thus analogously to manual, i.e. non-electrical toothbrushes comprises a main body, in particular of wood, as well as a brush head as a function part. That which has been stated concerning manual toothbrushes applies accordingly.

Instead of a grip part, the main body here however forms an attachment part.

According to an embodiment variant, the main body forms a head part, in particular of wood, which analogously to the manual toothbrush is bristled with care bristles.

According to a further embodiment variant, the attachment brush analogously to the manual toothbrush comprises a brush head body of plastic. In particular, this can be stuck onto the main body. The brush head body can also be injected onto the main body. That which has been stated above concerning manual toothbrushes also applies to the design of the attachment connection and the injecting.

The mentioned attachment brushes are stuck onto the housing or onto a drive pin of the hand part which projects out of the housing. For this reason, the interface on the attachment brush is designed in the form of an element of plastic, in order to ensure a good connection. This element can be injected onto the main body of wood or also be assembled onto this, e.g. via a positive connection.

Corresponding embodiments in the context of the manuals toothbrush which is described above with regard to the injecting, assembly (attachment) and also the separation also apply to the attachment brush.

The advantages of the use of wood in the mentioned attachment brush of electrical brushes has the advantage that wood has certain damping characteristics, so that undesired vibrations are transmitted to a lesser extent.

With regard to sonic toothbrushes which carry out an effective to-and-fro movement, the drive pin is operated at a frequency of 200 HZ to 320 Hz, preferably of 240 Hz to 280 Hz. The deflection angle of the drive pin per side from the zero position in particular lies in a range of 2.5° to 9°, preferably 4° to 7°.

Vibration toothbrushes are provided with a motor with a rotation speed of 3000 r.p.m to 16000 r.p.m, particularly preferably 13500 r.p.m.

Analogously to the attachment brush for electrical toothbrushes, of course according to the invention an attachment brush for an electrically operated, in particular vibrating facial brush can also be realised.

It is possible for other brush products to be bristled with other bristling methods. Thus for example a bristling method, according to which the filaments which form the care bristles are rotated into a wire and are thus fastened to the wire, is also known.

According to this bristling method, the filaments are fed from a roll, wherein several filament strands can be wound on a roll. Each filament in the brush herein corresponds to a filament strand.

For feeding the bristling machine, in particular several rolls are biased.

The filaments are spread out to that width, at which they are also inserted into the brush.

The filaments are pulled forwards so that they are exposed for the next working step, i.e. that a wire can be fed over the spreaded filaments.

The wire is fed from a roll onto the machine, i.e. is wound off, and is introduced into the process.

The wire is cut to a length which is larger than the wound-off length of the rotated-in brush. The final cutting to length is effected after the rotating in.

The wire is bent into a U. The open side is subsequently pushed over the filaments (threaded in the bristles). The filament and the bent wire are led together in this manner. Hereby, the bent wire is held on the bending locations (base of the U).

The open wire end or the wire limbs are now clamped, so that the filaments are clamped between the wire limbs and are held by the wire.

The filaments are cut to a length which is larger than their final length in the brush. The excess length ensures the cutting to length of the rotated-in filaments of the brush into their correct final length.

The wire is now rotated which is to say the wire limbs are rotated to one another. In this manner, the filaments are rotated in and clamped, i.e. fixed between the wire.

After the filaments are fixed in the wire, they are cut (profiled) to the correct final length.

Excess (rotated) wire is furthermore cut off.

A rotated-in brush which is manufactured in this manner can be integrated in a main body of wood. With regard to the manufacture, the respective aforementioned embodiments in the context of the toothbrush are referred to.

The brush can be bonded into a main body. The brush can be clamped into a main body, for example if the main body is of two parts and is put together such that the brush lies therebetween or if the main body comprises a receiver slot which runs in the longitudinal direction of the main body and is with e.g. resilient limbs.

According to the present disclosure, certain parts of the product according to the invention such as toothbrush can be of plastic.

The manufacture of components of plastic, such as e.g. the brush head body, bristle carrier element or securing element in particular is effected by way of an injection moulding method.

The injection moulding method can basically be a hot channel method or a cold channel method.

If several components are processed in the injection moulding method, then these can be manufactured by way of a co-injection method or a multi-component injection moulding method.

The plastic which in particular is capable of being injection moulded can be a hard component or a soft component depending on the application purpose.

As a hard component which in particular is capable of being injection moulded, for example one of the following plastic components can be used:

- styrene polymerisate, such a styrene acrylonitrile (SAN), polystyrene (PS), acrylonitrile butadiene styrene (ABS), styrene methyl methacrylate (SMMA) or styrene butadiene (S B);
- polyolefins, such as polypropylene (P) or polyethylene (PE) for example also in the forms of high density polyethylene (HDPE) or low density polyethylene (LDPE);
- polyesters, such as polyethylene terephthalate (PET) in the form of acid-modified polyethylene terephthalate (PETA) or glycol-modified polyethylene terephthalate (PETG), polybutylene terephthalate (PBT), acid-modified polycyclohexylene dimethylene terephthalate (PCT-A) or glycol-modified polycyclohexylene dimethylene terephthalate (PCT-G);
- cellulose derivatives such as cellulose acetate (CA), cellulose acetobutyrate (CAB), cellulose propionate (CP), cellulose acetate phthalate (CAP) or cellulose butyrate (CB);
- polyamides (PA) such a PA 6.6, PA 6.10 or PA 6.12;
- polymethyl methacrylate (PMMA);
- polycarbonate (PC);
- polyoxymethylene (POM);
- polyvinyl chloride (PVC) or a
- polyurethane (PUR).

Polyethylene (PE) and polyurethane (PUR) can be used in a suitable modification as a hard components as well as a soft component.

Polypropylene (PP) is preferably used as a hard component.

The modulus of elasticity of the hard component, in particular of polypropylene (PP) in particular lies between 1000-2400 N/mm$^2$, very particularly between 1300-1800 N/mm$^2$.

Hard components in particular are applied in a stable, structure-supporting elements, for example brush head body, bristle carrier element or securing element.

If several hard components are applied in a two-component or multi-component injection moulding method or if components are connected by way of ultrasound welding, then the applied hard components in particular form a material fit amongst one another.

Alternatively, several hard components which assume no material fit in the two-component or multi-component injecting moulding can be used. Concerning such pairings, a positive fit is envisaged (undercuts and/or openings and/or partial and/or complete peripheral injections, etc.).

The second injected hard component on cooling shrinks onto the first injected hard component and then forms a shrink connection.

Examples for possible hard component pairings which assume no material fit are polypropylene—polyester, polypropylene—styrene-acrylonitrile.

One of the following plastics components can be used as a soft component which in particular is capable of being injection moulded:

- thermoplastic styrene elastomers (TPE-S) such as styrene ethylene butylene styrene copolymer (SEBS) or styrene butadiene styrene copolymer (SBS)
- thermoplastic polyurethane elastomers (TPE-U)
- thermoplastic polyamide elastomers (TPE-A)
- thermoplastic polyolefin elastomers (TPE-O)
- thermoplastic polyester elastomers (TPE-E)
- silicones.

In a corresponding modification, polyethylene (PE) as well as polyurethane (PUR) can be used as a soft component.

Preferred soft components are thermoplastic elastomers (TPE), such as TPE-S.

The soft components, in particular the thermoplastic elastomer in particular has a shore A hardness of <90 (less than 90), very particularly of <50, or of <30.

For example, soft-elastic oral hygiene members such as cleaning and massage elements or hand grip zones such as thumb rest can be of a soft component.

Soft component elements with the hard components in particular form a material fit in the two-component or multi-component injection method by way of over-injecting.

Since the product such as toothbrush is to be manufactured as much as possible according to ecological criteria, bio-plastics can be applied as plastic for the aforementioned components. Bio-plastics wherein these are manufactured of renewable raw materials and are moreover biologically degradable.

The bio-plastic can be manufactured from one or more of the following raw materials or basic substances or at least particular consist thereof:

Raw Materials:

- maize
- castor oil plant
- wheat
- wood
- hemp
- palm oil
- sugar cane bamboo
sugar
potatoes
rubber
castor plants/miracle tree Basic Substances:
cellulose
glucose
starch
chitin
lactic acid (PLA)
chitosan The bio-plastic can originate from one of the following main groups:
starch-based bio-plastics
cellulose-base bioplastics
polyhydroxylalkanoates (e.g. PHB, polyhydroxyl butyric acid)
PLA polylactic acid (e.g.. ecovio®)
aliphatic/aromatic copolyester (e.g. Ecoflex®, infinito®)
further bio-plastics, e.g.: lignin-based bioplastics Furthermore, water soluble polymers can also be applied.

It is further possible, for applicators, for example for mascara applicators, to fashion actual applicator from wood. Herein, the applicator can have a layer-like/disc-like construction along the longitudinal axis. This means that the longitudinal axis quasi pierce through the discs and thus rows one after the other. The construction can be effected from individual discs or the applicator for example can be of one piece. The individual discs are herein preferably arranged centrally on the longitudinal axis, wherein the discs can be different with regard to diameter and thickness. The outer geometry of the individual disc can be symmetrical or asymmetrical. The shape of the outer geometry is a closed, preferably round or rounding shape. However, designs in the shape of regular or irregular n-gons are also possible.

Figure 1B:
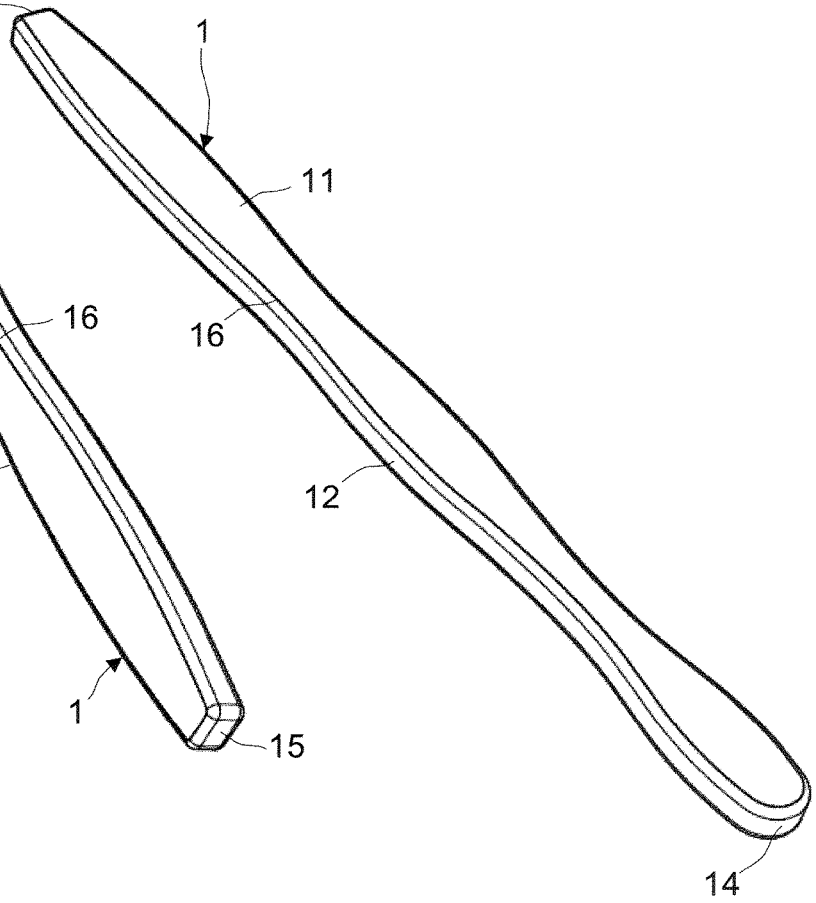
Figure 1F:
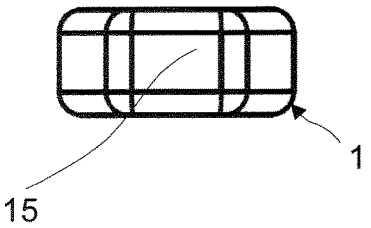
Figure 1G:
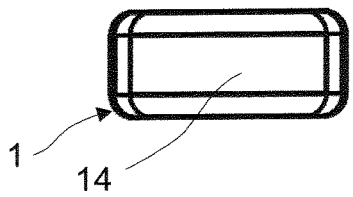
Figure 1C:
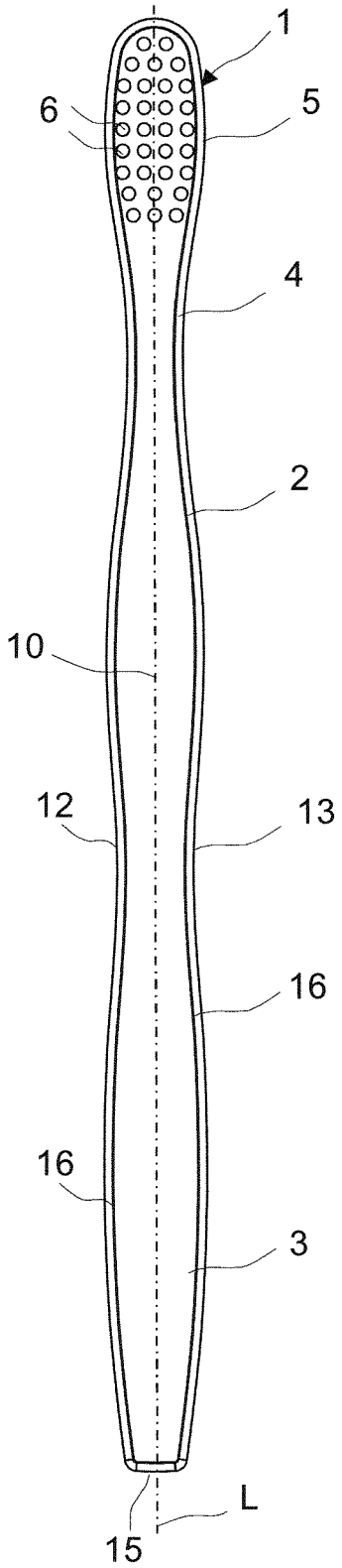

The subject-matter of the invention is hereinafter explained in more detail by way of particular embodiments which are represented in the accompanying figures. Shown schematically in each case are:

FIG. 1*a*: a perspective view of a toothbrush which is known from the state of the art, from the front side;

FIG. 1*b*: a perspective view of the toothbrush according to FIG. 1*a* from the rear side;

FIG. 1*c*: a plan view of the toothbrush according to FIG. 1*a;*

Figure 1D:
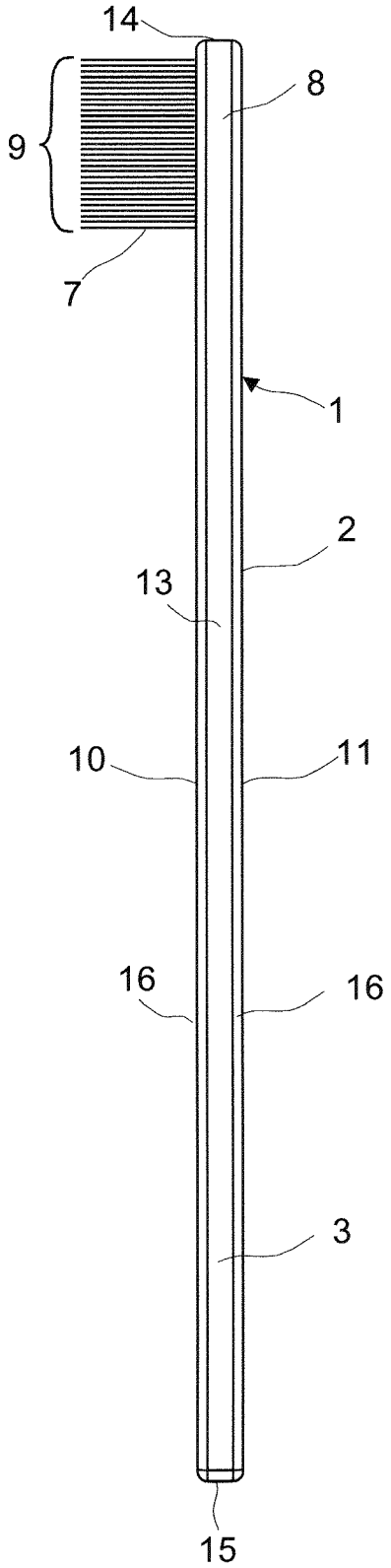
Figure 1E:
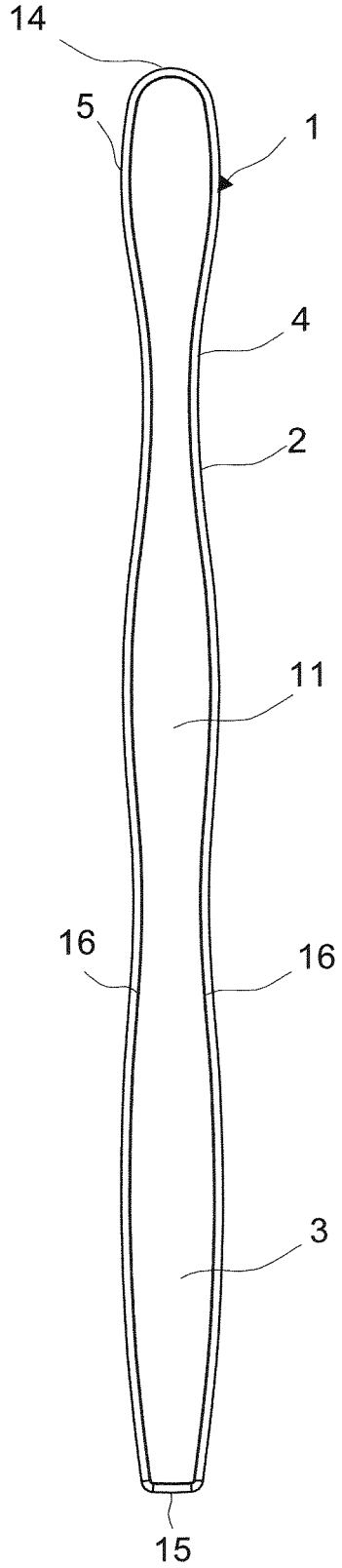
Figure 2D:
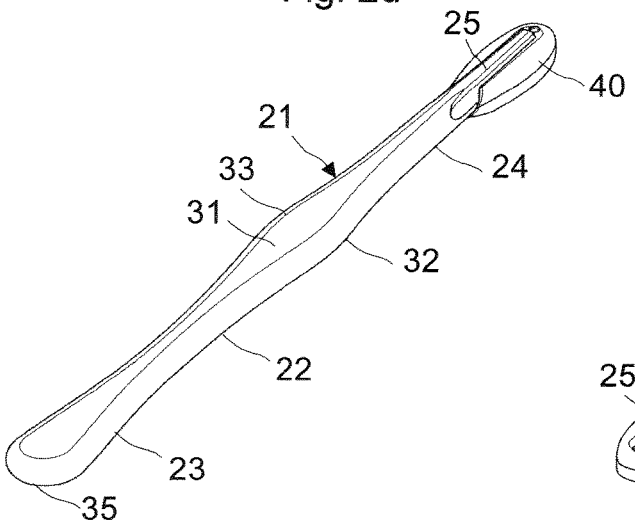
Figure 2B:
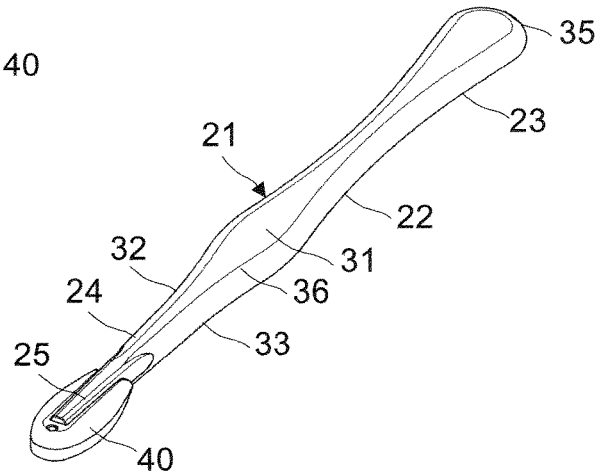
Figure 2A:
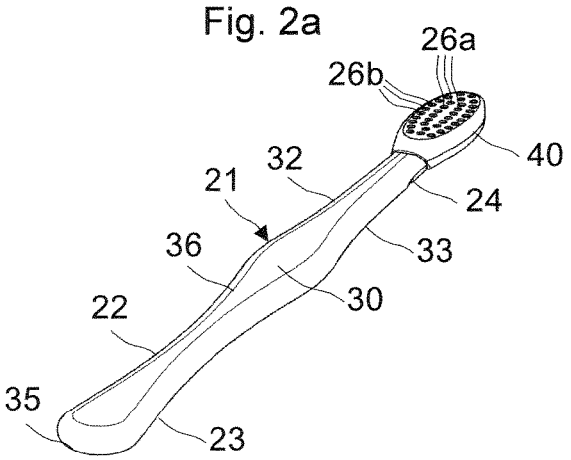
Figure 2C:
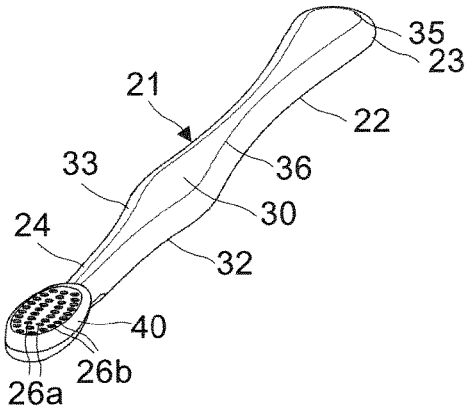
Figure 2E:
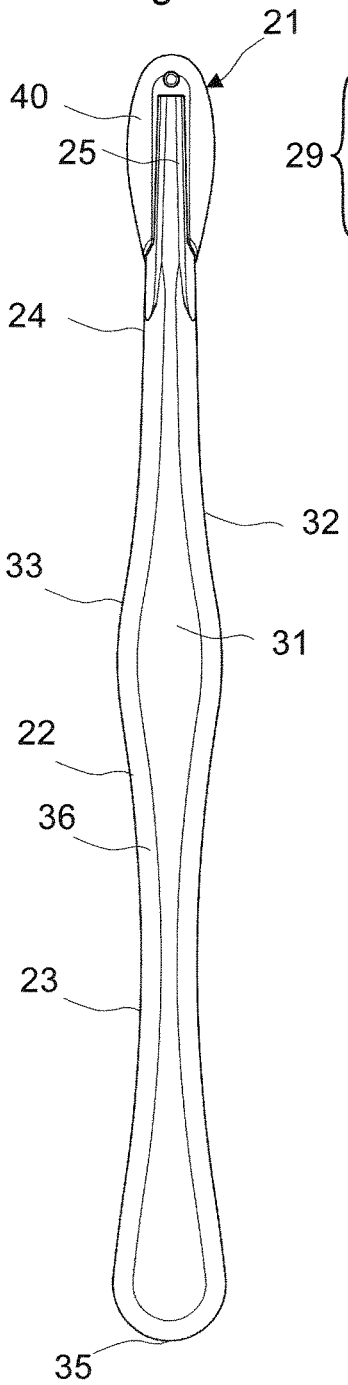

FIG. 1*d*: a lateral view of the complete toothbrush according to FIG. 1*a* with care bristles;

FIG. 1*e*: a rear view of the toothbrush according to FIG. 1*a*; Figure if: a longitudinal plan view of the toothbrush according to FIG. 1*a* from the rear;

FIG. 1*g*: a longitudinal plan view of the toothbrush according to FIG. 1*a* from the front;

FIG. 2*a*: a perspective view of a toothbrush according to the invention from the front side;

FIG. 2*b*: a perspective view of the toothbrush according to FIG. 2*a* from the rear side;

FIG. 2*c*: a further perspective view of the toothbrush according to FIG. 2*a* from the front side;

FIG. 2*d*: a further perspective view of the toothbrush according to FIG. 2*b* from the rear side, FIG. 2*e*: a rear view of the toothbrush according to FIG. 2*a;*

Figure 2F:
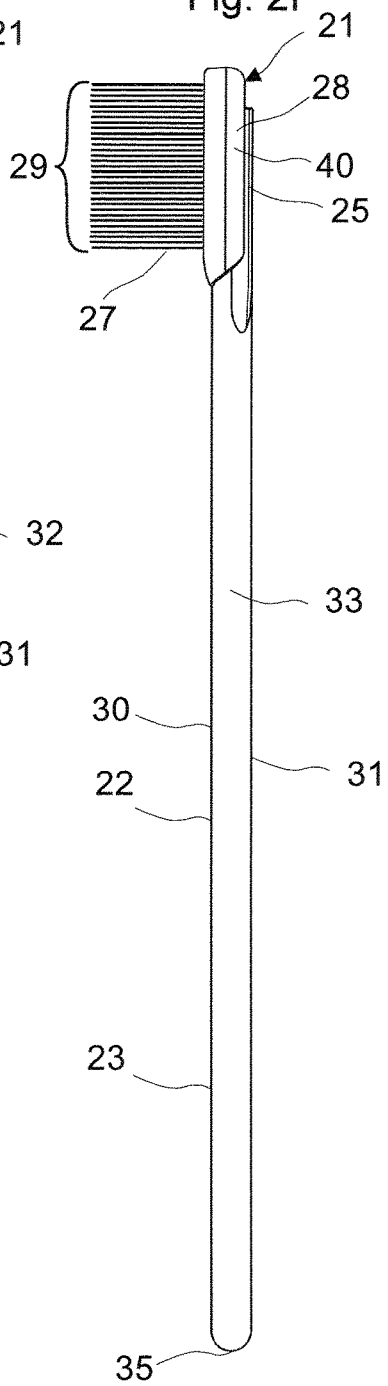
Figure 2G:
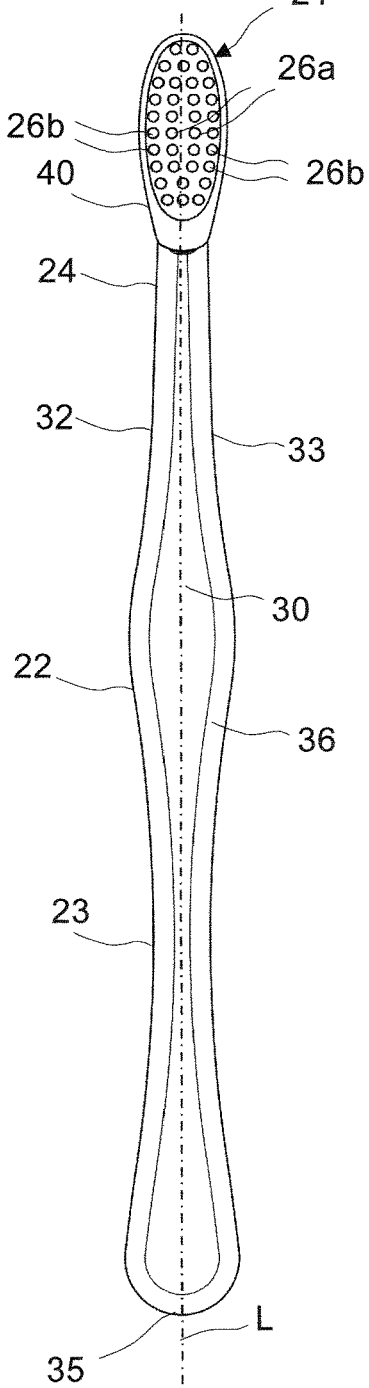

FIG. 2*f*: a lateral view of the complete toothbrush according to FIG. 2*a* with bristles;

FIG. 2*g*: a plan view of the toothbrush according to FIG. 2*a;*

Figure 2H:
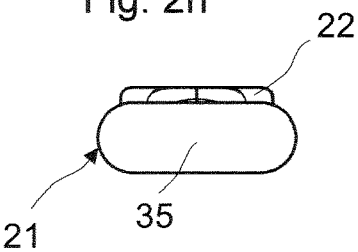
Figure 2I:
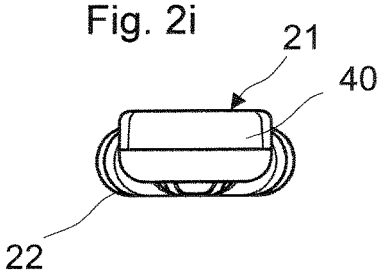
Figure 3A:
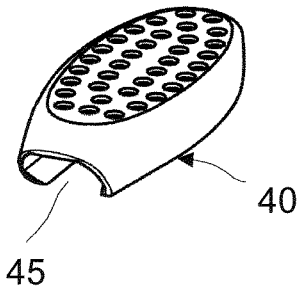
Figure 3B:
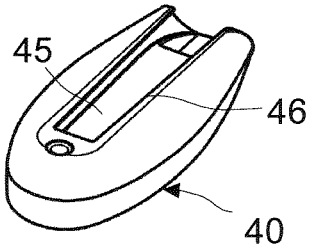
Figure 3C:
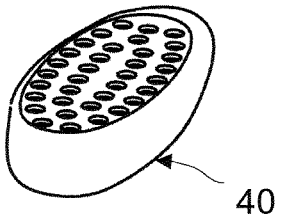
Figure 3D:
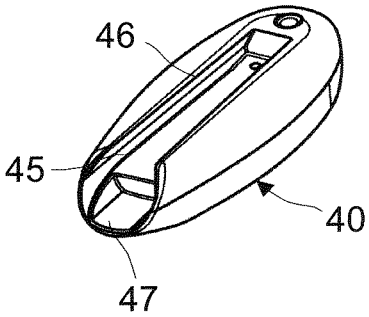
Figure 3E:
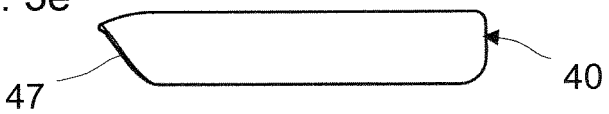

FIG. 2*h*: a longitudinal plan view of the toothbrush according to FIG. 2*a* from the rear;

FIG. 2*i*: a longitudinal plan view of the toothbrush according to FIG. 2*a* from the front;

FIG. 3*a*: a perspective view of a brush head body according to the invention, from the front side;

FIG. 3*b*: a perspective view of the brush head body according FIG. 3*a* from the rear side;

FIG. 3*c*: a further perspective view of the brush head body according to FIG. 3*a* from the rear side;

FIG. 3*d*: a further perspective view of the brush head body according to FIG. 3*b* from the rear side;

FIG. 3*e*: a lateral view of the brush head body according to FIG. 3*a;*

Figure 3F:
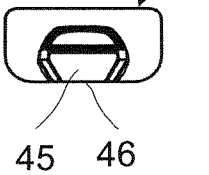
Figure 3H:
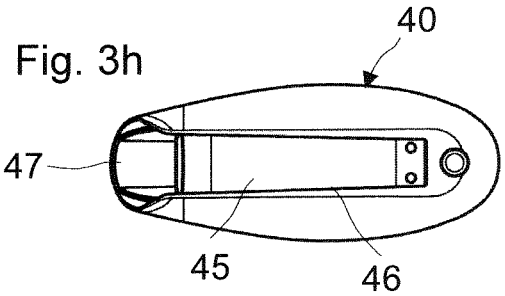
Figure 3G:
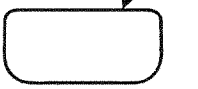

FIG. 3*f*: a longitudinal plan view of the brush head body according to FIG. 3*a* from the rear;

FIG. 3*g*: a longitudinal plan view of the brush head body according to FIG. 3*a* from the front;

FIG. 3*h*: a rear view of the brush head body according to FIG. 3*a;*

FIG. 3*i*: a plan view of the brush head body according to FIG. 3*a;*

Figure 4E:
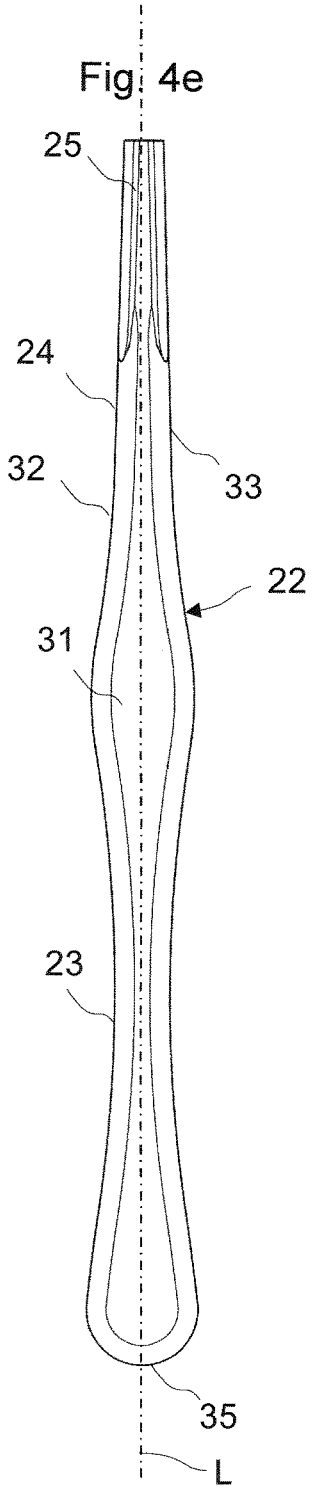

FIG. 3*j*: a cross-sectional view of the brush head body according to FIG. 3*i* along the section line A-A:

FIG. 3*k*: a cross-sectional view of the brush head body according to FIG. 3*i* along the section line B-B;

FIG. 4*a*: a perspective view of a main body according to the invention from the rear side;

FIG. 4*b*: a perspective view of the main body according to FIG. 4*a* from the front side;

FIG. 4*c*: a further perspective view of the main body according to FIG. 4*a* from the rear side;

FIG. 4*d*: a further perspective view of the main body according to FIG. 4*b* from the front side;

FIG. 4*e*: a rear view of the main body according to FIG. 4*a;*

Figure 4F:
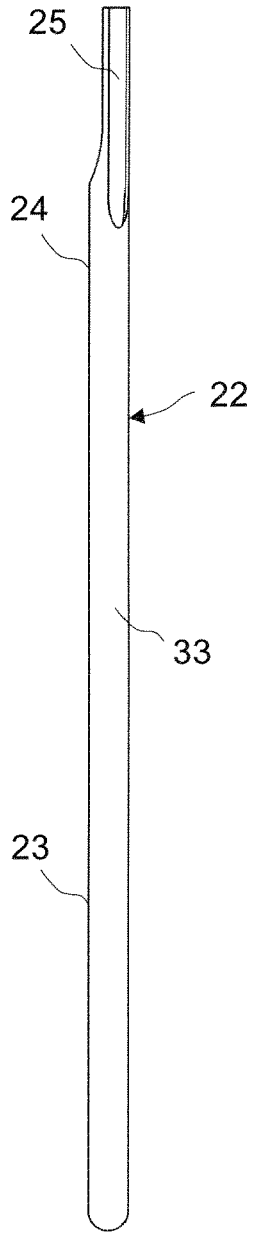

FIG. 4*f*: a lateral view of the main body according to FIG. 4*a:*

Figure 4G:
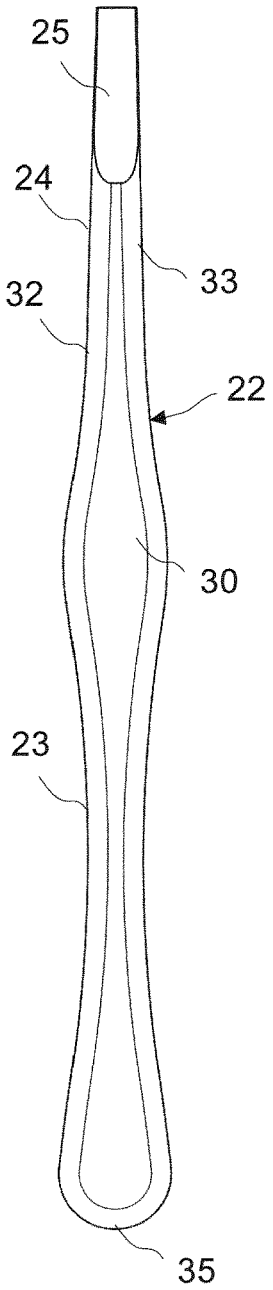

FIG. 4*g*: a plan view of the main body according to FIG. 4*a;*

Figure 4H:
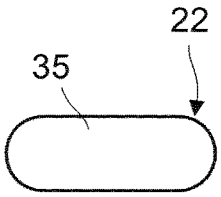
Figure 4I:
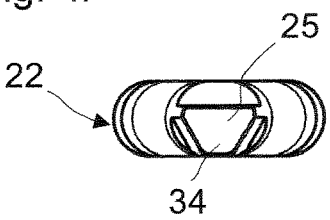
Figure 5A:
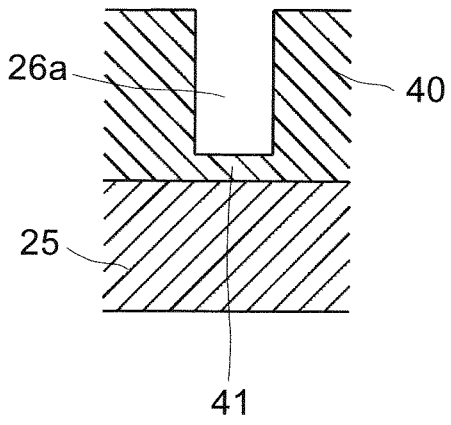
Figure 5B:
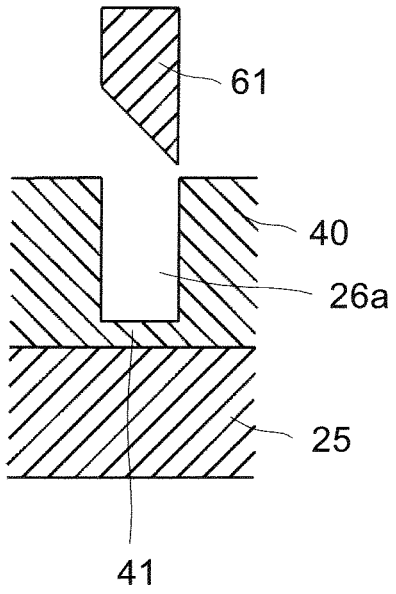
Figure 5C:
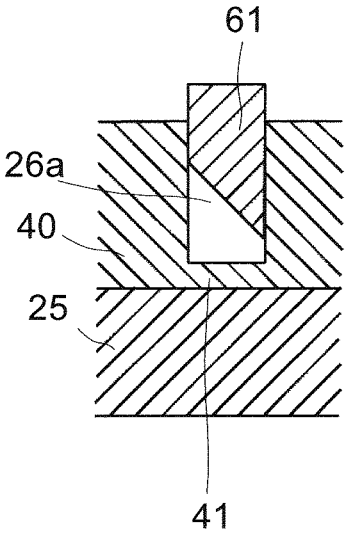
Figure 5D:
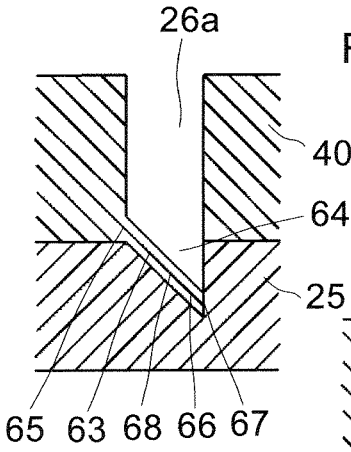
Figure 5E:
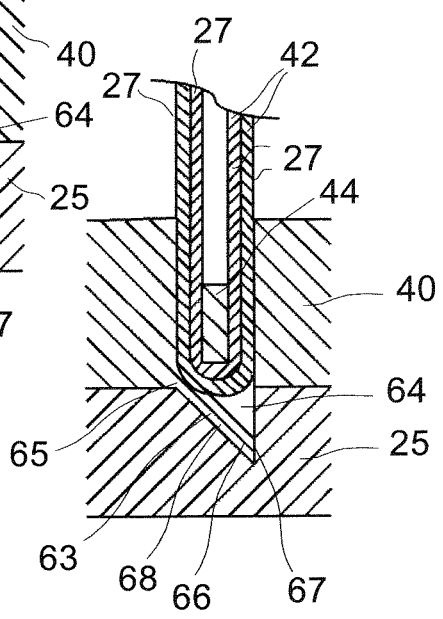
Figure 6:
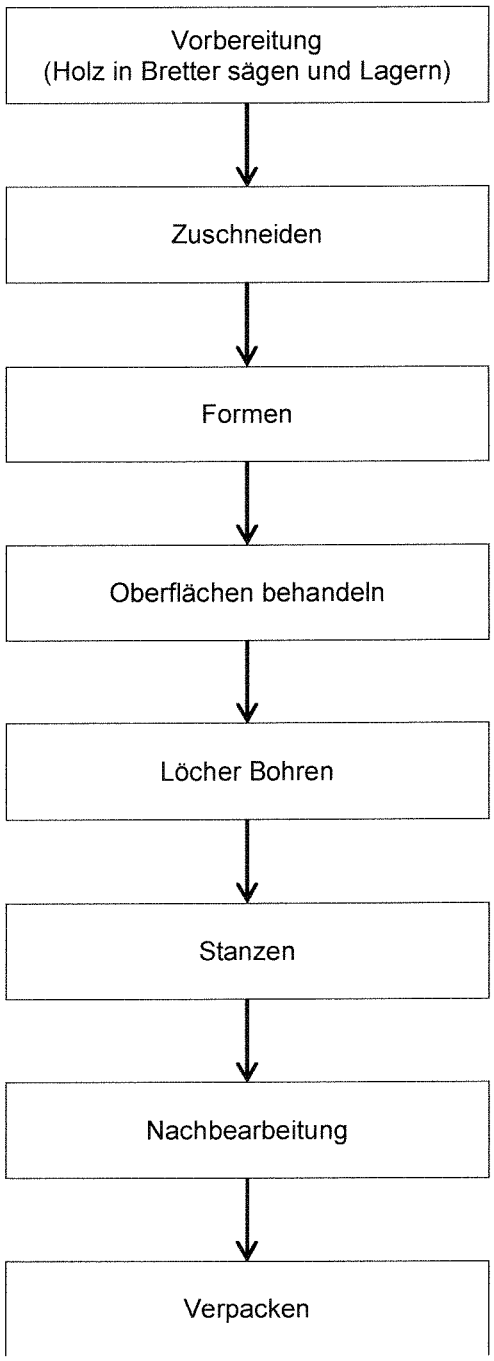
Figure 7:
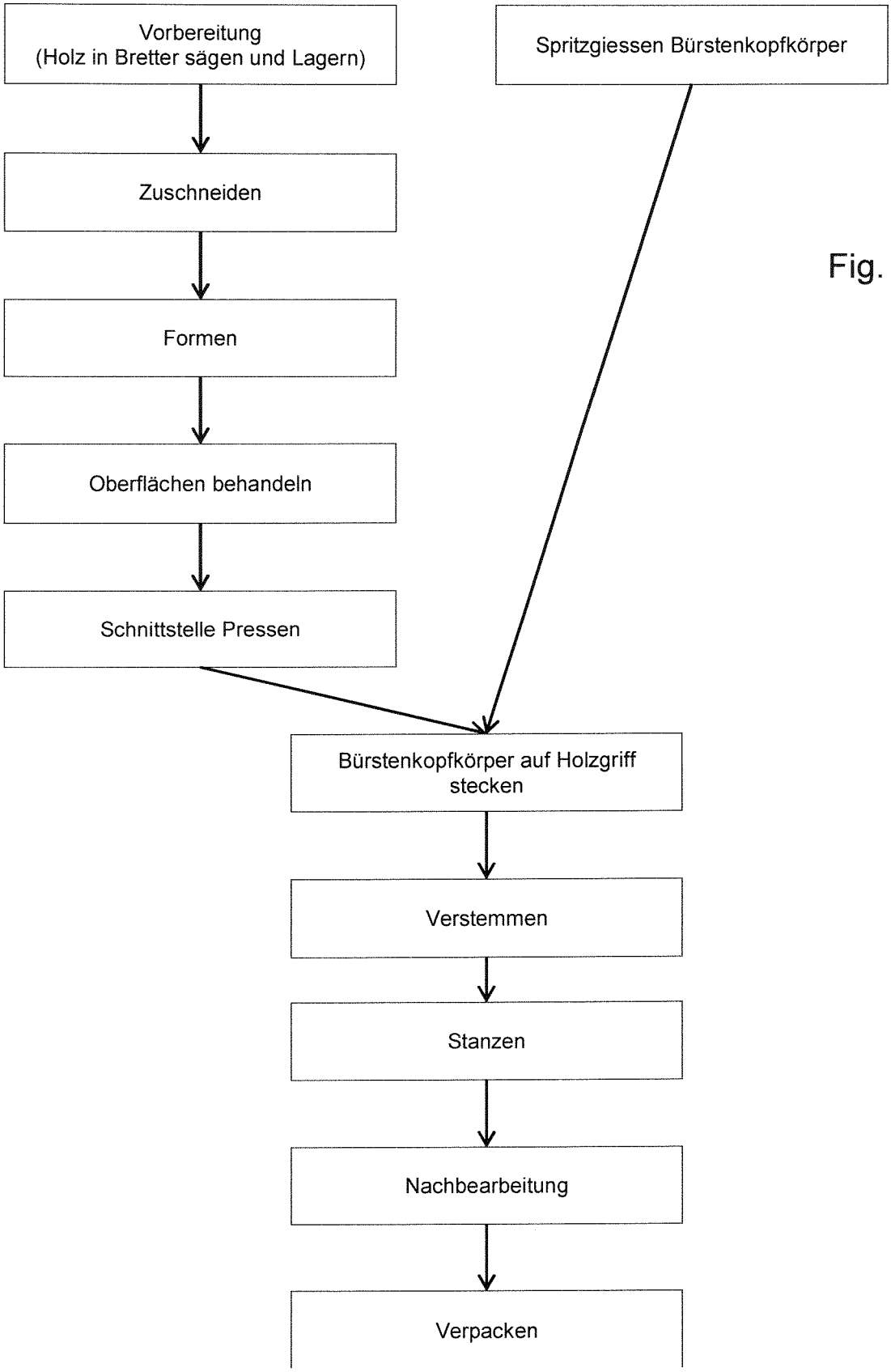
Figure 8A:
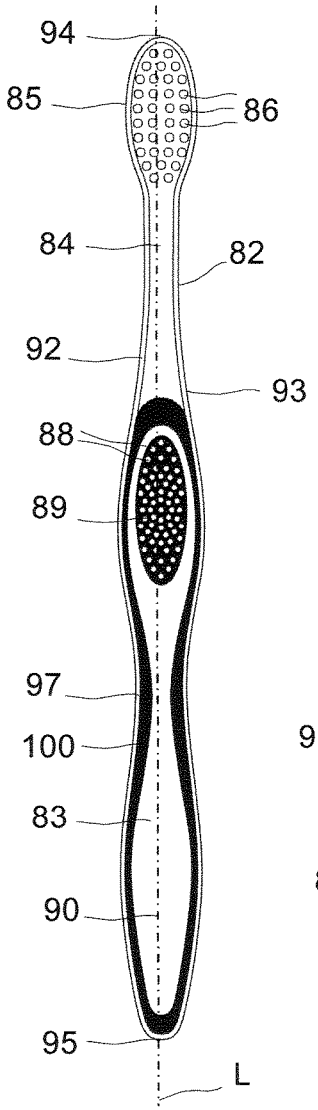
Figure 8B:
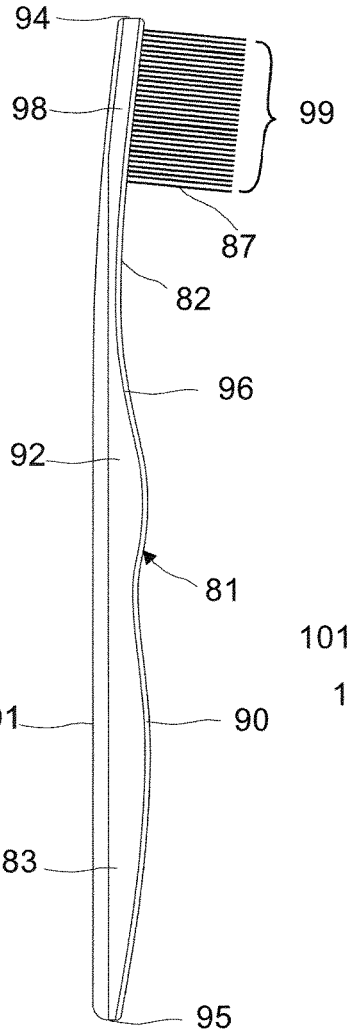
Figure 9A:
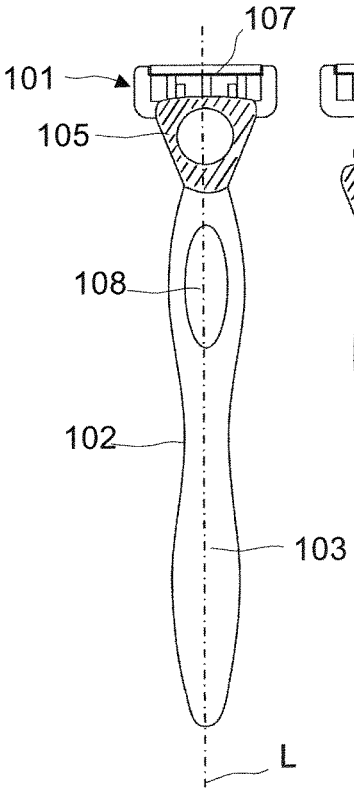
Figure 9B:
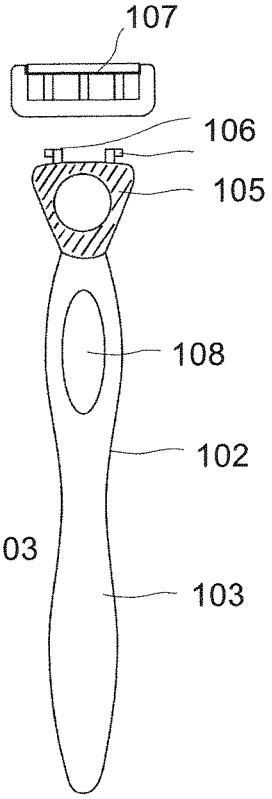
Figure 10A:
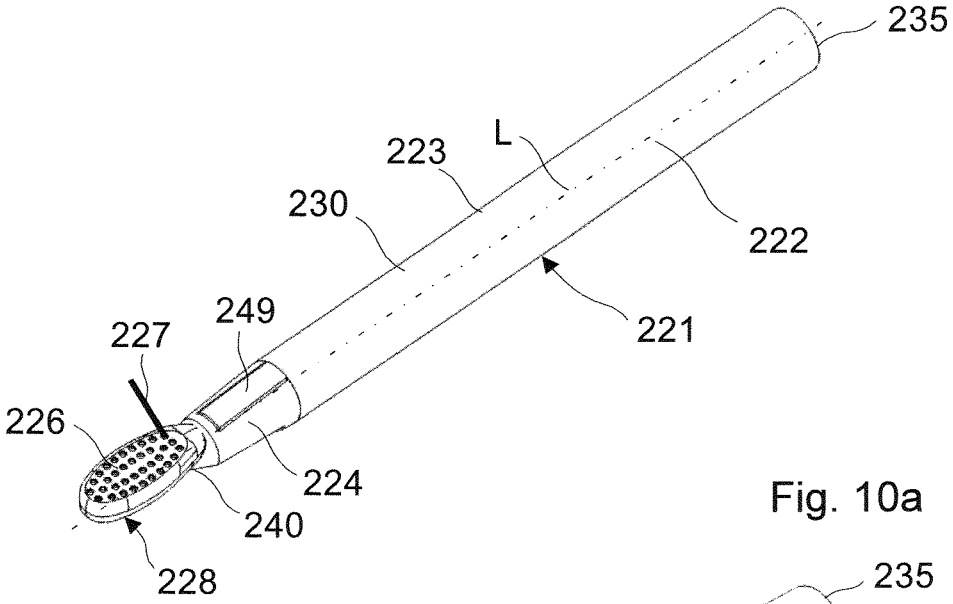
Figure 10B:
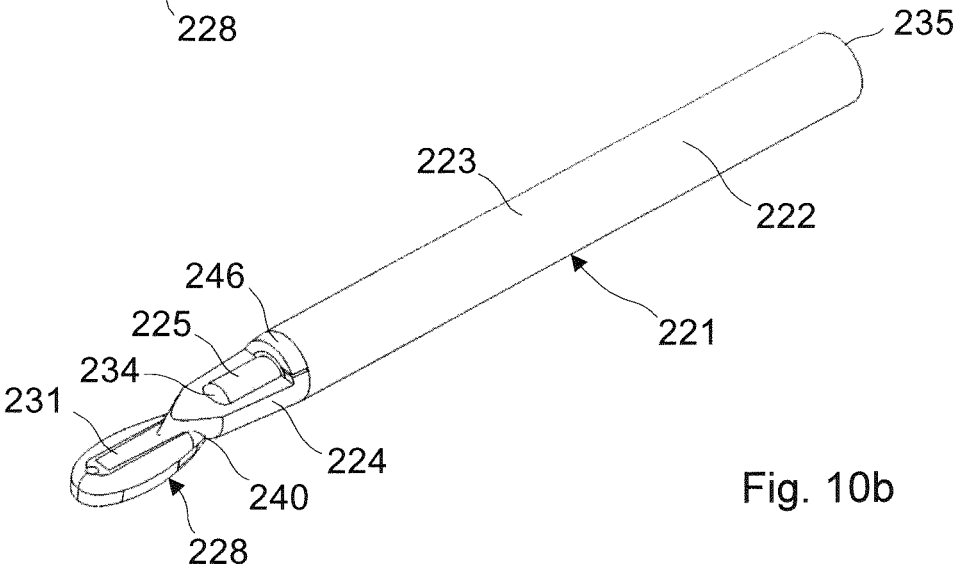
Figure 10C:
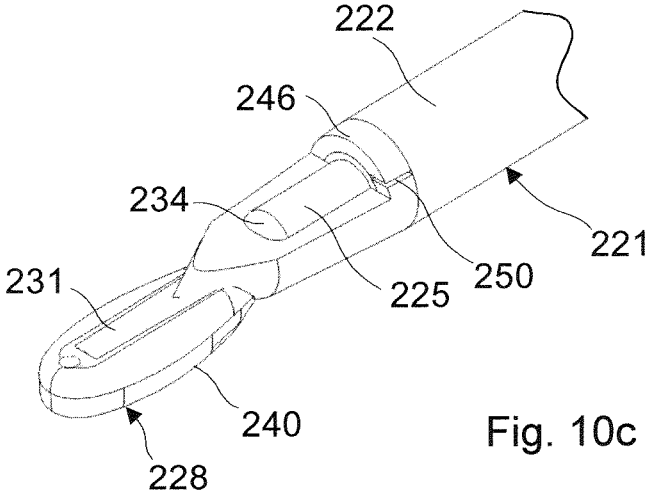

FIG. 4*h*: a longitudinal plan view of the main body according to FIG. 4*a* from the rear;

FIG. 4*i*: a longitudinal plan view of the main body according to FIG. 4*a* from the front;

FIG. 5*a*: a cross-sectional view through a bristle hole in the brush head of a toothbrush to be manufactured according to FIGS. 2*a* to 2*i* before the assembly of the care bristles;

FIG. 5*b*: a cross-sectional view through the bristle hole according to FIG. 5 with a reshaping stamp in the ready position;

FIG. 5*c*: a cross-sectional view through the bristle hole according to FIG. 5*a* with an reshaping stamp inserted into the bristle hole, before the press-fit stemming;

FIG. 5*d*: a cross-sectional view through the bristle hole according to FIG. 5*a* after the press-fit stemming;

FIG. 5*e*: a cross-sectional view through the bristle hole according to FIG. 5*a* with inserted care bristles;

FIG. 6: a process course for manufacturing a toothbrush with a head part of wood;

FIG. 7: a process course for manufacturing a toothbrush with a brush head body;

FIG. 8*a*: a plan view of a toothbrush according to a further embodiment:

FIG. 8*b*: a lateral view of the complete toothbrush according to FIG. 8*a* with bristles;

FIG. 9*a*: a plan view of a wet shaver;

FIG. 9*b*: a plan view of the wet shaver according to FIG. 9*a* with a separated blade head;

FIG. 10*a*: a perspective view of a further embodiment of a toothbrush according to the invention, from the front side;

FIG. 10*b*: a perspective view of the toothbrush according to FIG. 10*a* from the rear side;

FIG. 10*c*: an enlarged perspective view of the rear side of the brush head of the toothbrush of FIG. 10*b;*

Figure 11A:
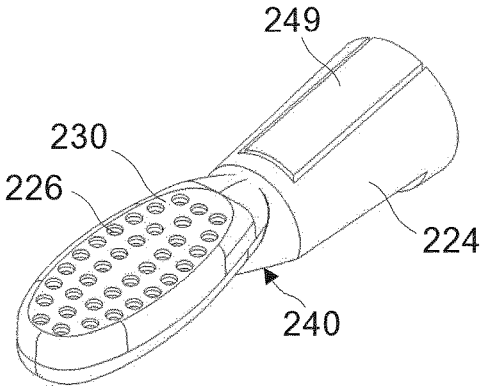
Figure 11B:
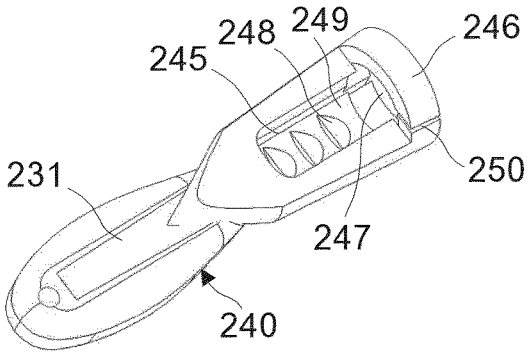
Figure 12A:
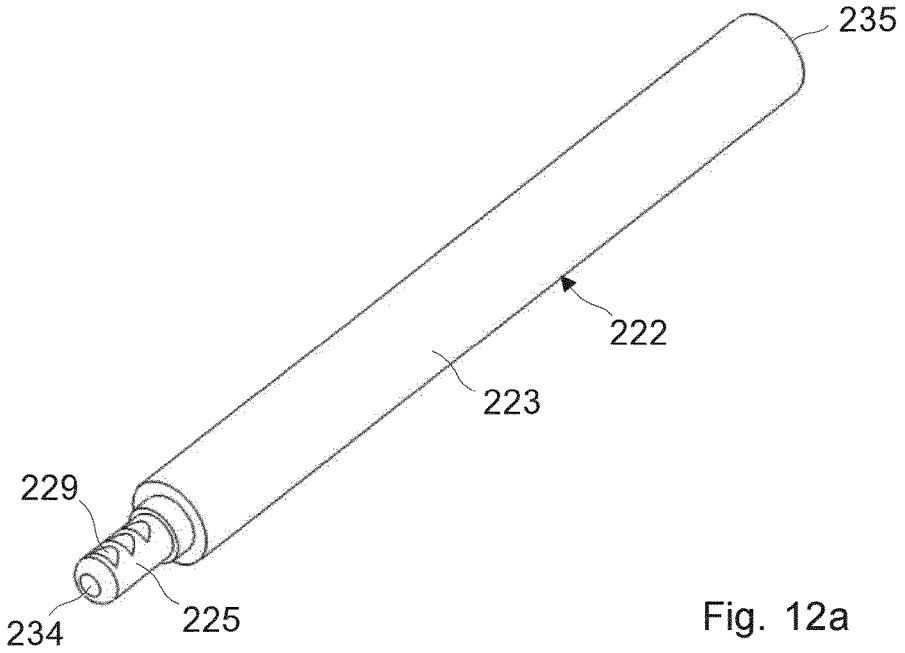
Figure 12B:
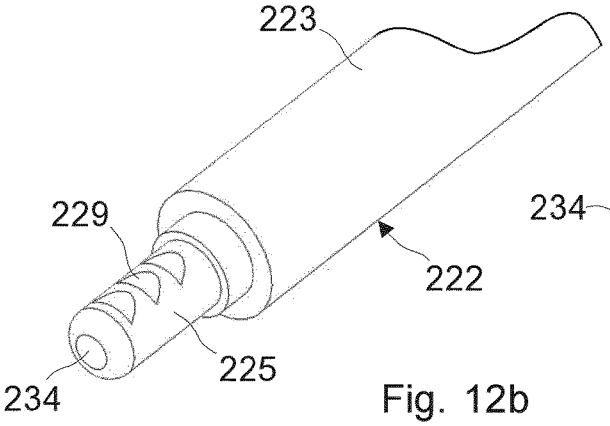

FIG. 11*a*: a perspective view of the brush head body according to the toothbrush of FIG. 10*a* from the front:

FIG. 11*b*: a perspective view of the brush head body according to the toothbrush of FIG. 10*a* from the rear;

FIG. 12*a*: a perspective view of the main body according to the toothbrush of FIG. 10*a* from the front;

FIG. 12*b*: an enlarged perspective view of interface of the main body of the toothbrush of FIG. 12*b;*

Figure 12C:
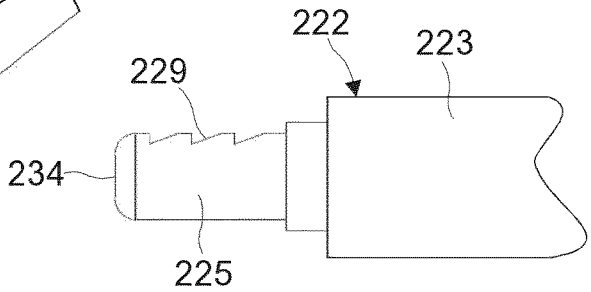

FIG. 12*c*: an enlarged lateral view of the interface of the main body of the toothbrush of FIG. 12*b;*

Figure 13A:
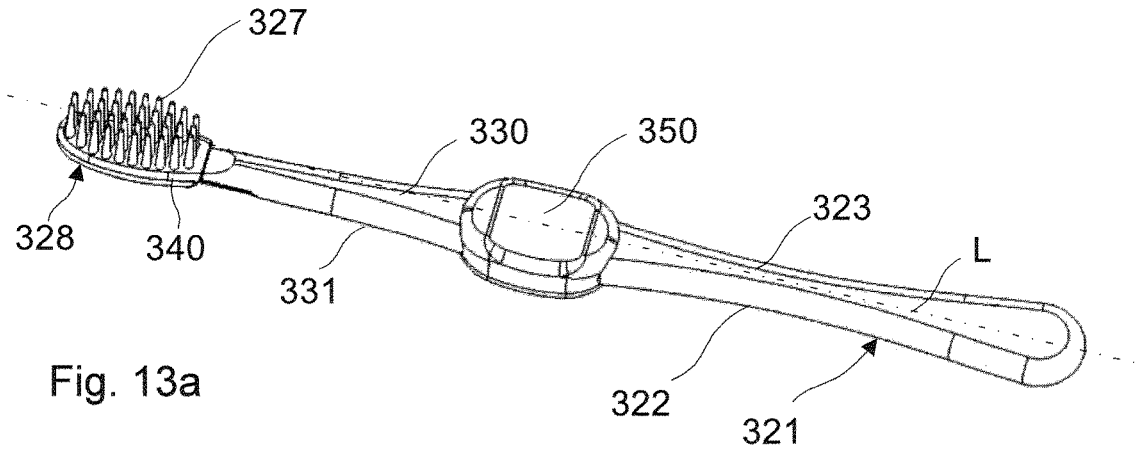
Figure 13B:
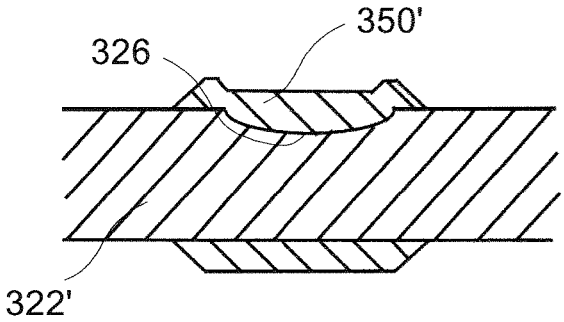
Figure 13C:
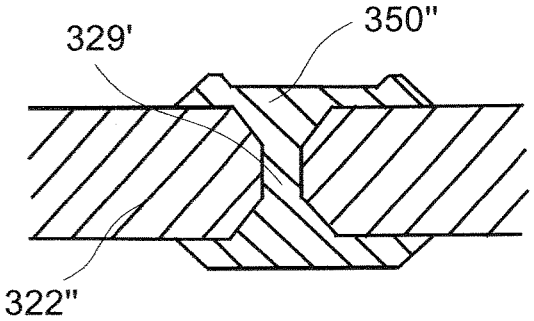
Figure 13D:
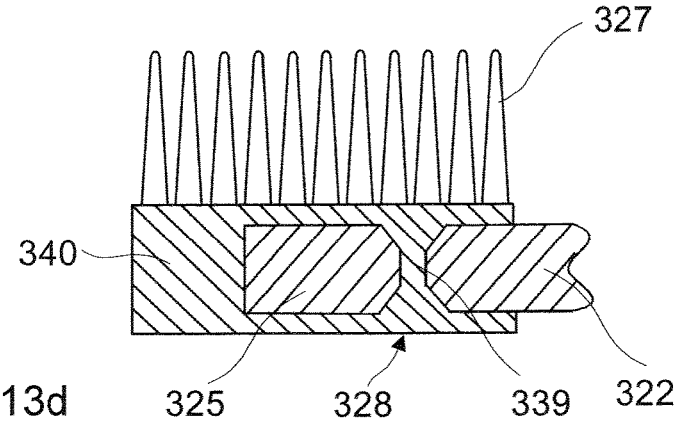

FIG. 13*a*: a perspective view of a further embodiment of a toothbrush according to the invention, from the front side;

FIG. 13*b*: a longitudinal section through the thumb region of the toothbrush of FIG. 13*a* according to a first embodiment variant;

FIG. 13*c*: a longitudinal section through the thumb region of the toothbrush of FIG. 13*a* according to a second embodiment variant;

FIG. 13*d*: a longitudinal section through the head region of the toothbrush of FIG. 13*a;*

FIG. 14*a*: a perspective view of a further embodiment of a toothbrush according to the invention from the rear side;

FIG. 14*b*: a plan view of the toothbrush according to FIG. 14*a;*

FIG. 14*c*: a lateral view of the toothbrush according to FIG. 14*a;*

FIG. 14*d*: a perspective view of the main body of the toothbrush according to FIG. 14*a* from the rear side;

FIG. 14*e*: an enlarged detail (A) of the perspective view of the main body from FIG. 14*d;*

FIG. 14*f*: a perspective view of the brush head body of the toothbrush according to the invention of FIG. 14*a;*

FIG. 15*a*: a perspective view of a further embodiment of a toothbrush according to the invention from the front side;

FIG. 15*b*: a plan view of the toothbrush according to FIG. 15*a;*

FIG. 15*c*: a lateral view of the toothbrush according to FIG. 15*a;*

Figure 15E:
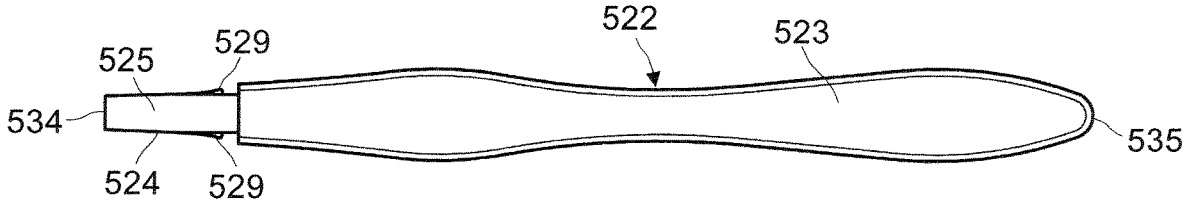

FIG. 15*d*: a perspective view of the main body of the toothbrush according to FIG. 15*a* from the front side;

FIG. 15*e*: a plan view of the main body of the toothbrush according to FIG. 15*a;*

Figure 15F:
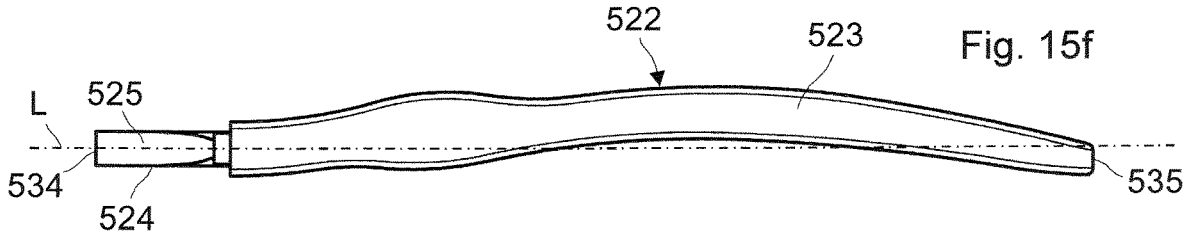

FIG. 15*f*: a lateral view of the main body of the toothbrush according to FIG. 15*a;*

Figure 15G:
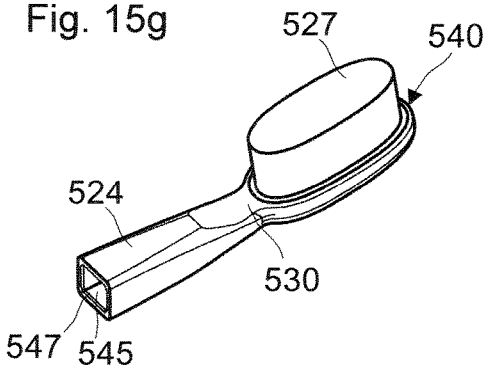
Figure 15H:
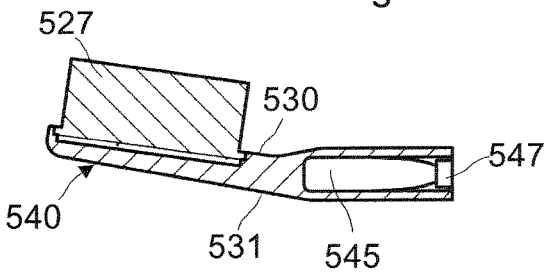

FIG. 15*g*: a perspective view of the brush head body of the toothbrush according to FIG. 15*a* from the front side;

FIG. 15*h*: a longitudinal section through the brush head body of the toothbrush according to FIG. 15*a;*

Figure 15I:
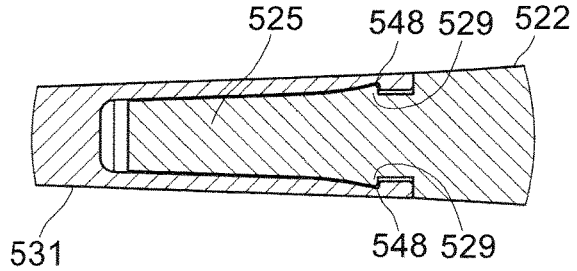

FIG. 15*i*: a longitudinal section through the toothbrush according to the invention and FIG. 15*a* in the region of the connection section;

FIG. 16*a*: a perspective view of a further embodiment of a toothbrush according to the invention from the front side:

FIG. 16*b*: a perspective view of a further embodiment of a toothbrush according to the invention and FIG. 16*a* from the rear side;

FIG. 16*c*: a lateral view of the toothbrush according to FIG. 16*a;*

FIG. 16*d*: a plan view of the toothbrush according to FIG. 16*a;*

FIG. 16*e*: a lateral view of the main body according to the toothbrush according to FIG. 16*a* after the first profiling step;

FIG. 16*f*: a plan view of the main body of the toothbrush according to FIG. 16*a* after the first profiling step.

The present invention is not limited to the embodiments or design variants which are represented in the figures.

Features which are disclosed in the context of certain embodiment examples or figures can be also be conferred upon other embodiment examples or figures which show the same or similar features or manifestations and in which the features or manifestations are however not described or represented to the same degree with regard the detail.

Basically, in the figures, the same parts are provided with the same reference numerals.

FIGS. 1*a* to 1*e* show an embodiment example of a toothbrush 1 with a main body 2 of wood.

The main body 2 comprises a front side 10 as well as a rear side 11 which lies opposite this. The two sides are designed in a plane manner (see FIGS. 1*a* and 1*b*). Furthermore, the main body 2 considered with a view onto the front side 10 comprises a left longitudinal narrow side 12 as well as a right longitudinal narrow side 13 which connect the front side 10 and the rear side 11 to one another via a chamfered edge 16 as well as laterally delimit these.

The main body 2 comprises a grip part 3 as well as a head part 5 which is connected to the grip part 3 via a neck section 4. The neck section 4 is characterised by a cross-sectional reduction, i.e. narrowing between the grip part 3 and the head part 5.

In the head part 5, the main body 2 forms a front face side 14 as well as in the grip part 3 a rear face side. The front face side 14 in the head part 5 is rounded between the two longitudinal narrow sides 12, 13.

The head part 5 on the front side forms a bristle field 9 of a plurality of care bristles 7. The care bristles 7 for the sake of a better overview are only represented in Figure 1*d*. For receiving the care bristles 7, the head part 5 on its front side forms a plurality of bristle holes 6 (see FIG. 1*c*).

The care bristles 7 are anchored into the bristle holes 6 of the head part by way of a conventional anchor punching method.

The head part 5 together with the care bristles 7 forms the brush head 8 of the toothbrush 1.

FIGS. 2*a* to 2*i* show an embodiment of a toothbrush 21 according to the invention with a main body 22 of wood. The main body 22 is yet shown separately on the FIGS. 4*a* to 4*i*.

The main body 22 comprises a front side 30 as well as a rear side 31 which lies opposite this. Furthermore, the main body 22 considered in the direction of the front side 30 comprise a left longitudinal narrow side 32 as well as a right longitudinal narrow side 33 which connect the front side 30 and the rear side 31 to one another as well as laterally delimit these. The longitudinal narrow sides 32, 33 in cross-sectional view are rounded between the front side 30 and the rear side 31. The rounding faces outwards. Accordingly, the edges 36 between the front side 30 and the longitudinal narrow sides 32, 33 or the rear side 31 and the longitudinal narrow sides 32, 33 are also rounded.

The main body 22 comprises a grip part 23 as well as a connection section 25 which is connected to the grip part 23 via a neck section 24. The neck section 24 is characterised by a cross-sectional narrowing towards the connection section 25 with respect to the grip part 23.

In the connection section 25, the main body 22 forms a front face side 34 as well as in the grip part 23 a rear face side 35.

The toothbrush 21 according to the invention further comprises a brush head body 40 which is stuck onto the main body 22 and is connected to this body via the connection section 25. The brush head body 40 is an injection moulded part of plastic. The brush head body 40 is yet represented separately in FIGS. 3*a*-3*k*.

The brush head body 40 together with the connection section 25 as well as the care bristles 327 forms the brush head. The toothbrush 21 on the front side of the brush head body 40 accordingly forms a bristle field 29 of a plurality of care bristles 27. The care bristles 27 are only shown in FIG. 2*f* for the purpose of a better overview.

For receiving the care bristles, 27, the brush head body 40 on its front side forms a bristle hole field with a plurality of bristle holes 26*a*, 26*b*.

On its rear side, the brush head body 40 forms a connection interface in the form of a slot-like receiver or receiving groove 45, which is orientated in the longitudinal direction of the main body 22 or of the toothbrush 21 and via which the brush head body 40 is stuck or pushed onto the connection section 25 of the main body 22 and is connected to this.

The slot-like receiver or receiving groove 45 comprises a slot opening 46 which is arranged on the rear side and which runs in the longitudinal direction L of the main body 22 or of the toothbrush 21.

The slot-like receiver or receiving groove 45 comprises a face-side insert opening 47 for inserting or pushing the connection section 25 into the slot-like receiver or receiving groove 45. The insert opening 47 is directed towards the grip part 23 of the main body 22 in the assembled state.

The cross-sectional geometry of the slot-like receiver or receiver groove 45 is trapezoidal. The trapezium shape has a longer base side which is directed to the front side, as well as a shorter base side which is directed to the rear side and which in the assembled state is arranged in the slot opening 46. The two trapezium limbs which connect the two base sides to one another taper to one another towards the shorter base side (see FIG. 3*k*).

The slot-like receive or receiving groove 45 is designed in a conically tapering manner towards the head end (see FIG. 3*h*).

The cross-sectional geometry of the connection section 25 is trapezoidal. The trapezium shape has a longer base side which is directed towards the front side of the toothbrush 21 as well as a shorter base side which is directed towards the rear side of the toothbrush 21. The two trapezium limbs which connect the base sides to one another taper to one another towards the shorter base side (see FIGS. 4*a* and 4*i*).

The connection section 25 is designed in conically tapering manner towards its free end (see FIG. 4*e*).

The cross-sectional geometry of the slot-like receiver or receiving groove 45 is inverted to the cross-sectional geometry of the connection section 25 of the main body 22, so that the connection section 25 with the slot-like receiver or receiving groove 45 forms a positive or frictional fit on joining together.

For creating the connection between the main body 22 and the brush head body 40, the brush head body 40 is stuck or pushed onto the connection section 25 of the main body 22. For this, the connection section 25 is stuck or pushed with its the front side 34 in front, through the face-side insert opening 47 on the brush head body 40 into the slot-like receiver or receiving groove 45 of the brush head body 40.

The stick-on or push-on movement runs in the longitudinal direction L of the main body 22 in the direction of the grip part 23.

The stick-on direction is merely a provisory fastening since the connection is releasable again by way of pulling off the brush head body 40.

The brush head body 40 is press-fit stemmed to the connection section 25 for creating a non-releasable connection. The press-fit stemming is effected via bristle holes 26*a* which are arranged over the connection section 25. In the present embodiment example, this relates to the inner-lying rows of bristle holes 26*a* (see FIG. 3*i*). The bristle holes 26*a* are designed as blind holes and have a bristle hole base 41 (see FIG. 3*j*).

The sequence of the press-fit stemming procedure is represented in FIGS. 5*a* to 5*e*.

In a first step, the brush head body 40 is stuck onto connection section 25 as already described above. The bristle holes 26*a* do not yet comprise care bristles (see FIG. 5*a*).

A notching stamp 61 with a wedge-like active section is inserted into a bristle hole 26*a* and is moved towards the bristle hole base 41 which bears on the connection section 25 (see FIG. 5*b*, 5*c*).

The bristle hole base 41 is partially broken out of the brush head body 40 by way of the advanced notching stamp 61, but a connection zone 65 remain connected to the brush head body 40 (see FIG. 5*d*).

The partially broken-out or pressed-out bristle hole base 41 forms a lobe-like engagement element 63. The lobe-like engagement element 63 forms a free end section 66 with a front end-face 67 which lies opposite the connection zone 65. Furthermore, the lobe-like engagement element forms the lateral end-faces 68.

A notch 64 is pressed into the connection section 25 by the wedge-like active section of the notching stamp 61 simultaneously with the breaking or pressing of the bristle hole base 41 out of the brush head body 40. The compliant wood material is compressed in the region of the notch 64 (see FIG. 5*d*).

The lobe-like engagement element 63 is pressed into the notch 64 by the notching stamp 61 and projects into the notch 64 at an angle of 45° relative to the surface of the connection section 25, into which surface the bristle hole 26*a* is recessed.

According to the present embodiment example, the connection zone 65 in a plan view of the toothbrush 21 is arranged in front of the free end section 66 of the lobe-like engagement element 63 considered in the direction of the brush head end. On applying a pull-out force upon the brush head body 40, accordingly a pressure acts upon the front end-face 67 of the free end section 66 of the press-fit stemmed engagement element 63.

The notching stamp 61 is pulled out of the bristle hole 26*a* subsequently to the press-fit stemming (FIG. 5*d*).

In a subsequent method step, the respective bristle hole 26*a* is bristled with care bristles 27 by way of an anchor punching method. For this, several filaments 42 are bent in a U-shaped manner and are inserted or punched into the bristle hole 26*a* by way of a punch (not shown). With this procedure, an anchor element 44 is also inserted into the bristle hole 26*a* which is placed in the U-shaped end section of the bent filaments 42. The anchor element 44 is wedged to the bristle hole walls, by which means the filaments 42 are anchored in the bristle hole 26*a* and form a bristle bundle of care bristles 27 (FIG. 5*e*).

The wedged anchor element 44 as well as the care bristles 27 which are anchored by this have blocking effect or form an obstacle to the moving-back of the lobe-like engagement element 63 out of the notch 61 into the bristle hole 26*a*.

Of course, the bristle holes 26*b* can also be provided with care bristles 27.

FIG. 6 in a sequence diagram once again shows the basic method steps for manufacturing a main body with a head part of wood as well as a toothbrush with such a main body.

The manufacturing method comprises:

the manufacturing of planks from a tree trunk;

the cutting of blanks out of the planks;

the shaping and profiling of a main body from a blank by way of a material-removing machining and possibly by way of a reshaping step;

the treatment of the surface of the main body, such as varnishing, staining, oiling, impregnating;

the drilling of bristle holes in the head part;

the bringing of the care bristles into the bristle holes, e.g. by way of anchor punching, including the profiling and rounding of the care bristles;

the post-machining of the toothbrush, such as cleaning;

the packaging of the toothbrush, e.g. into a box packet.

FIG. 7 in a sequence diagram once again shows the basic method steps for manufacturing a main body of wood according to the invention as well as a toothbrush according to the invention with such a main body and with a brush head body of plastic.

The manufacturing method comprises:

the manufacturing of planks from a tree trunk;

the cutting of blanks out of the planks;

the shaping and profiling of a main body from a blank by way of a material-removing machining and possibly by way of a reshaping step;

the treatment of the surface of the main body, such as varnishing, staining, oiling, impregnating;

the shaping of the cross-sectional geometry of the connection section into its final geometry by way of shape pressing;

the sticking of the brush head body onto the connection section;

the press-fit stemming of the brush head body to the connection section;

the attachment or incorporation of the care bristles into the brush head body, e.g. by way of anchor punching in bristle holes including profiling and rounding the care bristles;

the post-machining of the toothbrush, such as cleaning;

the packaging of the toothbrush, e.g. in a cardboard packet.

Furthermore, the manufacturing method also comprises the manufacture of the brush head body by way of injection moulding which is incorporated into the manufacturing method described above.

The methods which are described above can also be used for the manufacture of other products, as are mentioned further above, e.g. for manufacturing a wet shaver. The brush head body possibly corresponds to a function head body. The bristling step is done away with and is possibly replaced by another production step, by way of which a function head or function element, such a blade head, is connected to the function body, e.g. stuck on.

The toothbrush 81 which is shown in FIG. 8 represents a further development of the toothbrush according to FIG. 1*a* to 1*e*.

The main body 82 comprises a front side 90 as well as a rear side 91 which lies opposite this. Furthermore, the main body 82 considered in the direction of the front side 90 comprises a left longitudinal narrow side 92 as well as a right longitudinal narrow side 93 which via a chamfered edge 96 connect the front side 90 and the rear side 91 to one another as well as laterally delimit these.

The main body 82 comprises a grip part 83 as well as a head part 85 which is connected to the grip part 83 via a neck section 84. The neck section 84 is characterised by a cross-sectional narrowing between the grip part 83 and the head part 85.

In the head part 85, the main body 82 forms a front face side 94 as well as in the grip part a rear face side 95. The front face side 94 in the head part 85 is rounded between the two longitudinal narrow sides 92, 93.

The head part 85 on its front side forms a bristle field 99 of a plurality of care bristles 87. The care bristles 87 are only represented in FIG. 8*b* for the purpose of a better overview. For receiving the care bristles 87, the head part 85 on its front side forms a plurality of bristle holes 86. The care bristles 87 are anchored in the bristle holes 86 of the head part 85 by way of a conventional anchor punching method.

The head part 85 together with the care bristles 87 forms the brush head 98 of the toothbrush 81.

The longitudinal narrow sides 92, 93 in a plan view form a curved contour. The curved contour in the grip part 83 effects a first widening of the main body 82, said widening merging into the neck section 84 in the direction of the brush head 91 and into a waisting in the direction of the rear face side 95.

A thumb rest 89 is formed on the front side of the first widening. The thumb rest 89 is shaped in an oval manner and within the oval shape comprises a structuring in the form of a point pattern. The point pattern is formed from point-like prominences or point-like deepenings 88.

The point-like deepenings 88 can be formed by way of milling, embossing or burning in. Point-like prominences 88 can be formed by milling, embossing or burning-in in the surface which surrounds these.

The surface of the thumb rest 89 which surrounds the point-like prominences or deepenings 88 comprises a characterisation such as for example a colour pattern, which contrasts with the wood grain of the main body 82. The characterisation can be effected by way of burning-in, lasering or a printing method.

The front side of the main body 82 furthermore comprises a closed peripheral strip 100 which follows along the chambered edge 96 and thus the curved contour of the longitudinal narrow sides 92, 93. The strip 100 comprises a colour pattern which contrasts with the wood grain of the main body 82. The strip 100 can be deposited onto the front side by way of burning in, lasering or a printing method.

The toothbrush 81 as already mentioned comprises a waisting i.e. a narrow section in the main body 82, said waisting merging into the first widening with the thumb rest 89 in the direction of the brush head 91 and into a second widening of the main body 82 in the direction of the rear grip part end.

The front side of the grip part 83 in a lateral view has a curved contour with alternating thick and thin locations. The grip part 83 thus comprises a first thick location in the region of the thumb rest 89. A further thick location is arranged in the transition from the grip-part-end-side, second widening into the waisting.

The front side of the neck section 84 as well as the front side of the head part 85 are designed in a plane manner. The rear side of the grip part 83 as well as of the head part 85 are likewise designed in a plane manner. In the neck section 84, the toothbrush 81 has a curvature. The curvature is of a nature such that the brush head 98 is inclined to the front side.

The wet shaver 101 which is shown in FIGS. 9*a* and 9*b* comprises a main body 102 of wood, a blade holder body 105 which is connected to the main body 102, as well as a blade head 107 which is releasably mounted by the blade holder body 105. The blade holder body 105 comprises connection elements 106 for creating a releasable connection to be blade head 107.

The main body 105 comprises a grip part 103 for holding the wet shaver 101 by the hand as well as a connection section which is not represented and on which the blade holder body 195 is fastened, in particular in a non-releasable manner.

The main body 105 can be manufactured in an analogous method as the main body for the toothbrush. The associated disclosure in particular with regard to the manufacture of the connection section by way of pressing accordingly also applies here.

In particular, the connection section is a head-side end section on the main body 102. The blade holder body 105 in particular is stuck onto the connection section and is press-fit stemmed to this. The press-fit stemming can be effected in an analogous manner as the stemming of the brush head body. However, the engagement elements are not formed by the bristle hole base. The engagement elements can be released out of the wall section of the blade holder body 105 in the described way and manner.

The embodiment example according to FIGS. 9*a* and 9*b* on the front side of the main body 102 further comprises a finger rest 108 for laying on the index finger during the use of the wet shaver 101.

FIGS. 10 to 10*c* show a further embodiment of a toothbrush 221 according to the invention with a main body 222 of wood. The main body 222 is yet shown separately in the FIGS. 12*a* to 12*c*.

In the present case, the main body 222 in particular is a turned body and comprises a cylindrical basic shape. The main body 222 comprises a grip part 223 as well as a connection section 225 which forms a part of the neck section 224 and is connected to the grip part 223.

In the connection section 225, the main body 222 forms a front side 234 as well as in the grip part 223 a rear face side 235.

The toothbrush 221 according to the invention further comprises a brush head body 240 which is stuck onto the main body 222 via the connection section 225 and is connected to this. The brush head body 240 is an injection moulded part of plastic. The brush head body 240 is yet shown separately in FIGS. 11*a* and 11*b*.

The brush head body 240 together with the care bristles 227 forms the brush head 228. The toothbrush 221 on the front side 230 of the brush head body 240 accordingly forms a bristle field of a plurality of care bristles 227. Only a single bristle bundle with care bristles 227 is represented for the purpose of better overview.

For receiving the care bristles 227, the brush head body 240 on its front side 230 forms a bristle hole field with a plurality of bristle holes 226.

On its section which is directed towards the main body 222, the brush head body 240 forms a connection interface in the form of an open, in particular semi-open, groove-like or slot-like receiver 245 which is orientated in the longitudinal direction L of the main body 222 or toothbrush 221 and via which the brush head body 240 can be stuck or pushed onto the connection section 225 of the main body 22 and connected to this. The groove-like or slot-like receiver 245 in the present case is shaped out in a cylinder-shaped or semi-cylinder-shaped manner.

The semi-open, cylinder-shaped receiver 245 is open at the rear side and at its open end is provided with a receiving ring 246 which is part of the brush head body. The receiving ring 246 encloses an insert opening 247. The insert opening 247 is arranged at the face side, facing towards the connection section 225.

The open part of the brush head body 240 or of the cylinder-shaped receiver 245 is arranged on the rear side of the toothbrush 221 in the assembled state.

The cross-sectional geometry of the cylinder-shaped receiver 245 is round. In the lateral surface of the cylinder-shaped receiver 245, a saw-tooth-shaped latching geometry 248 is formed opposite to the rear-side opening.

A saw-tooth-shaped latching geometry 229 as a counter geometry to the mentioned latching geometry 248 in the receiver 245 is likewise formed in the connection section 225 of the main body 222.

The connection section 225 is designed in a manner tapering conically towards its free end.

The cross-sectional geometry of the cylinder-shaped receiver or receiving groove 245 is designed inversely to the cross-sectional geometry of the connection section 225 of the main body 222, so that the connection section 225 with the cylinder-shaped receiver 245 forms a positive-fit on joining together.

For creating the connection between the main body 222 and the brush head body 240, the brush head body 240 is stuck onto the connection section 225 of the main body 222 or pushed onto this. For this, the connection section 225 with the front face side 234 in front is stuck or pushed through the face-side insert opening 247 which is on the brush head body 240 and is formed by the receiving ring 246, into the cylinder-shaped receiver or receiving groove 245 of the brush head body 240.

The stick-on or push-on movement runs in the longitudinal direction L of the main body 222 in the direction of the grip part 223.

The stick-on connection is a non-releasable latching connection which is realised by sticking on. For this, the saw-tooth-shaped latching geometries of the receiver 245 and of the connection section 225 engage into one another.

However, the toothbrush 221 according to the FIGS. 10*a* to 10*c* is designed such that the brush head body 240 and the main body 222 can be separated amid the destruction of the connection. For this, a separation tab 240 which runs in the longitudinal direction L of the brush head body 2240 or of the toothbrush 221 is shaped out in the brush head body 240. The separating tab 249 is arranged on the front side 230 of the brush head body 240 and receives the saw-tooth-shaped latching geometry 248. The separating tab 249 runs from the end of the cylinder-shaped receiver 245 of the brush head body 240 in the direction of the receiving ring 246.

The separating tab 249 is delimited with respect to the remaining bush head body 240 via two weakening lines such as perforation lines, which are run next to one another and are distanced to one another.

The weakening lines are formed in the region of the receiver 245 as well as on the outer side of the brush head body 240.

The design of the weakening lines, on assembly permits a certain resilience of the latching geometry, so that the joining parts can be stuck together and can form a positive fit.

The receiving ring 246 for its part is interrupted at a separating location 250 and can be opened e.g. by hand. After or on opening the receiving ring 246, the separating tab 249 with the saw-tooth-shaped latching geometry together with the receiving ring 246 or a ring sector of the receiving ring 246 can be torn away along the weakening lines.

Subsequent to the tearing-away of the separating tab 249, the brush head body 240 can be separated or parted from the main body 222. In this manner, the different materials, such as wood and plastic can be separated for the waste recycling at the end of the service life of the toothbrush.

The term main body and grip part can be used analogously in the FIGS. 10 to 12.

A further embodiment of a toothbrush 321 comprising a front side 330 and a rear side 331 as well as with a main body 322 of wood and with differently injected-on elements of plastic is shown in FIGS. 13*a* to 13*d*.

The main body 322 comprises a grip part 323, via which the toothbrush 321 is held. A thumb grip body 350 of plastic which forms a thumb rest is formed on the grip part 323.

A connection section 325, via which a brush head body 340 of plastic is connected to the main body 322 is formed at the front end of the main body 322. The care bristles 327 which together with the brush head body 340 form the brush head 328 are arranged on this body.

The care bristles 327 can be injection moulded together with the brush head body 340. Care bristles 327 and the brush head body 340 in particular can be designed in a single-part manner.

The thumb grip body 350 and the brush head body 340 are injected onto the main body 322 by way of an injection moulding method. In particular, this is effected by way of the so-called insert-moulding method. For this, the toothbrush 321 or the main body 322 is inserted into an injection moulding tool and is peripherally injected.

The thumb grip body 350 is connected to the main body 322 in particular with a positive fit for example by way of geometries as are shown in FIGS. 13*b* and 13*c*.

Hence the thumb grip body 350 encompasses the main body 322 in cross section over the whole periphery at least in sections.

According to the embodiment variant according to FIG. 13*b*, a deepening/depression 326 is formed in the main body 322 and this is filled with the material of the thumb grip body 350 and thus provides the thumb grip body 350 with a retention from a pull-out force in the longitudinal direction L of the toothbrush which acts upon this (quasi an undercut). This means that the thumb grip body 350 which is injected onto the main body 322 can no longer be pulled away from the main body 322 on account of this narrowing in the cross section of the main body 322.

According to embodiment variants according to FIG. 13*c*, the main body 322 is provided with an opening 329 which is filled with material of the thumb grip body 350. Thanks to this positive fit through the main body 322, the thumb grip body 350 can no longer be released or pulled away from the main body 322.

The brush head body 340 can be fastened to the main body 322 in a manner comparable to the thumb grip body 350. The brush head body 340 in particular analogously to the methods by way of through-injection which are shown in FIG. 13*c* is connected through an opening 339 in the connection section 325 to the connection section 325 of the main body 322 by way of through-injection.

This method is schematically shown in FIG. 13*d*. The retention by way of through-injection is better than with the connecting by way of a narrowing in the cross section of the main body 322, as is shown in FIG. 13*b* by way of the thumb grip body 350. In particular, this is due to the fact that the brush head body 340 is subjected to a greater loading i.e. forces than the thumb grip body 350.

The FIGS. 14*a* to 14*f* show a further embodiment of a toothbrush 421 according to the invention with a main body 422 of wood. The main body 422 is yet represented separately in the FIGS. 14*d* to 14*e*.

The main body 422 in particular comprises a profiled basic shape as is already shown and described for example in the context of FIG. 2. The main body 422 comprises a grip part 423 as well as a connection section 425 which forms a part of the neck section 424 and is connected to the grip part 423.

In the connection section 425, the main body 422 forms a front face side 434 as well as in the grip part 423 a rear face side 435.

On the front side 430, the grip part 423 forms a thumb rest 432 in the form of a trough. The thumb rest 432 however is not necessary and can also be designed differently.

The toothbrush 421 according to the invention further comprises a brush head body 440 which is stuck onto the main body 422 via the connection section 425 and is connected to this. The brush head body 440 is an injection moulded part of plastic. The brush head body 440 is yet shown separately in FIG. 14*f*.

The brush head body 440 together with the care bristles 427 forms the brush head 428. The toothbrush 421 on the front side 430 of the brush head body 440 accordingly forms a bristle field of a plurality of care bristles 427 (only represented schematically).

For receiving the care bristles 427, the brush head body 440 on its front side 430 forms a bristle hole field as for example also the brush head body 40 according to FIG. 3*a* to 3*k* comprises.

The brush head body 440 on its section which is directed towards the main body 422 forms a connection interface in the form of an open, in particular semi-open, groove-like or slot-like receiver 445 which is oriented in the longitudinal direction L of the main body 422 or toothbrush 445 and via which the brush head body 440 can be stuck or pushed onto the connection section 425 of the main body 422 and connected to this. The groove-like or slot-like receiver 445 can be shaped out e.g. in a cylinder-shaped or semi-cylinder-shaped manner.

The brush head body 440 on its rear side is provided with a separating tab 449 which is pivotably fastened to the remaining brush head body 440. The separating tab 445 is pivotable via the open, cylindrical receiver 445 and closes this in the assembled state.

Hence, the separating tab 449 is pivoted in the direction of the insert opening 447 for fastening the brush head body 440 and laterally latches on the brush head body 440. Herewith, the brush head body 44 is fixedly fastened to the main body 442.

The open section of the brush head body 440 or of the receiver 445 is arranged on the rear side of the toothbrush 421 in the assembled state.

The cross-sectional geometry of the receiver 445 has a similar shape to that in FIG. 2. The separating tab 449 has a saw-tooth-shaped latching geometry 448 which in the closed or assembled state faces towards the connection section 425 of the main body or towards the receiver 445.

Latching geometry means that this is suitable for assuming a latching position with a corresponding counter-geometry.

A saw-tooth-shaped latching geometry 429 as a counter geometry to the mentioned latching geometry 448 of the brush head body 440 is likewise formed in the connection section 425 of the main body 422 and projects into the receiver 445.

The two saw-tooth-shaped latching geometries 429, 448 meshingly engage into one another and thus secure the connection section 425 from being pulled out of the receiver 445.

If the separating tab 449 is already in the latching position before the insertion of the connection section 425 into the receiver 445, then a latching of the two latching geometries 429, 448 takes place on inserting the connection section 425 into the receiver 445.

If the separating tab 449 is not brought into the latching position until after the insertion of the connection section 425 into the receiver 445, then the latching takes place on positioning the separating tab 449 into the assembled position via the connection section 425.

The connection section 425 is designed in a conically tapering manner towards its free end.

The cross-sectional geometry of the receiver or receiving groove 445 is inverted to the cross-sectional geometry of the connection section 425 of the main body 422, so that the connection section 425 forms a positive fit on joining together with the receiver 445.

For creating the connection between the main body 422 and the brush head body 44, the brush head body 440 is stuck onto the connection section 425 of the main body 422 or pushed onto this. For this, the connection section 425 is pushed or inserted with the front face side in front through the face-side insert opening 447 on the brush head body 440 into the cylinder-shaped receiver or receiving groove 445 of the brush head body 440.

The separating tab 449 is subsequently pivoted in the direction of the insert opening 447 and fixed or latched on the brush head body 440.

As already mentioned, the separating tab 449 can also be brought into the latching position before the insertion of the connection section 425 into the receiver 445 of the brush head body 440.

The stick-on or push-on movement runs in the longitudinal direction L of the main body 422 on the direction of the grip part 432.

The stick-on connection with a fixation or latching of the separating tab forms a non-releasable connection between the connection section 425 and the brush head body 440. For this, the saw-tooth-shaped latching geometries of the receiver 445 and of the connection section 425 in particular meshingly engage into one another.

The toothbrush 421 according to FIGS. 14*a* to 14*c* however is designed such that the brush head body 440 and the main body 422 can be separated amid the destruction of the connection. For this, a separating tab 449 which runs in the longitudinal direction L of the brush head body 440 or of the toothbrush 421 is shaped out in the brush head body 440. The separating tab 449 is arranged on the rear side 431 of the brush head body 440 and receives the saw-tooth-shaped latching geometry 448. The separating tab 449 runs from the end of the receiver 445 of the brush head body 440 in the direction of the insert opening 447.

The separating tab 449 is delimited from the remaining brush head body 440 or connected to this via a film hinge. By way of the separation, the connection between the separating tab and the brush head body 440 is destroyed and the brush head body 440 and the main body 422 can be separated or parted. In this manner, the different materials such as wood or plastic can be separated for the waste recycling at the end of the service life of the toothbrush.

Alternatively, the brush head body 440 can be injected with a similar geometry also directly onto the main body 422. A separating tab 449 is likewise formed, and this in an analogous manner permits the separation of the bodies. The separating tab 449 can be delimited with respect to the remaining brush head body 440 via weak locations, such as thin locations in the wall.

FIGS. 15*a* to 15*i* show a further embodiment of a toothbrush 521 according to the invention with a main body 522 of wood. The main body 522 in the FIGS. 15*d* to 15*f* is still represented separately, whilst in FIGS. 15*g* and 15*h* the brush head body is represented separately and in FIG. 15*i* the connection section is shown in a detailed manner in a longitudinal section.

In the present case, the main body 522 in particular has a profiled basic shape. The main body 522 comprises a grip part 523 as well as a connection section 525 which forms a part of the neck section 524 and is connected to the grip part 523.

The main body 522 in the connection section 525 forms a front face side 534 as well as in the grip part 523 a rear face side 535.

The toothbrush 521 according to the invention further comprises a brush head body 540 which is stuck onto the main body 522 via the connection section 525 and is connected to this main body. The brush head body 540 is an injection moulded part of plastic. The brush head body 540 is yet represented separately in the FIGS. 15*g* and 15*h*.

The brush head body 540 together with the care bristles 527 (only represented schematically) forms the brush head 528. The toothbrush 521 on the front side 530 of the brush head body 540 accordingly forms a bristle field of a plurality of care bristles 527.

For receiving the care bristles 527, the brush head body 540 on its front side 530 forms a bristle hole field as for example also the brush head body 40 according to FIG. 3*a* to 3*k* comprises.

The brush head body 540 on its section which is directed to the main body 522 forms a connection interface in the form of a closed, elongate receiver 545 which is orientated in the longitudinal direction L of the main body 522 or of the toothbrush 521 and via which the brush head body 540 can be stuck or pushed onto the connection section 525 of the main body 522 and connected to this. The receiver 545 can be shaped out in e.g. a cylinder-shaped manner, such as rectangular cylinder shaped manner.

The receiver 545 in a receiver section which faces the face-side insert opening 547 comprises lateral latching recesses 548 which form a latching geometry and which interact with laterally projecting latching elements 529 which form a latching geometry on the connection section 525.

By way of latching the projecting latching elements 529 in the latching recesses 548, the brush head body 540 on sticking onto the connection section 445 is releasably fastened on the main body 522. This permits the exchange of the brush head body 540.

However, one can also envisage the brush head body 540 being connected to the connection section 525 in a non-releasable manner, which means not able to be separated without destruction.

The connection section 525 is designed in a conically tapering manner towards its free end.

The cross-sectional geometry of the receiver 545 in particular is inverted to the cross-sectional geometry of the connection section 525 of the main body 522, so that the connection section 525 with the receiver 545 on joining together forms a positive fit.

For creating the connection between the main body 522 and the brush head body 540, the brush head body 540 is stuck onto the connection section 525 of the main body 522 or is pushed onto this. For this, the connection section 525 with the front face side in front is pushed through the face side insert opening 547 on the brush head body 540 into the receiver 545 of the brush head body 540. Herein, the latching geometries 529 and 549 latch into one another or engage into one another.

The stick-on or push-on movement runs in the longitudinal direction L of the main body 522, in particular in the direction of the grip part 523.

However, the toothbrush 521 according to FIGS. 15*a* to 15*c* in particular is designed such that the brush head body 540 and the main body 522 of the connection can be separated again (without destruction). In this manner, an exchange system which permits the exchange of the brush head body can be formed.

For this, the brush head body 540 is pulled away from the main body 522 in the longitudinal direction and the latching geometries detach on exceeding a critical pull-out force. The latching geometries are designed accordingly, so that this feature can be realised. Thus in particular the brush head body 540 has a certain compliance or elasticity in the region of the latching geometry 548 and this permits a moving-back of the latching geometry 548 transversely to the pull-off direction on applying a pull-out force, without this becoming damaged by way of this.

By way of the exchange system, brush head bodies and main bodies of the most varied of materials can be combined with one another and on the other hand in this manner the different materials such as wood and plastic can be separated for waste recycling the end of the service life of the toothbrush.

FIGS. 16*a* to 16*c* show an embodiment example of a toothbrush 621 with a main body 622 of wood. The FIGS. 16*e* and 16*f* show the associated main body 622 after a first profiling step.

The main body 622 comprises a front side 630 as well as a rear side 631 which lies opposite this. The two sides are designed in a profiled manner (see FIGS. 16*a* and 16*b*).

The main body 622 furthermore, considered with a view onto the front side 630, comprises left longitudinal narrow side 632 as well as a right longitudinal narrow side 633 which connect and as well as laterally delimit the front side 620 and the rear side 631 via a chamfered edge 636.

The main body 622 comprises a grip part 623 as well as a head part 625 which is connected to the grip part 263 via a neck section 624. The neck section 624 is characterised by a cross-sectional reduction, i.e. narrowing, between the grip part 623 and the head part 625.

In the head part 625, the main body 622 forms a front face side 634 as well as in the grip part 623 a rear face side. The front face side 634 in the head part 625 is rounded between the two longitudinal narrow sides 632, 633.

The head part 625 on the front side forms a bristle field 629 of a plurality of care bristles 627. For receiving the care bristles 627, the head part 625 on its front side forms a plurality of bristle holes as for example the head part 5 and 85 according to FIGS. 1*a* to 1*e* and FIGS. 8*a* to and 8*b* respectively also comprises.

The care bristles 627 are anchored into the bristle holes 626 of the head part by way of a conventional anchor punching method.

The head part 625 together with the care bristles 627 forms the brush head 628 of the toothbrush 62.

FIG. 16*e* shows a lateral view of the main body 622' after a first profiling step. Herein, the front side and the rear side 631 are already profiled. The later longitudinal narrow sides 632 and 633 have not yet obtained their profiling, which is manifested in the fact that these are still shaped in a straight or plane manner. This is evident in the plan view according to FIG. 16*f*.

Basically, one can also envisage the brush head bodies according to FIGS. 3, 10, 11, 14 and 15 being able to be injected onto the main body or its connection section in an injection moulding method, instead of being stuck onto this.

The invention claimed is:

1. A toothbrush comprising a main body with a grip part and a brush head which forms a bristle field with a plurality of care bristles, wherein the brush head comprises a brush head body made of plastic for receiving the care bristles, the brush head body forms a receiver for receiving a connection section of the main body, the main body consists of wood and at a brush-head-side end section forms the connection section, via which the brush head body is connected to the main body by establishing a positive and/or non-positive connection, at least one engagement element of the brush head body engages into at least one engagement deepening on the connection section, and the at least one engagement element is formed by at least one surface section of a bristle hole base.

2. The toothbrush according to claim 1, wherein the brush head body forms at least one bristle hole which receives at least one care bristle.

3. The toothbrush according to claim 2, wherein the at least one bristle hole is designed as a blind hole and comprises a bristle hole base.

4. The toothbrush according to claim 1, wherein the brush head body and the connection section of the main body each comprise a positive-fit geometry via which a positive connection is formed between the brush head body and the connection section.

5. The toothbrush according to claim 4, wherein the positive-fit geometry is a latching geometry.

6. The toothbrush according to claim 5, wherein the positive-fit geometries comprise saw-tooth structures which mesh into one another.

7. The toothbrush according to claim 4, wherein the positive-fit geometries each comprise deepenings and/or prominences which engage into one another.

8. The toothbrush according to claim 1, wherein the brush head body is designed as a separate component which is connected to the main body by a separate joining step.

9. The toothbrush according to claim 1, wherein a positive-fit geometry, with at least one prominence and/or deepening is formed in the receiver.

10. The toothbrush according to claim 1, wherein the brush head body is designed in a manner removable from the main body or from the connection section of the main body.

11. The toothbrush according to claim 10, wherein the brush head body comprises a detachment element, for pulling off the brush head body from the main body or from the connection section of the main body.

12. The toothbrush according to claim 11, wherein the detachment element forms a wall section of the receiver.

13. The toothbrush according to claim 1, wherein the brush head body is designed as an exchangeable head and is releasably connected to the main body.

14. The toothbrush according to claim 1, wherein the brush head body is press-fit stemmed to the connection section.

15. The toothbrush according to claim 1, wherein the at least one engagement element is designed in a lobe-like manner.

16. The toothbrush according to claim 15, wherein the at least one engagement element projects into the engagement deepening at an angle of more than 0° and less than 90° relative to the surface of the connection section, into which surface the engagement deepening is recessed.

17. The toothbrush according to claim 1, wherein the at least one engagement element which projects into the at least one engagement deepening in the connection section is directed with a free end towards a brush head end.

18. The toothbrush according to claim 1, wherein the brush head body is injected onto the main body.

19. The toothbrush according to claim 1, wherein the front side and the rear side of the grip part of the main body comprise a profiling.

* * * * *